US011072181B2

(12) United States Patent
Horade et al.

(10) Patent No.: US 11,072,181 B2
(45) Date of Patent: Jul. 27, 2021

(54) LIQUID DISCHARGE DEVICE

(71) Applicant: BROTHER KOGYO KABUSHIKI KAISHA, Nagoya (JP)

(72) Inventors: Kenta Horade, Tokai (JP); Mikio Ogawa, Nagoya (JP); Toshiro Ueda, Inazawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/583,923

(22) Filed: Sep. 26, 2019

(65) Prior Publication Data

US 2020/0101749 A1 Apr. 2, 2020

(30) Foreign Application Priority Data

Sep. 28, 2018 (JP) ..... JP2018-185809

(51) Int. Cl.
*B41J 2/175* (2006.01)

(52) U.S. Cl.
CPC ..... *B41J 2/17513* (2013.01); *B41J 2/1752* (2013.01); *B41J 2/17566* (2013.01); *B41J 2/1755* (2013.01); *B41J 2/17556* (2013.01)

(58) Field of Classification Search
CPC ... B41J 2/17513; B41J 2/1752; B41J 2/17566
See application file for complete search history.

(56) References Cited

U.S. PATENT DOCUMENTS 6,520,630 B1 * 2/2003 Oda ..... B41J 2/17503 347/85
6,726,313 B1 * 4/2004 Oda ..... B41J 2/17503 347/85
6,969,161 B2 * 11/2005 Kuwabara ..... B41J 2/17509 347/85
7,465,044 B2 * 12/2008 Fukazawa ..... B41J 2/17509 347/85
9,409,404 B2 * 8/2016 Fukuda ..... B41J 2/19
9,840,085 B2 * 12/2017 Miyako ..... B41J 2/1752
2008/0204488 A1 8/2008 Usui

FOREIGN PATENT DOCUMENTS

JP 2008-213162 A 9/2008

* cited by examiner

*Primary Examiner* — Sharon Polk
(74) *Attorney, Agent, or Firm* — Merchant & Gould P.C.

(57) ABSTRACT

Aspects of a disclosure relates to a liquid discharge device enables previously disabled liquid discharge through a head after a cartridge including a first liquid chamber is replaced and before the liquid level in a second liquid chamber of a tank reaches a predetermined level or higher. Another aspects of the disclosure relates to a liquid discharge device that deactivates an alarm after a cartridge including a first liquid chamber is replaced and before the liquid level in a second liquid reaches a predetermined level or higher.

7 Claims, 29 Drawing Sheets

LIQUID DISCHARGE DEVICE

CROSS-REFERENCE TO RELATED APPLICATION

This application claims priority from Japanese Patent Application No. 2018-185809 filed on Sep. 28, 2018, the content of which is incorporated herein by reference in its entirety.

TECHNICAL FIELD

The present disclosure relates to a liquid discharge device for discharging liquid.

BACKGROUND

A known inkjet printer includes a removable main tank, a subtank storing ink fed from the main tank that has been installed, and an image recording unit that discharges ink from the subtank to print an image (e.g., JP-A-2008-213162). In the above inkjet printer, the main tank and the subtank each have the internal space open to the air. When the main tank is installed in the inkjet printer, the liquid height difference between the internal spaces of the main tank and the subtank (hereinafter, the water head difference) causes ink transfer between the tanks toward the same liquid level under the pressure of water head. The inkjet printer then displays, on a display, a message urging replacement of the cartridge when the residual amount of the ink detected by a residual amount sensor decreases below a threshold, or a message indicating that the ink cartridge is empty. The inkjet printer then disables the ink discharge through the image recording unit when the ink cartridge becomes empty.

SUMMARY

After the main tank is replaced, ink flows from the main tank into the subtank. A residual amount sensor may be provided to detect the ink in the subtank. As the ink flows from the main tank into the subtank, a detection signal from the residual amount sensor changes. In response to a change in the detection signal from the residual amount sensor, the inkjet printer may enable the disabled ink discharge through the image recording unit. However, the ink discharge can remain disabled for a relatively long time until the signal output from the residual amount sensor changes after the ink starts flowing from the main tank into the subtank. The user may thus have an impression that image recording cannot be started readily after the main tank is replaced.

Also, when the detection signal from the residual amount sensor changes, the inkjet printer can delete the message for cartridge replacement or the massage indicating the empty cartridge from the display. However, the message on the display remains for a relatively long time until the signal output from the residual amount sensor changes after the ink starts flowing from the main tank into the subtank. The user seeing the message on the display after replacing the main tank may misunderstand that the main tank replacement has failed. This may also cause an inconvenience to the user to wait for image recording.

One aspects of the present disclosure is directed to a liquid discharge device that enables previously disabled liquid discharge through a head after a cartridge including a first liquid chamber is replaced and before the liquid level in a second liquid chamber reaches a predetermined level or higher.

Another aspects of the present disclosure is directed to a liquid discharge device that deactivates an alarm after a cartridge including a first liquid chamber is replaced and before the liquid level in a second liquid reaches a predetermined level or higher.

DETAILED DESCRIPTION

Figure 1A:
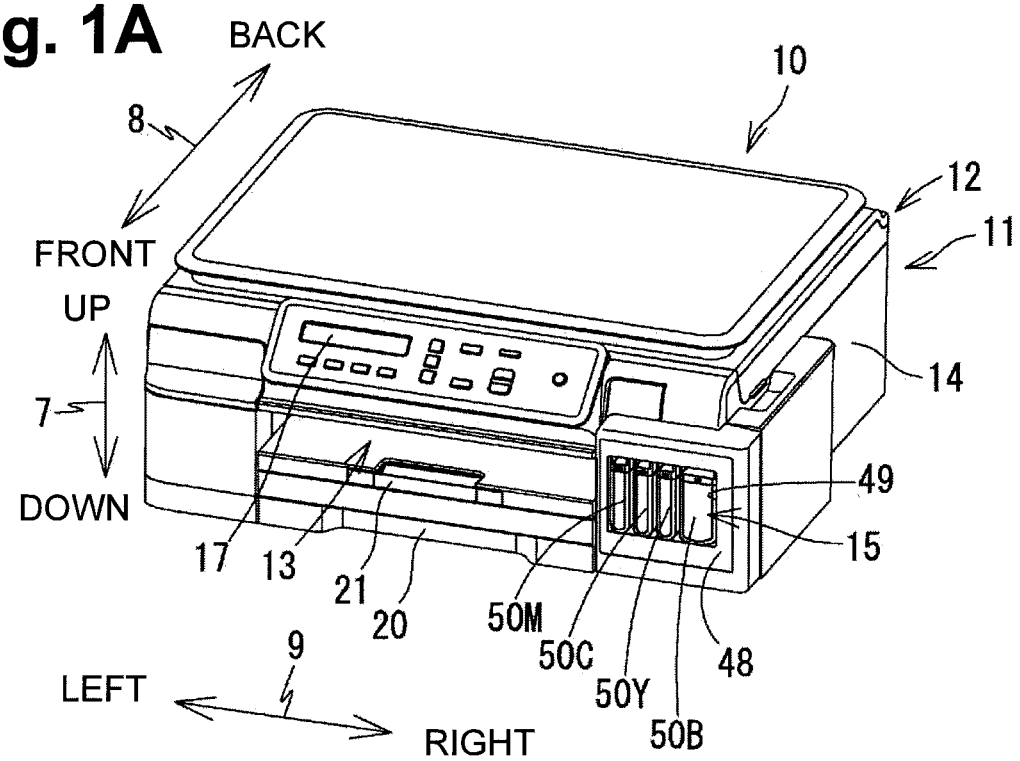
FIG. 1A is an external perspective view of a multifunction peripheral 10 according to a first embodiment with a cover 48 at a closed position.

Embodiments of the present disclosure will be described below. The embodiments described below are merely examples and can be appropriately modified without departing from the spirit and scope of the present disclosure. An up-down direction 7 is defined based on the posture of a multifunction peripheral 10 placed on a horizontal plane with ink cartridges 50 installed for use (posture in FIG. 1, hereinafter referred to as a use posture), a front-back direction 8 is defined using a surface of the multifunction peripheral 10 with an opening 13 as a front surface, and a left-right direction 9 is defined for the multifunction peripheral 10 viewed from the front surface. In the present embodiment, the up-down direction 7 in the use posture corresponds to a vertical direction, and the front-back direction 8 and the left-right direction 9 correspond to a horizontal direction.

First Embodiment

The multifunction peripheral 10 and an ink feeder 15 according to a first embodiment will now be described.

Overall Structure of Multifunction Peripheral 10

Figure 1B:
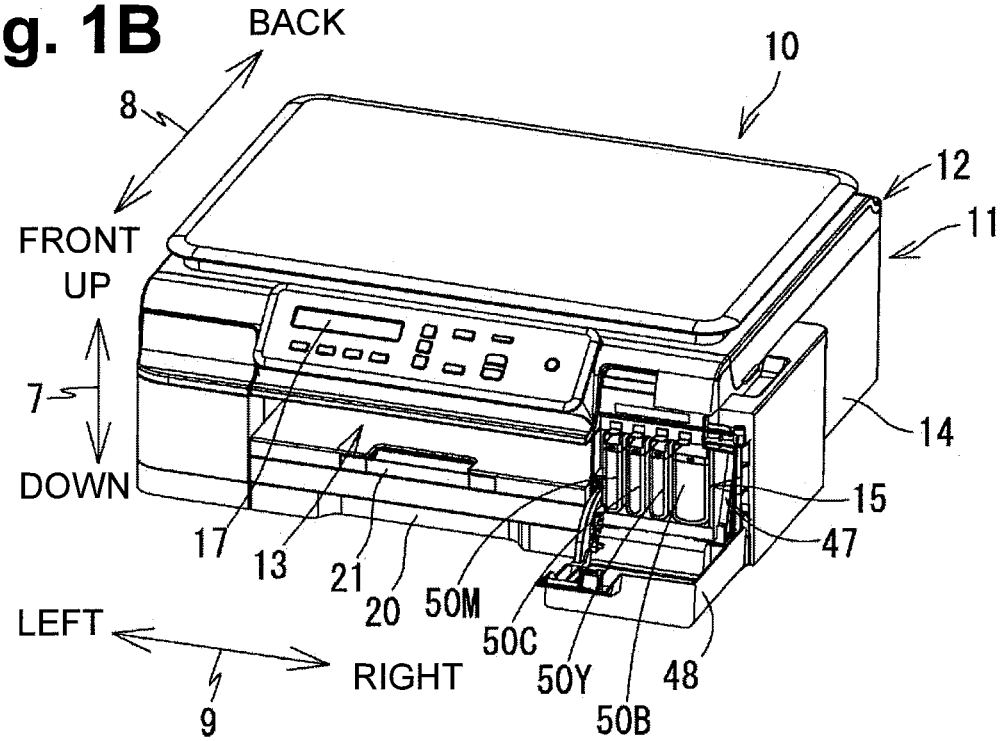
FIG. 1B is an external perspective view of the multifunction peripheral 10 with the cover 48 at an open position.

As shown in FIGS. 1A and 1B, the multifunction peripheral 10 (an example of a liquid discharge device) is in the shape of a substantially rectangular parallelepiped. The multifunction peripheral 10 includes a printer unit 11, a scanner unit 12, and an operation panel 22. The printer unit 11, which is a lower part of the multifunction peripheral 10, records an image on a sheet of paper (sheet 28) with an inkjet recording method (see FIG. 2). The scanner unit 12 with a scanning function is located above the printer unit 11. The printer unit 11 includes a housing 14 having a front opening 13, and the ink feeder 15 on the right of the opening 13 in the housing 14.

The operation panel 22 is located in front of the scanner unit 12. The operation panel 22 is operated by a user to cause the multifunction peripheral 10 to perform image recording by the printer unit 11 or image reading by the scanner unit 12. The operation panel 22 includes a display 17. The display 17 may be, for example, a liquid crystal display or an organic electroluminescence (EL) display, and has a display screen on which various items of information appear. The display 17 is an example of an alarm. However, the alarm is not limited to the display 17, and may be a speaker, a light-emitting diode (LED) lamp, or a combination of these devices. The operation panel 22 outputs an operation signal corresponding to a user's operation to a controller 230. For example, the operation panel 22 may include a push button, or may include a touch sensor overlaid on the display.

Figure 2:
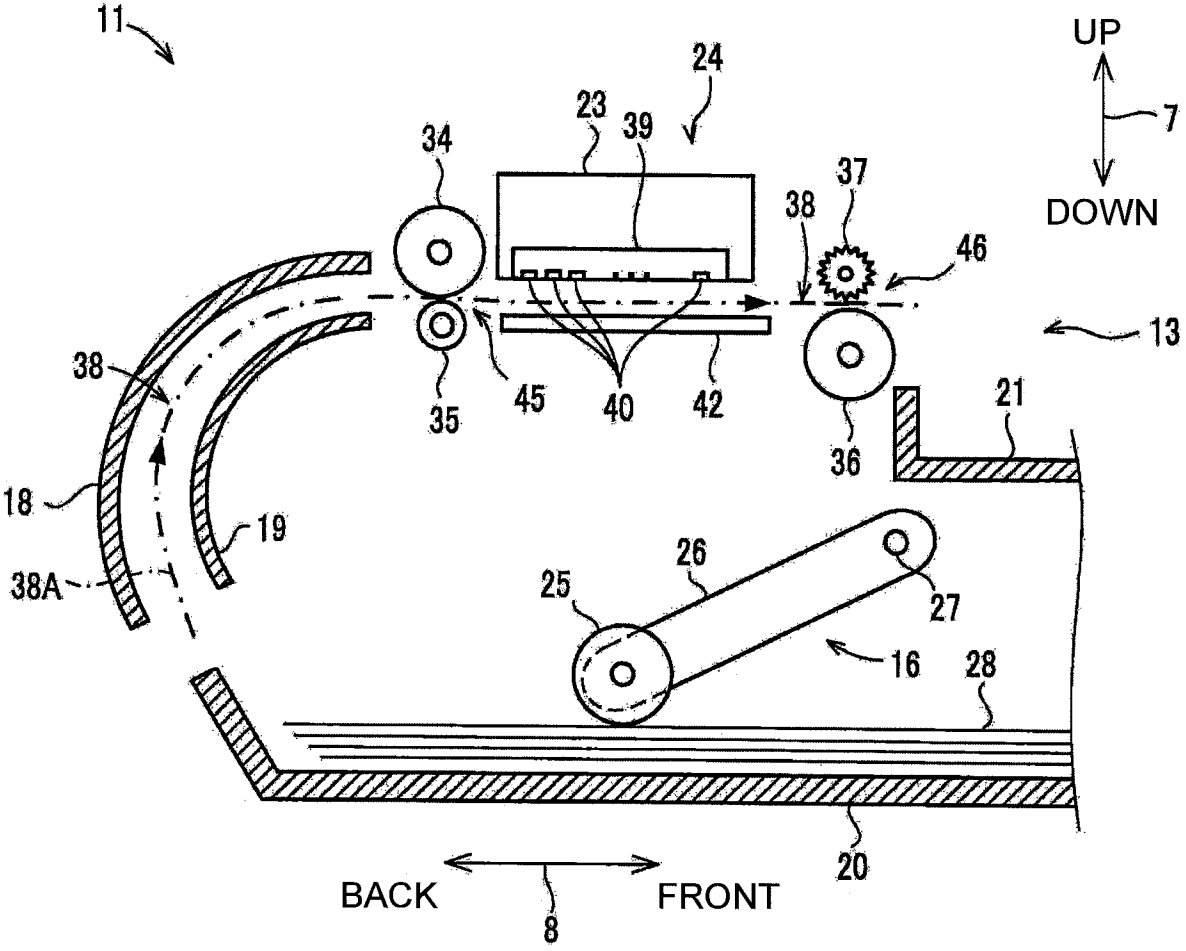
FIG. 2 is a sectional view of a printer unit 11 schematically showing the internal structure.

As shown in FIG. 2, the housing 14 contains a feeder 16, a feed tray 20, a discharge tray 21, a conveyance roller pair 45, a recorder 24, a discharge roller pair 46, and a platen 42.

Feed Tray 20 and Discharge Tray 21

As shown in FIGS. 1A and 1B, the feed tray 20 is insertable into and removable from the housing 14 in the front-back direction 8 through the opening 13. The opening 13 is located in the front surface of the multifunction peripheral 10 in the middle in the left-right direction 9. As shown in FIG. 2, the feed tray 20 can support a plurality of sheets 28 stacked on one another. The discharge tray 21 is located above the feed tray 20, and is inserted or removed in the front-back direction 8 together with the feed tray 20. The discharge tray 21 supports sheets 28 discharged from the discharge roller pair 46.

Feeder 16

The feeder 16 feeds a sheet 28 supported on the feed tray 20 to a conveyance path 38. As shown in FIG. 2, the feeder 16 includes a feed roller 25, a feed arm 26, and a shaft 27. The feed roller 25 is rotatably supported at an end of the feed arm 26. The feed roller 25 is driven by a feed motor (not shown). The feed arm 26 is rotatably supported by the shaft 27 that is supported by a frame of the printer unit 11. The feed arm 26 is rotationally urged toward the feed tray 20 by its weight or by an elastic force from a spring or another member.

Hereafter, the rotation of the feed roller 25, a conveyance roller 34, and a discharge roller 36 for conveyance of the sheet 28 in a conveyance direction 38A of the sheet 28 will be referred to as normal rotation.

Conveyance Path 38

Figure 3:
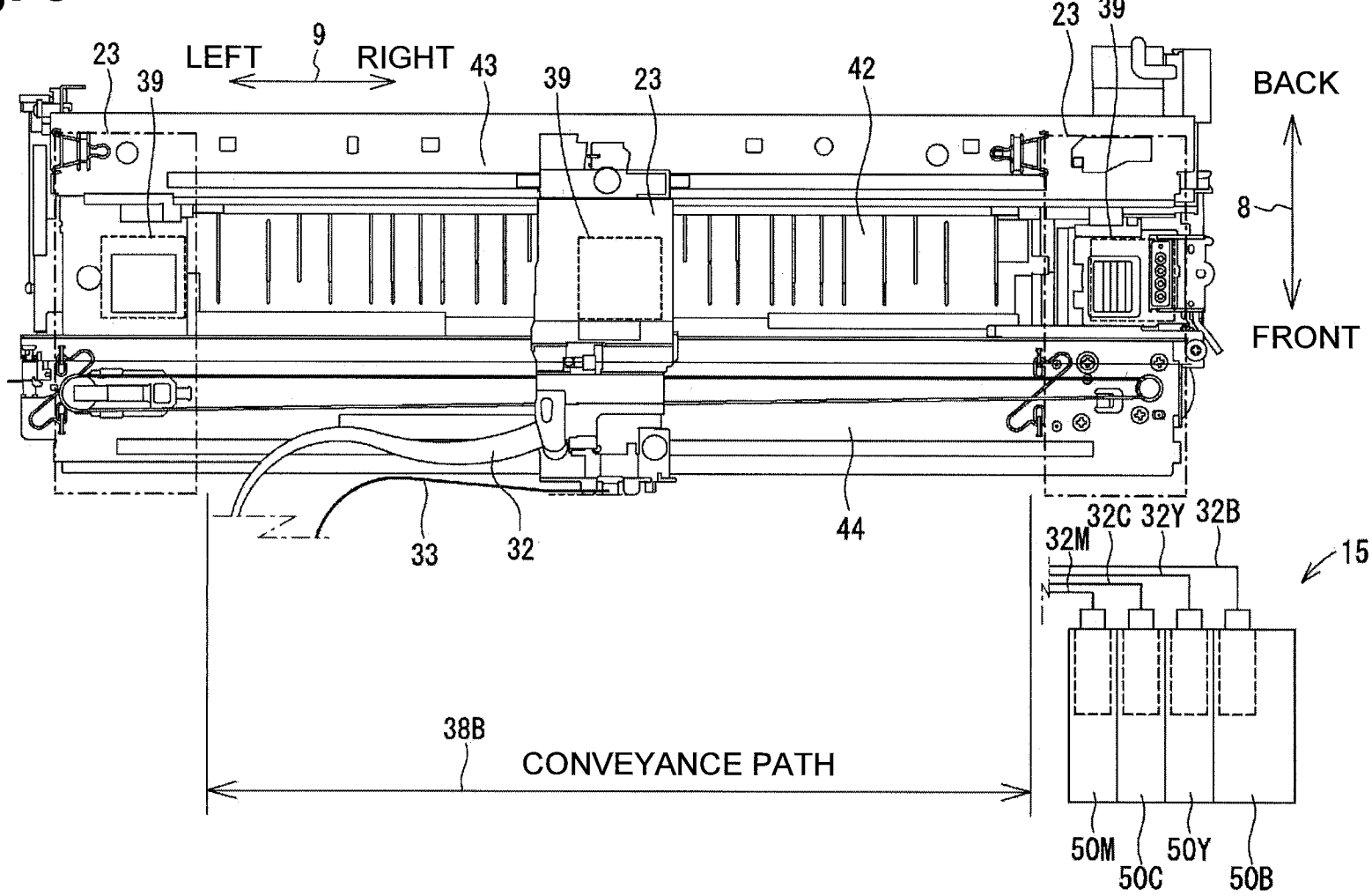
FIG. 3 is a plan view of a carriage 23 and an ink feeder 15 showing their arrangement.

As shown in FIG. 2, the conveyance path 38 is a space partially defined by an outer guide 18 and an inner guide 19 facing each other at a predetermined distance in the printer unit 11. The conveyance path 38 extends rearward from the rear end of the feed tray 20. The conveyance path 38 extends upward at the rear of the printer unit 11, U-turns, and extends forward through a space between the recorder 24 and the platen 42 into the discharge tray 21. As shown in FIGS. 2 and 3, a part of the conveyance path 38 between the conveyance roller pair 45 and the discharge roller pair 46 is located substantially in the middle of the multifunction peripheral 10 in the left-right direction 9, and extends in the front-back direction 8. The conveyance direction 38A of the sheet 28 on the conveyance path 38 is indicated by an arrow in FIG. 2.

Conveyance Roller Pair 45

As shown in FIG. 2, the conveyance roller pair 45 is located upstream from the recorder 24 in the conveyance direction 38A. The conveyance roller pair 45 includes the conveyance roller 34 and a pinch roller 35 facing each other. The conveyance roller 34 is driven by a conveyance motor (not shown) to rotate in normal or reverse direction. The pinch roller 35 rotates in accordance with the rotation of the conveyance roller 34. The sheet 28 is conveyed in the conveyance direction 38A between the conveyance roller 34 and the pinch roller 35 that are rotating in normal direction.

Discharge Roller Pair 46

As shown in FIG. 2, the discharge roller pair 46 is located downstream from the recorder 24 in the conveyance direction 38A. The discharge roller pair 46 includes the discharge roller 36 and a spur 37 facing each other. The discharge roller 36 is driven by the conveyance motor (not shown) to rotate in normal or reverse direction. The spur 37 rotates in accordance with the rotation of the discharge roller 36. The sheet 28 is conveyed in the conveyance direction 38A between the discharge roller 36 and the spur 37 that are rotating in normal direction.

Recorder 24

As shown in FIG. 2, the recorder 24 is located between the conveyance roller pair 45 and the discharge roller pair 46 in the conveyance direction 38A. The recorder 24 faces the platen 42 in the up-down direction 7 across the conveyance path 38. The recorder 24 includes a carriage 23 and a recording head 39 included in the carriage 23.

As shown in FIG. 3, the carriage 23 is supported by guide rails 43 and 44 spaced from each other in the front-back direction 8 and each extending in the left-right direction 9. The guide rails 43 and 44 are supported by a frame (not shown). The carriage 23 is connected to a known belt mechanism included in the guide rail 44. The belt mechanism is driven by a carriage drive motor (not shown) to rotate. As the belt mechanism rotates, the carriage 23 is guided by the guide rails 43 and 44 to reciprocate in the left-right direction 9. The carriage 23 moves beyond the right and left ends of a width 38B of the conveyance path 38, as indicated by dash-dot lines in FIG. 3.

The recording head 39 and four subtanks 100 included in the ink feeder 15 are connected to each other with four ink tubes 32. The recording head 39 is connected to a control board (not shown) with a flexible flat cable 33.

The four subtanks 100 include a magenta subtank 100M, a cyan subtank 100C, a yellow subtank 100Y, and a black subtank 100B. The magenta subtank 100M, the cyan subtank 100C, the yellow subtank 100Y, and the black subtank 100B are herein collectively referred to as the subtanks 100, unless they are distinguished.

The four ink tubes 32 include a yellow ink tube 32Y, a cyan ink tube 32C, a magenta ink tube 32M, and a black ink tube 32B. The yellow ink tube 32Y, the cyan ink tube 32C, the magenta ink tube 32M, and the black ink tube 32B are herein collectively referred to as the ink tubes 32, unless they are distinguished. The four ink tubes 32 are bundled together.

The flexible flat cable 33 electrically connects the control board including a control unit to the recording head 39. The flexible flat cable 33 transfers a control signal output from the control unit to the recording head 39.

As shown in FIG. 2, the recording head 39 includes a plurality of nozzles 40 on its bottom surface. The nozzles 40 have ends exposed at the bottom surface of the recording head 39. The recording head 39 discharges ink through the nozzles 40 as fine droplets. While the carriage 23 is moving, the recording head 39 discharges ink droplets toward the sheet 28 supported on the platen 42. This records an image on the sheet 28. In this process, the ink stored in the four subtanks 100 is used.

Platen 42

As shown in FIGS. 2 and 3, the platen 42 is located between the conveyance roller pair 45 and the discharge roller pair 46 on the conveyance path 38. The platen 42 faces the recorder 24 in the up-down direction 7 across the conveyance path 38. The platen 42 supports the sheet 28 from below when the conveyance roller pair 45 conveys the sheet 28.

Cover 48

As shown in FIG. 1B, the housing 14 has a front right opening 47. The housing 14 contains the ink feeder 15 with a front surface exposed at the opening 47. The housing 14 has a cover 48 attached to open and close the opening 47. The cover 48 has a lower end under the opening 47, which is pivotably supported by the housing 14 about an axis in the left-right direction 9. The cover 48 is pivotable between a closed position (shown in FIG. 1A) at which the opening 47 is closed and an open position (shown in FIG. 1B) at which the opening 47 is open.

As shown in FIG. 1A, the cover 48 has a translucent part 49. The translucent part 49 is translucent to allow the interior to be viewable from outside the cover 48. With the cover 48 at the closed position, the translucent part 49 allows viewing of the front surfaces of the ink cartridges 50 installed in the ink feeder 15.

Cover Sensor 88

Figure 13:
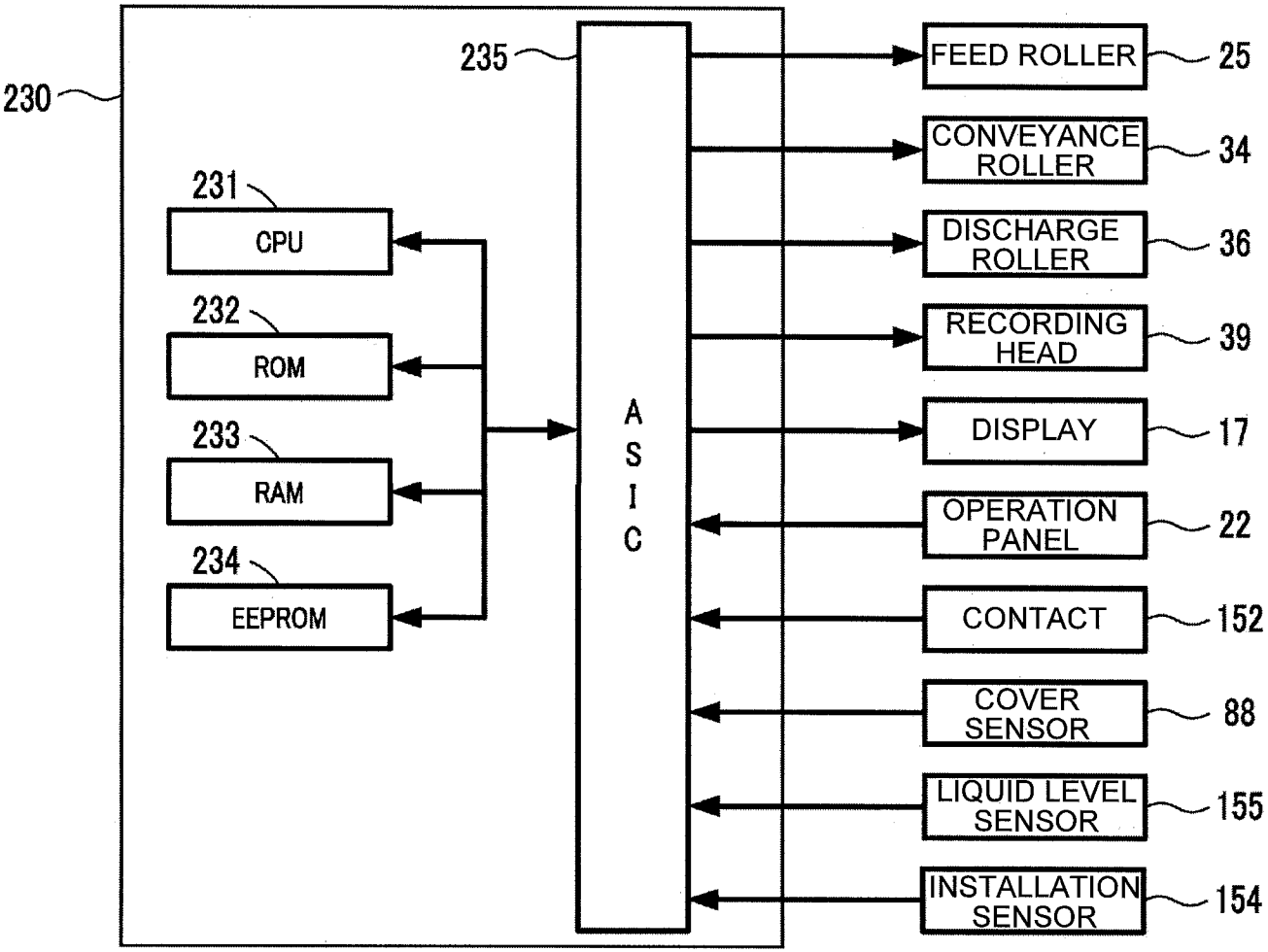
FIG. 13 is a block diagram of the multifunction peripheral 10.

The multifunction peripheral 10 includes a cover sensor 88 (see FIG. 13). The cover sensor 88 may be, for example, a mechanical sensor such as a switch with and from which the cover 48 contacts and separates, or an optical sensor for which light is blocked or transmitted depending on the position of the cover 48. The cover sensor 88 outputs a signal corresponding to the position of the cover 48 to the controller 230. More specifically, the cover sensor 88 outputs a low-level signal to the controller 230 when the cover 48 is at the closed position. The cover sensor 88 outputs a high-level signal having a higher signal intensity than the low-level signal to the controller 230 when the cover 48 is at a position different from the closed position. In other words, the cover sensor 88 outputs a high-level signal to the controller 230 when the cover 48 is at the open position.

Ink Feeder 15

Figure 4:
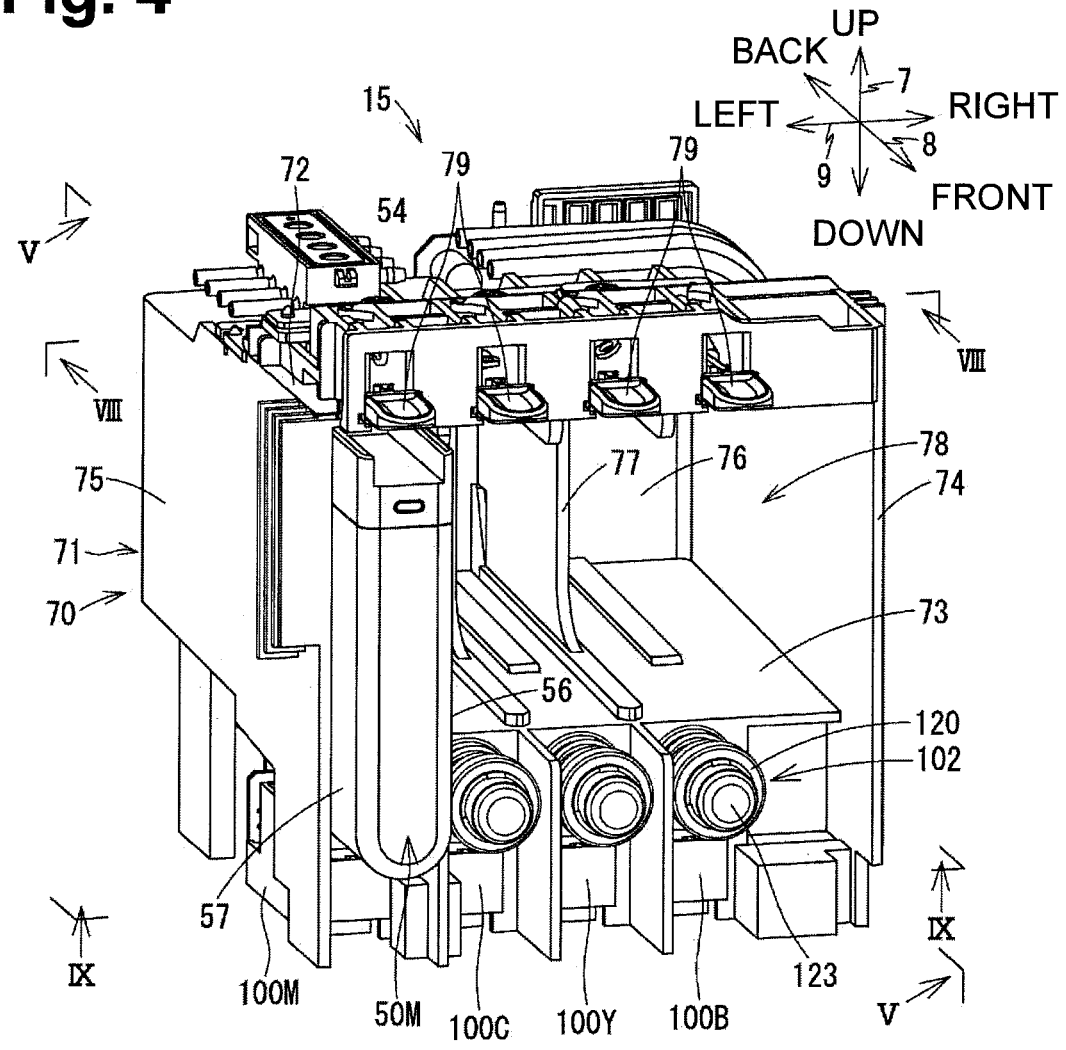
FIG. 4 is a perspective view of the ink feeder 15 viewed from the front left.
Figure 5:
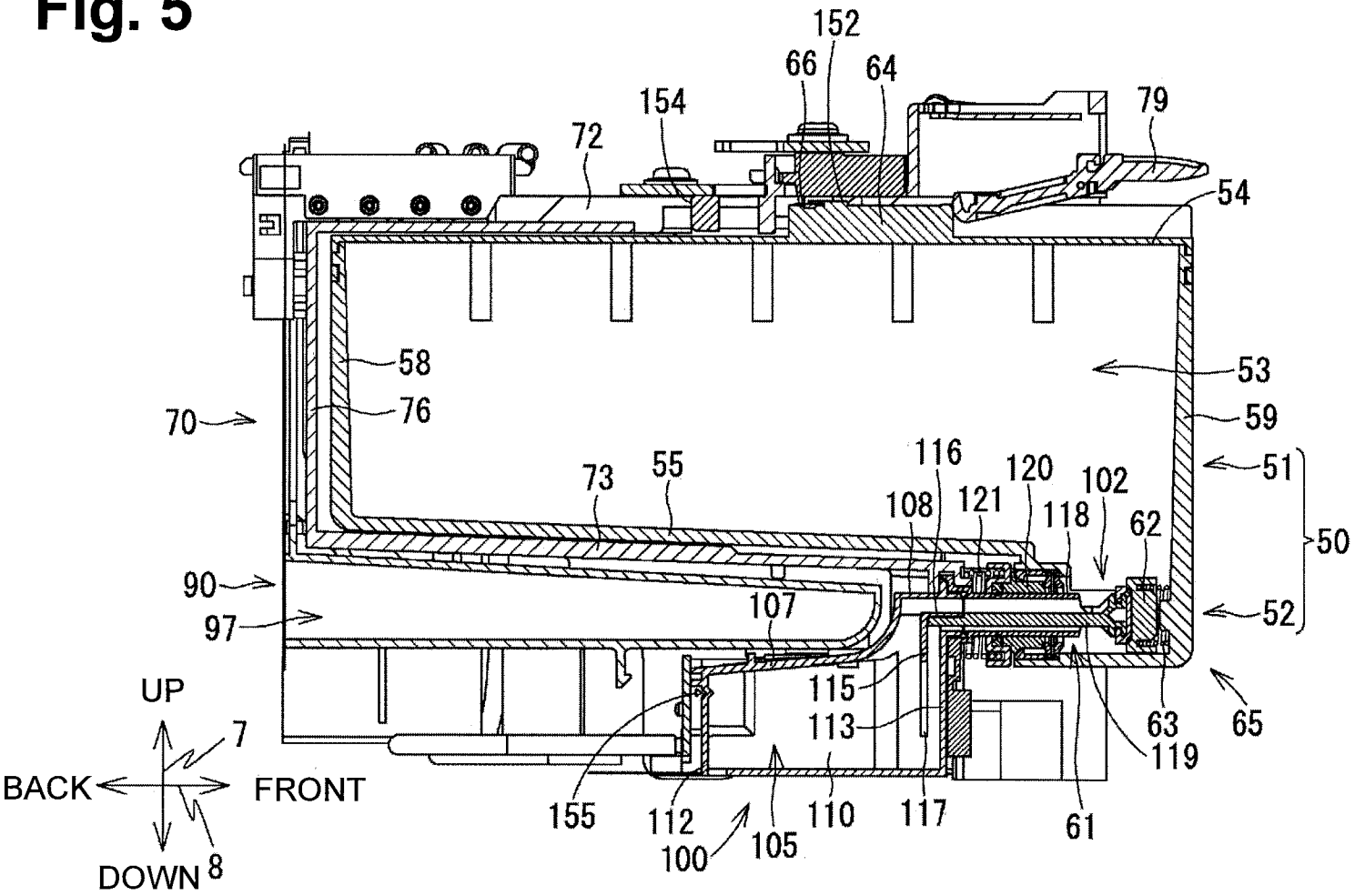
FIG. 5 is a cross-sectional view taken in the arrow direction of line V-V in FIG. 4.
Figure 11:
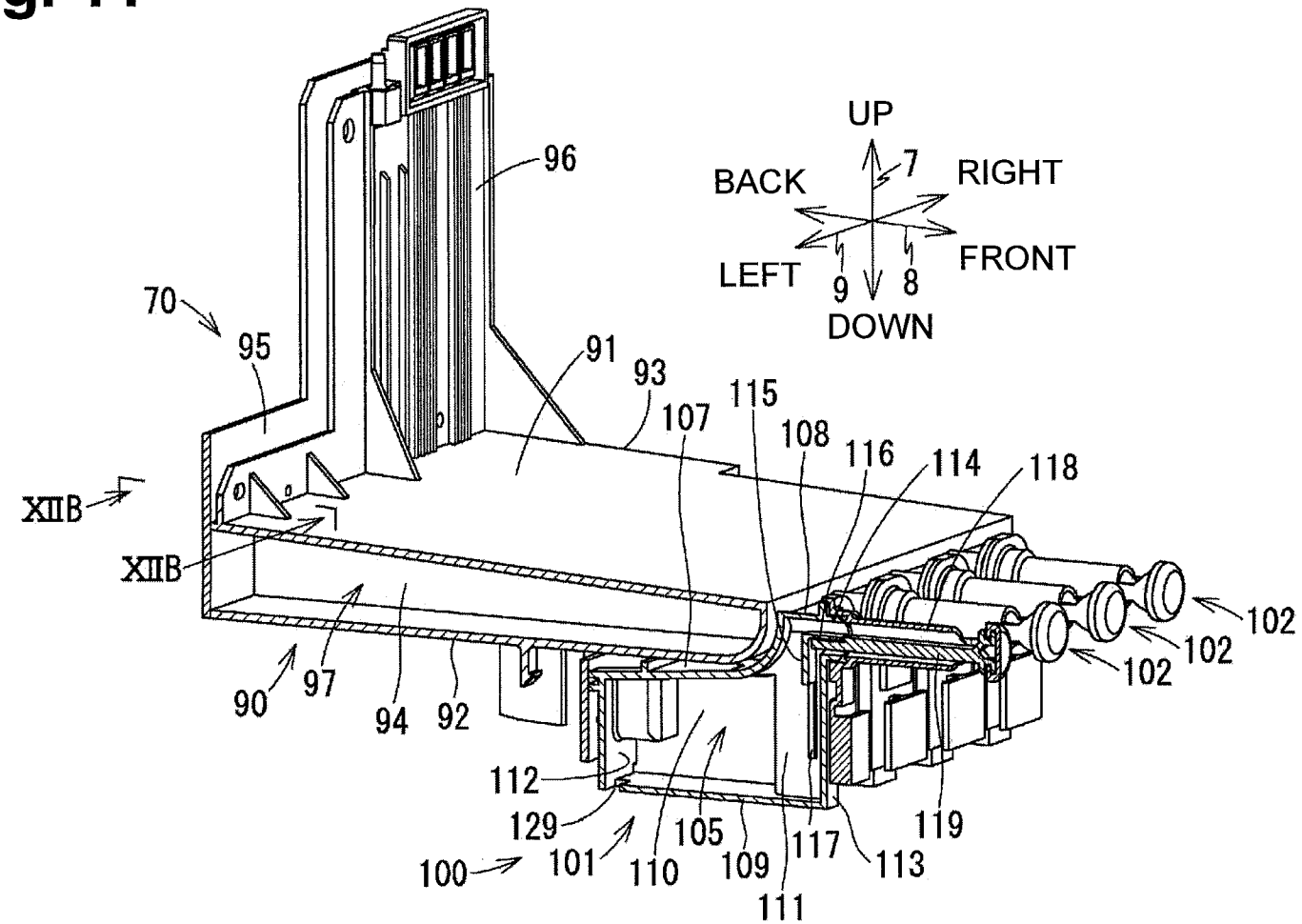
FIG. 11 is a perspective view of the subtank 100 and a buffer tank 90 viewed from the front left.

As shown in FIG. 4, the ink feeder 15 includes the four ink cartridges 50, an installation case 71, the four subtanks 100, and an air communication portion 70 (see FIGS. 5 and 11).

Ink Cartridge 50

As shown in FIGS. 1A, 1B, and 3, the four ink cartridges 50 (examples of cartridges) include a magenta ink cartridge 50M, a cyan ink cartridge 50C, a yellow ink cartridge 50Y, and a black ink cartridge 50B. The magenta ink cartridge 50M, the cyan ink cartridge 50C, the yellow ink cartridge 50Y, and the black ink cartridge 50B are herein collectively referred to as the ink cartridges 50, unless they are distinguished.

In FIG. 4, the magenta ink cartridge 50M, which is the leftmost one of the four ink cartridges 50 in the left-right direction 9, alone is installed in the installation case 71.

Figure 6:
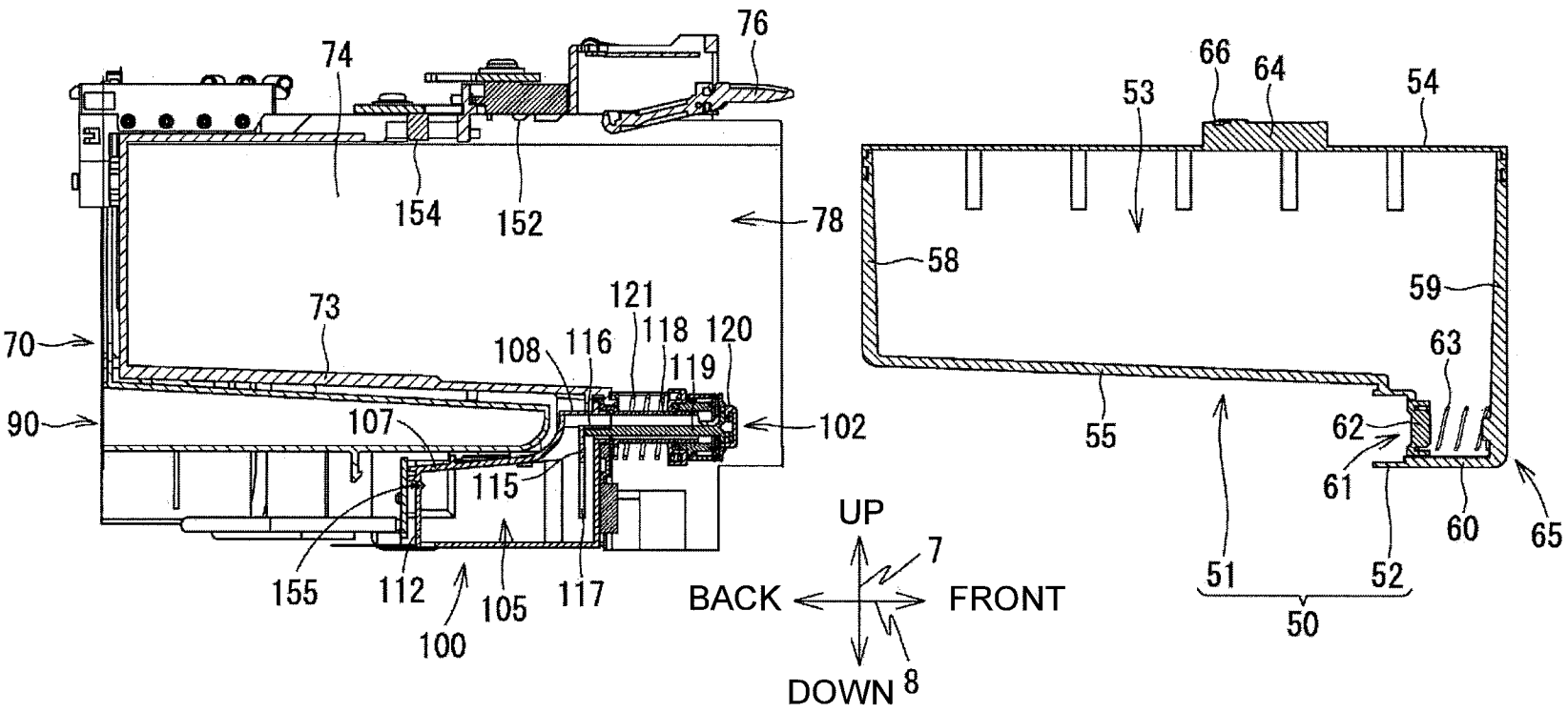
FIG. 6 is a cross-sectional view taken in the arrow direction of line V-V in FIG. 4 with an ink cartridge 50 removed.

As shown in FIGS. 5 and 6, an ink cartridge 50 includes a cartridge body 51 and a joint receiver 52. The cartridge body 51 includes a first reservoir 53 (an example of a first liquid chamber) storing ink (an example of liquid).

The cartridge body 51 is in the shape of a substantially rectangular parallelepiped box. The cartridge body 51 is substantially rectangular as viewed in the up-down direction 7 and the front-back direction 8. The cartridge body 51 has a downward protrusion 65 on its front end. The cartridge body 51 has an upper wall 54, a lower subwall 55, a right wall 56 (see FIG. 4), a left wall 57 (see FIG. 4), a rear wall 58, a front wall 59, and a lower wall 60. The lower wall 60 is located at the front part and the lower end of the cartridge body 51, and below the lower subwall 55. The lower subwall 55 is located behind the lower wall 60. The cartridge body 51 has a communication port 61 that is open rearward (an example of a horizontal direction) in the protrusion 65. The communication port 61 is an opening defined by the lower subwall 55, the lower wall 60, the right wall 56, and the left wall 57.

The upper wall 54 has a contact part 64 protruding upward in the middle in the front-back direction 8. The contact part 64 comes into contact with a lock lever 79 (described later) on the installation case 71.

The contact part 64 receives an integrated circuit (IC) chip 66 (an example of a cartridge memory) on its upper surface.

The IC chip 66 includes an IC chip. The IC chip 66 also includes a memory (not shown). In the IC chip 66, the IC chip is electrically connected to the memory. The IC chip 66 is exposed on its upper surface for electrical connection with a contact 152. More specifically, the IC chip 66 is electrically connected to the contact 152 when the ink cartridge 50 is installed in the installation case 71. The controller 230 can read information from the memory of the IC chip 66 through the contact 152 and the IC chip 66, and can write information to the memory of the IC chip 66 through the contact 152 and the IC chip 66.

The memory of the IC chip 66 stores an ink amount Vc and identification information for identifying each ink cartridge 50. For a fresh ink cartridge 50, the memory of the IC chip 66 stores an initial ink amount Vc0 as the ink amount Vc. The initial ink amount Vc0 is an example of a maximum liquid amount indicating a maximum amount of ink that can be stored in the ink cartridge 50. In other words, the initial ink amount Vc0 indicates the amount of ink stored in a fresh ink cartridge 50. Hereafter, information stored in the memory of the IC chip 66 may be collectively referred to as cartridge (CTG) information. A fresh ink cartridge herein refers to an unused ink cartridge 50 from which ink has yet to flow out after manufactured and sold.

The memory of the IC chip 66 includes, for example, a non-writable storage area in which no information is overwritten by the controller 230 and a writable storage area in which information can be overwritten by the controller 230. For example, identification information is stored in the non-writable area, and the ink amount Vc is stored in the writable area.

The upper surface of the lower subwall 55, which defines the bottom surface of the first reservoir 53, is inclined downward to the protrusion 65 in the front-back direction 8.

The joint receiver 52 is cylindrical and extends rearward from a part of the cartridge body 51 surrounding the communication port 61. The joint receiver 52 receives a joint 102 (described later) included in a subtank 100.

FIG. 5 shows the ink cartridge 50 installed in the subtank 100. FIG. 6 shows the ink cartridge 50 separate from the subtank 100. The installed state will be detailed later.

The joint receiver 52 includes a plug 62 that can close the communication port 61 and a spring 63 that urges the plug 62 rearward. As shown in FIG. 6, under no external force applied to the ink cartridge 50, the plug 62 is located to close the communication port 61. The spring 63 extends in the front-back direction 8 between the plug 62 and the front wall 59, and can be compressed in the front-back direction 8. As shown in FIG. 5, when receiving a forward external force greater than the elastic force of the spring 63 from the joint 102, the plug 62 moves forward to leave the communication port 61.

Installation Case 71

The installation case 71 is in the shape of a substantially rectangular parallelepiped box that is open forward. The installation case 71 has an upper wall 72, a lower wall 73, a right wall 74, a left wall 75, a rear wall 76, and three partition walls 77. The upper wall 72, the lower wall 73, the right wall 74, the left wall 75, and the rear wall 76 define an internal space 78 opening forward. The three partition walls 77 are parallel with the right wall 74 and the left wall 75, and partition the internal space 78 into four spaces. Each of the four partition spaces receives the corresponding one of the four ink cartridges 50.

Lock Lever 79

As shown in FIGS. 4, 5, and 6, the installation case 71 includes lock levers 79 that hold the ink cartridges 50 inside the internal space 78. The lock levers 79 are plate-like members extending in the front-back direction. Each lock lever 79 is pivotably attached, at the center, to the upper wall 72 about an axis in the left-right direction 9. The lock lever 79 pivots between a locked position inclined rearward and an unlocked position inclined forward. Under no external force applied, the lock lever 79 is inclined rearward to the locked position with its weight. The lock lever 79 at the locked position has the rear end in contact with the front surface of the contact part 64 of the ink cartridge 50 inside the internal space 78 to prevent the ink cartridge 50 from moving forward in the front-back direction 8. When the front end of the lock lever 79 at the locked position is depressed with, for example, a finger of the user, the lock lever 79 pivots from the locked position to the unlocked position. The lock lever 79 at the unlocked position has the rear end located above the front surface of the contact part 64. The lock lever 79 at the unlocked position is not in contact with the contact part 64 of the ink cartridge 50 moving forward in the front-back direction 8, thus allowing the ink cartridge 50 to be removable from the installation case 71.

Contact 152

The contact 152 (an example of an interface) is located on the upper wall 72 of the installation case 71. The contact 152 protrudes downward toward the internal space 78 of the installation case 71 from the upper wall 72. The contact 152 is located to be in contact with the IC chip 66 (described below) of the ink cartridge 50 when the ink cartridge 50 is installed in the installation case 71. The contact 152 is conductive and elastically deformable in the up-down direction 7. The contact 152 is electrically connected to the controller 230.

Installation Sensor 154

The installation sensor 154 is located on the upper wall 72 of the installation case 71. The installation sensor 154 detects the ink cartridge 50 installed in the installation case 71. The installation sensor 154 includes a light emitter and a light receiver located at a distance from each other in the left-right direction 9. When the ink cartridge 50 is installed in the installation case 71, a detectable unit (not shown) of the ink cartridge 50 is located between the light emitter and the light receiver of the installation sensor 154. In other words, the light emitter and the light receiver of the installation sensor 154 are located opposite to each other across the detectable unit of the ink cartridge 50 installed in the installation case 71.

The installation sensor 154 outputs different signals (installation signals in the drawings) depending on whether light emitted from the light emitter in the left-right direction 9 is received by the light receiver. The installation sensor 154 outputs a low-level signal to the controller 230 when, for example, the intensity of the light received by the light receiver is lower than a threshold intensity. In contrast, the installation sensor 154 outputs a high-level signal having a higher signal intensity than the low-level signal to the controller 230 when the intensity of the light received by the light receiver is equal to or higher than the threshold intensity. The high-level signal is an example of a third signal, and the low-level signal is an example of a fourth signal.

Subtank 100

FIGS. 4 to 11 show the subtanks 100 (examples of tanks). The subtanks 100 are located under the lower wall 73 of the installation case 71.

Figure 7:
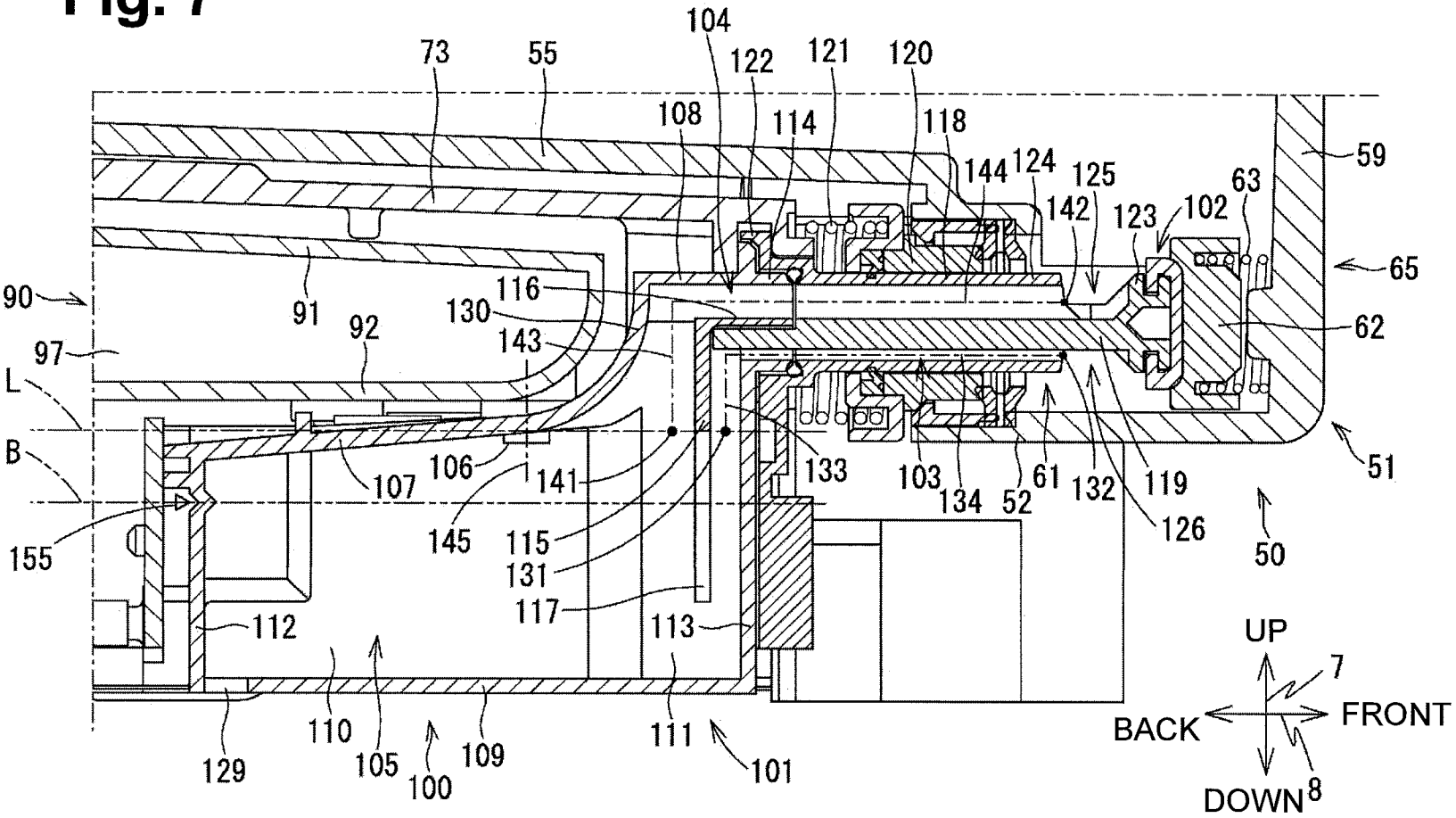
FIG. 7 is a cross-sectional view taken in the arrow direction of line V-V in FIG. 4 showing a part around a subtank 100.

As shown in FIG. 7, each subtank 100 includes a tank body 101 and the joint 102. The tank body 101 includes an internal second reservoir 105 (an example of a second liquid chamber) to store ink. The subtank 100 includes a liquid flow path 103 and a gas flow path 104 that communicate with the second reservoir 105. The liquid flow path 103 and the gas flow path 104 are defined inside the tank body 101 and the joint 102. The subtank 100 also includes an air communication port 106 (see FIGS. 9, 10, and 12A) that allows the second reservoir 105 to communicate with the outside.

Liquid Flow Path 103 and Gas Flow Path 104

As shown in FIG. 7, the liquid flow path 103 and the gas flow path 104 are located in parallel.

The liquid flow path 103 has a first opening 131, a second opening 132, a vertical part 133, and a horizontal part 134. The first opening 131 is formed in one end (rear end) of the liquid flow path 103 and communicates with the second reservoir 105. The first opening 131 is open in the up-down direction 7. The second opening 132 is formed in the opposite end (front end) of the liquid flow path 103 and is open to the outside. The second opening 132 is open in the front-back direction 8. With the ink cartridge 50 installed, the second opening 132 is located in the first reservoir 53 of the ink cartridge 50. The vertical part 133 is a part of the liquid flow path 103 extending upward from the first opening 131. The horizontal part 134 is a part of the liquid flow path 103 extending rearward from the second opening 132. The upper end of the vertical part 133 is connected to the rear end of the horizontal part 134.

The gas flow path 104 has a third opening 141, a fourth opening 142, a vertical part 143, and a horizontal part 144. The third opening 141 is formed in one end (rear end) of the gas flow path 104 and communicates with the second reservoir 105. The third opening 141 is open in the up-down direction 7. The fourth opening 142 is formed in the opposite end (front end) of the gas flow path 104 and is open to the outside. The fourth opening 142 is open in the front-back direction 8. With the ink cartridge 50 installed, the fourth opening 142 communicates with the first reservoir 53 of the ink cartridge 50. The vertical part 143 is a part of the gas flow path 104 extending upward from the third opening 141. The horizontal part 144 is a part of the gas flow path 104 extending rearward from the fourth opening 142. The upper end of the vertical part 143 is connected to the rear end of the horizontal part 144.

Tank Body 101

The tank body 101 has outer walls defining the shape of a substantial rectangular parallelepiped. The tank body 101 is substantially T-shaped as viewed in the up-down direction 7 (see FIGS. 9 and 10), substantially rectangular as viewed in the front-back direction 8 (see FIG. 8), and L-shaped as viewed in the left-right direction 9 (see FIGS. 4 to 7).

Figure 8:
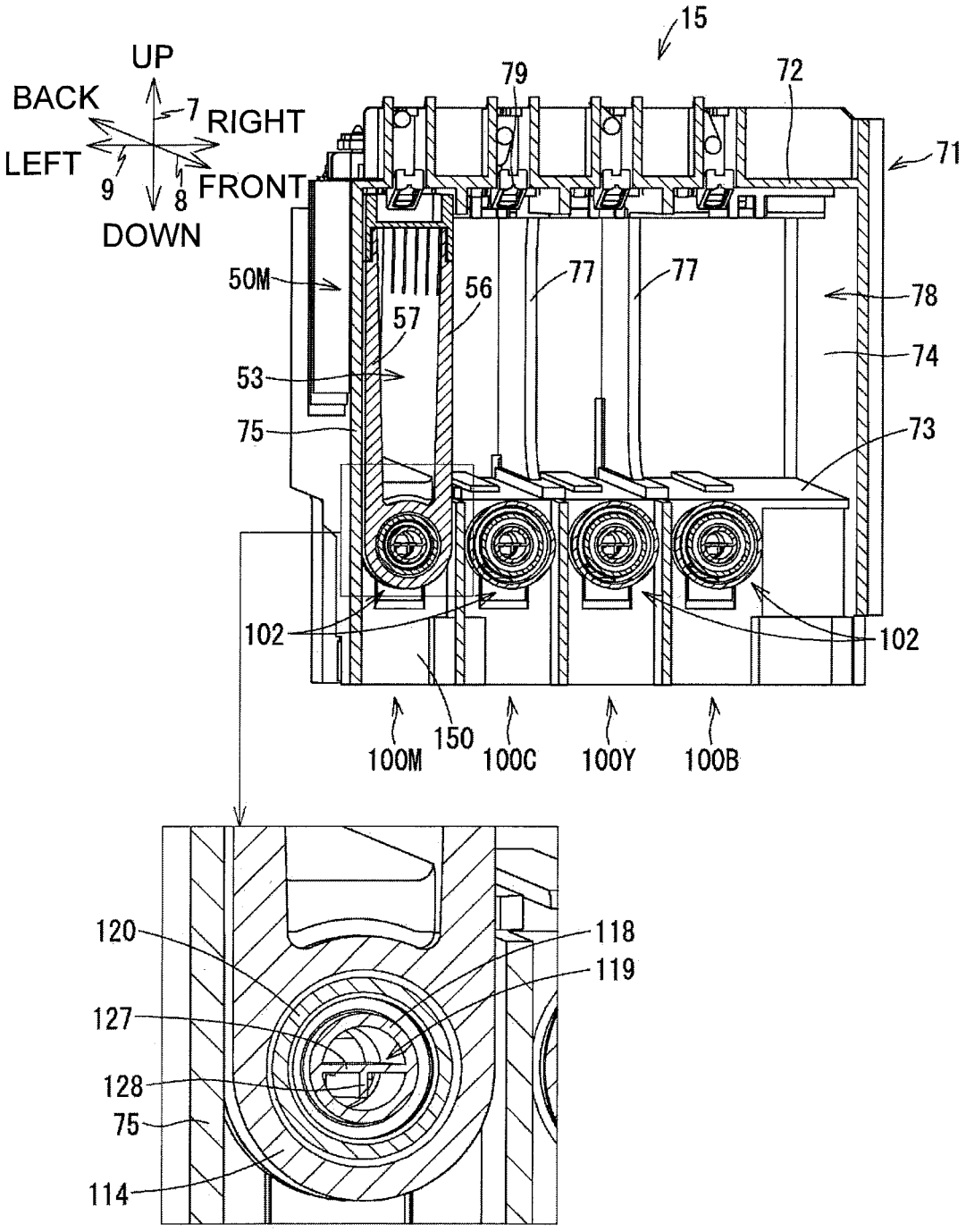
FIG. 8 is a cross-sectional view taken in the arrow direction of line VIII-VIII in FIG. 4.
Figure 9:
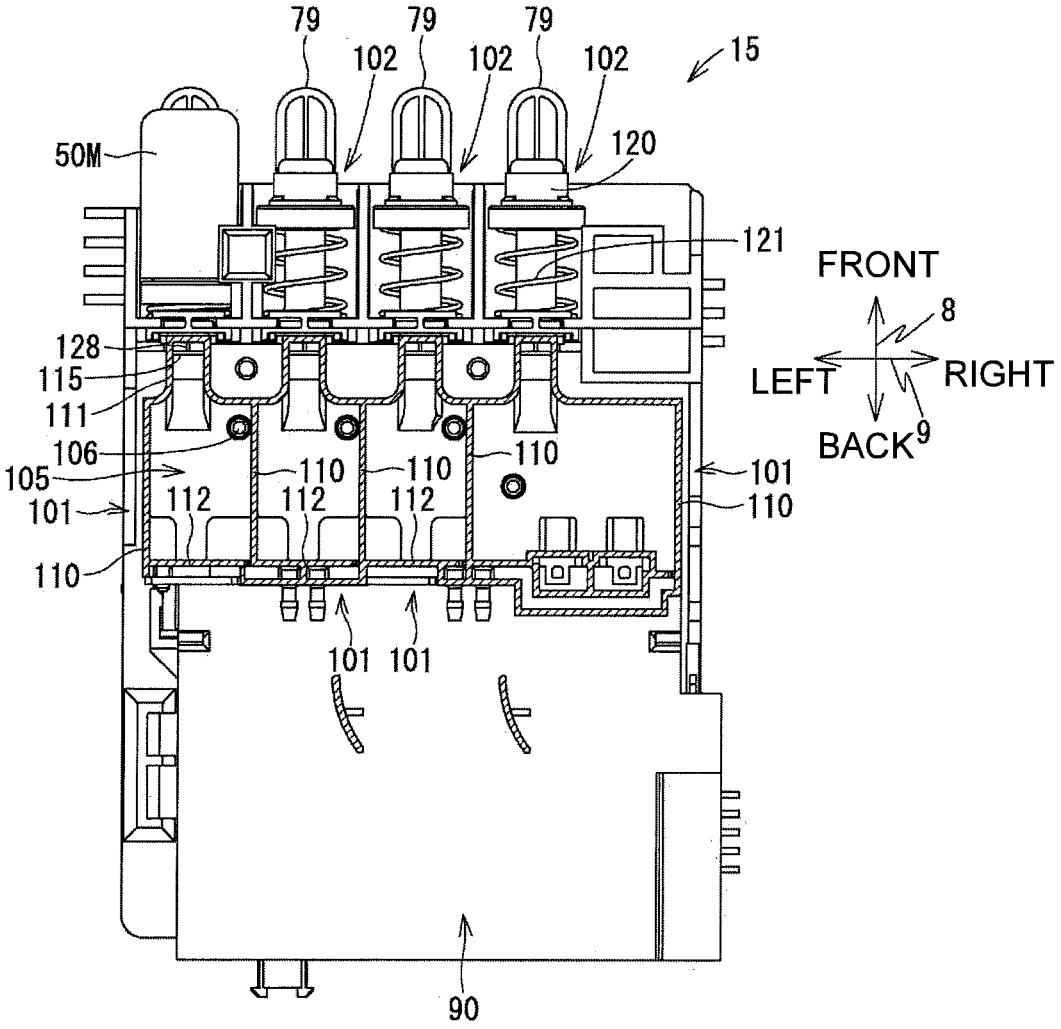
FIG. 9 is a cross-sectional view taken in the arrow direction of line IX-IX in FIG. 4.

As shown in FIGS. 4 to 11, the outer walls of the tank body 101 include a rear upper wall 107, a curved upper wall 130, a front upper wall 108, a lower wall 109, two rear side walls 110, two front curved side walls 111, a rear wall 112, and a front wall 113. The rear upper wall 107 extends forward from the rear end and is inclined upward with respect to the horizontal plane. The curved upper wall 130 extends from the front end of the rear upper wall 107 and curves upward as it extends forward. The front upper wall 108 extends from the upper end of the curved upper wall 130 forward in parallel with the horizontal plane. The lower wall 109 extends in the front-back direction 8 in parallel with the horizontal plane. The lower wall 109 is T-shaped as viewed in the up-down direction 7. The rear side walls 110 connect the rear upper wall 107 and the lower wall 109 in the up-down direction 7. The rear side walls 110 are substantially rectangular as viewed in the left-right direction 9. As shown in FIG. 9, adjacent tank bodies 101 for different inks share one rear side wall 110. The front curved side walls 111 connect the curved upper wall 130 and the front upper wall 108 to the lower wall 109 in the up-down direction 7. The front curved side walls 111 are substantially rectangular as viewed in the left-right direction 9, and L-shaped with a round corner as viewed in the up-down direction 7. The rear wall 112 extends upward from the rear end of the lower wall 109, and is connected to the two right and left rear side walls 110 and the rear upper wall 107. The front wall 113 extends upward from the front end of the lower wall 109, and is connected to the two right and left front curved side walls 111.

As shown in FIGS. 7 and 11, the lower wall 109 has a communication port 129 that communicates with the second reservoir 105. The communication port 129 is connected to one end of the ink tube 32, and the ink tube 32 connects the second reservoir 105 and the recording head 39.

The tank body 101 includes an inner cylinder 114 extending in the front-back direction 8 at the front end and the upper part of the tank body 101. The inside of the inner cylinder 114 communicates with the opening defined by the front wall 113, the two right and left front curved side walls 111, and the front upper wall 108. The rear end of the joint 102 is attachable to the inner cylinder 114. In the installed state with the joint 102 attached to the inner cylinder 114, the inside of the inner cylinder 114 communicates with the inside of the joint 102.

Wide Part 150 and Narrow Part 151

Figure 10:
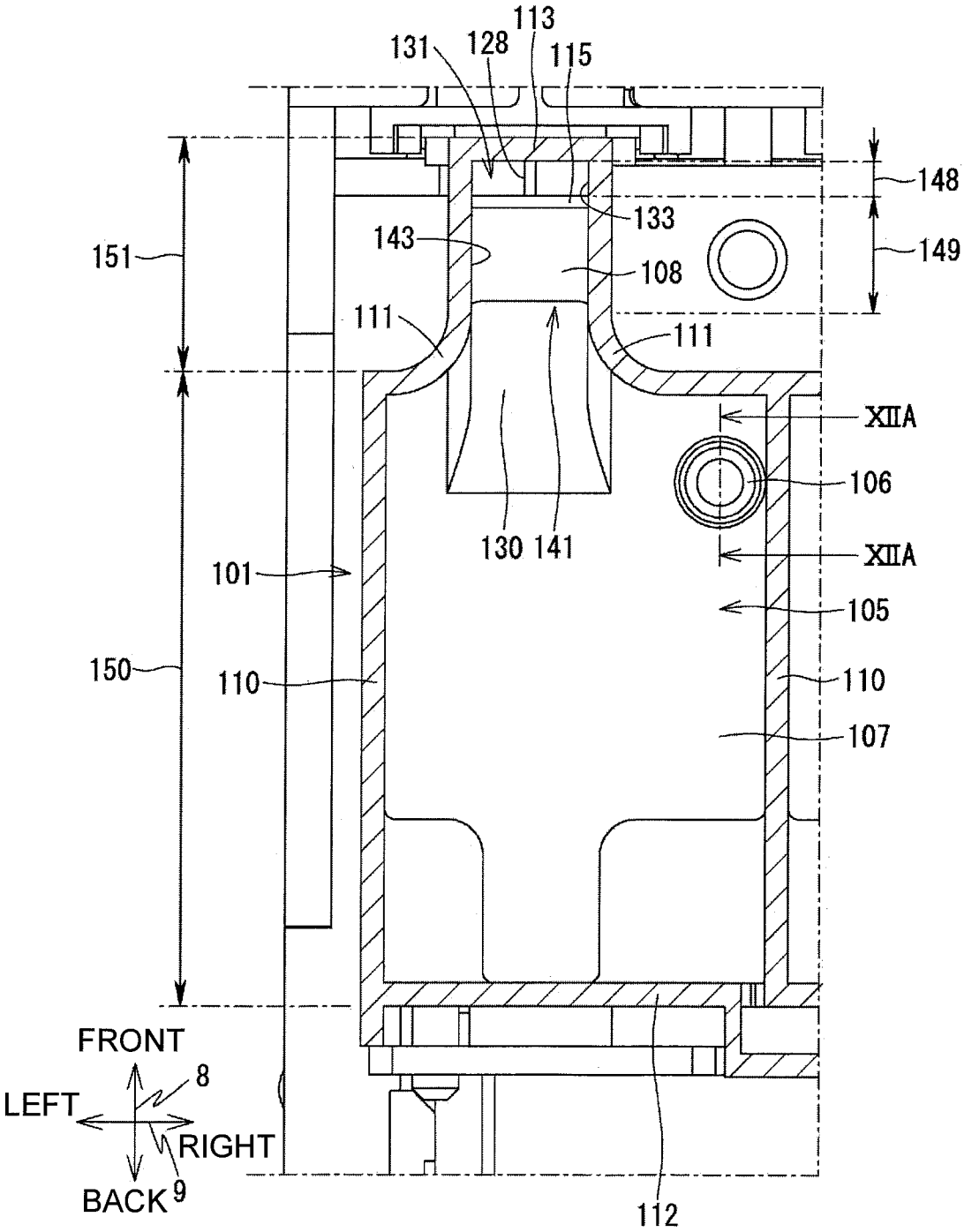
FIG. 10 is a cross-sectional view taken in the arrow direction of line IX-IX in FIG. 4 showing a part around the subtank 100.

As shown in FIG. 10, the tank body 101 has a wide part 150 and a narrow part 151 aligned with each other in the front-back direction 8. The wide part 150 is a rear part in the tank body 101 in the front-back direction 8 and includes the two rear side walls 110 and the rear wall 112. The narrow part 151 is located at the front end in the front-back direction 8 (an example of an end in a first direction) in the tank body 101 and includes the two front curved side walls 111 and the front wall 113. The narrow part 151 has a width in the left-right direction 9 (an example of a second direction orthogonal to the first direction) smaller than the width of the wide part 150 in the left-right direction 9. The second reservoir 105 extends across the wide part 150 and the narrow part 151.

As shown in FIG. 8, the width of the wide part 150 in the left-right direction 9 is substantially the same as the width of the ink cartridge 50 in the left-right direction 9. Thus, the width of the narrow part 151 in the left-right direction 9 is smaller than the width of the ink cartridge 50 in the left-right direction 9.

Vertical Wall 115 and Horizontal Wall 116

As shown in FIGS. 7 and 11, the tank body 101 includes a vertical wall 115 and a horizontal wall 116 in the upper front part of the tank body 101.

The vertical wall 115 extends in the up-down direction 7 and is located between the front wall 113 and the curved upper wall 130 in the front-back direction 8. The vertical wall 115 connects the two right and left front curved side walls 111, and partitions the space defined by the front wall 113, the front upper wall 108, and the two front curved side walls 111 into front and rear parts. The lower end position of the vertical wall 115 is a position at the first opening 131 of the liquid flow path 103 in the up-down direction 7, and also a position at the third opening 141 of the gas flow path 104 in the up-down direction 7. The lower end position of the vertical wall 115 is equal to the lower end position of the front end of the rear upper wall 107. More specifically, the upper surface of the second reservoir 105 is defined by an imaginary plane on the lower end position of the vertical wall 115 and parallel with the horizontal plane, and the bottom surface of the rear upper wall 107.

The horizontal wall 116 extends forward from the upper end of the vertical wall 115. The horizontal wall 116 extends into the inner cylinder 114. The horizontal wall 116 connects the two right and left front curved side walls 111, and also connects the facing inner surfaces inside the inner cylinder 114 in the left-right direction 9. The horizontal wall 116 partitions the space defined by the front upper wall 108 and the two front curved side walls 111 into upper and lower parts, and also partitions the space defined by the inner cylinder 114 into upper and lower parts.

As shown in FIG. 10, the vertical part 133 of the liquid flow path 103 is defined by the vertical wall 115, the front wall 113, and the two front curved side walls 111. The vertical part 133 of the liquid flow path 103 has a rectangular cross section orthogonal to the up-down direction 7. The vertical part 133 of the liquid flow path 103 is flush with the two front curved side walls 111 defining the second reservoir 105. Thus, the vertical part 133 of the liquid flow path 103 has a width in the left-right direction 9 equal to the width of the second reservoir 105 defined by the narrow part 151 in the left-right direction 9.

As shown in FIG. 10, the vertical part 143 of the gas flow path 104 is defined by the curved upper wall 130, the vertical wall 115, and the two front curved side walls 111. The vertical part 143 of the gas flow path 104 has a rectangular cross section orthogonal to the up-down direction 7. The vertical part 143 of the gas flow path 104 is flush with the two front curved side walls 111 defining the second reservoir 105. Thus, the vertical part 143 of the gas flow path 104 has a width in the left-right direction 9 equal to the width of the second reservoir 105 defined by the narrow part 151 in the left-right direction 9.

As shown in FIG. 10, the third opening 141 of the gas flow path 104 has a length 149 in the front-back direction 8 (an example of the horizontal direction), and the first opening 131 of the liquid flow path 103 has a length 148 in the front-back direction 8 (an example of the horizontal direction). The length 149 is greater than the length 148. The third opening 141 of the gas flow path 104 has a length in the left-right direction 9 equal to the length of the first opening 131 of the liquid flow path 103 in the left-right direction 9. Thus, the third opening 141 of the gas flow path 104 has a larger opening area than the first opening 131 of the liquid flow path 103.

As shown in FIG. 7, the opening area of the gas flow path 104 in the vertical part 143 of the gas flow path 104 increases toward the third opening 141 of the gas flow path 104. In the vertical part 133 of the liquid flow path 103, the opening area of the liquid flow path 103 remains constant in the up-down direction 7.

As shown in FIG. 7, the horizontal part 134 of the liquid flow path 103 in the tank body 101 is defined by the front upper wall 108, the horizontal wall 116, the two front curved side walls 111, and the inner cylinder 114. The horizontal part 144 of the gas flow path 104 in the tank body 101 is defined by the horizontal wall 116, the two front curved side walls 111, and the inner cylinder 114.

First Rib 117

As shown in FIGS. 7 and 11, the tank body 101 includes a first rib 117 connected to the vertical wall 115. The first rib 117 protrudes from a front curved side wall 111 and extends downward from the vertical wall 115. The first rib 117 is separate from the lower wall 109. Each of the two right and left front curved side walls 111 has the first rib 117. The single second reservoir 105 includes the two first ribs 117 separate from each other in the left-right direction 9.

Liquid Level Sensor 155

As shown in FIG. 7, a liquid level sensor 155 detects the liquid level of the second reservoir 105 of the tank body 101 equal to or higher than a predetermined level B. The predetermined level B is lower than an imaginary line L extending through the third opening 141 of the gas flow path 104 in the horizontal direction. The liquid level sensor 155 optically detects the liquid level of the ink in the second reservoir 105 at the predetermined level B using a prism with different reflectance values depending on whether the ink is in contact with the rear wall 112 of the tank body 101 at the predetermined level B.

The liquid level sensor 155 includes a light emitter and a light receiver located at a distance from each other in the left-right direction 9. The liquid level sensor 155 outputs different signals (liquid level signals in the drawings) depending on whether light output from the light emitter is received by the light receiver. In the present embodiment, when the second reservoir 105 of the tank body 101 has a liquid level equal to or higher than the predetermined level B, the liquid level sensor 155 outputs a low-level signal. When the second reservoir 105 of the tank body 101 has a liquid level lower than the predetermined level B, the liquid level sensor 155 outputs a high-level signal. The low-level signal is an example of a first signal. The high-level signal is an example of a second signal.

Joint 102

As shown in FIGS. 4 to 9 and 11, the joint 102 includes a joint body 118, an inner wall 119, a plug 120 (see FIGS. 6 and 7), and a spring 121 (see FIGS. 6 and 7).

Joint Body 118

As shown in FIG. 7, the joint body 118 includes an external cylinder 122 at its rear end, a front end 123, and a main body 124 connecting the external cylinder 122 and the front end 123. The external cylinder 122 is cylindrical and extends in the front-back direction 8. The external cylinder 122 is fitted in the inner cylinder 114 of the tank body 101. This fixes the joint body 118 to the tank body 101. The front end 123 is disc-shaped with the center at an axis in the front-back direction 8. The main body 124 is cylindrical and extends in the front-back direction 8. The main body 124 has an upper opening 125 facing upward and a lower opening 126 facing downward at the front end of the main body 124.

Partition Wall 127 and Second Rib 128

As shown in FIGS. 7 and 8, the inner wall 119 is located inside the joint body 118. The inner wall 119 extends rearward from the front end 123 beyond the external cylinder 122. The inner wall 119 has a partition wall 127 and a second rib 128. As shown in FIG. 8, the inner wall 119 is T-shaped as viewed in the front-back direction 8. The partition wall 127 has a rear end surface in contact with the front end surface of the horizontal wall 116 in the tank body 101. The partition wall 127 and the horizontal wall 116 partition the internal space of the connection part between the joint body 118 and the tank body 101 into the liquid flow path 103 and the gas flow path 104.

The partition wall 127 extends across the inside of the joint body 118 in the left-right direction 9. The partition wall 127 extends rearward from the front end 123. The joint body 118 has an internal space partitioned by the partition wall 127 into upper and lower parts.

The second rib 128 protrudes downward from the middle of the partition wall 127 in the left-right direction 9. The second rib 128 extends rearward from the front end 123. The second rib 128 and the joint body 118 have a gap between them.

The horizontal part 134 of the liquid flow path 103 in the joint 102 is defined by the inner surface of the joint body 118 and the bottom surface of the inner wall 119. The horizontal part 134 of the liquid flow path 103 in the joint 102 has a substantially semicircular cross section. More specifically, the cross section of the horizontal part 134 has a semicircular shape with an upper part divided by the second rib 128 into right and left areas, and a continuous lower part that is not divided into right and left areas. The horizontal part 144 of the gas flow path 104 in the joint 102 is defined by the inner surface of the joint body 118 and the upper surface of the inner wall 119. The horizontal part 144 of the gas flow path 104 in the joint 102 has a semicircular cross section.

Plug 120 and Spring 121

The plug 120 is a cylindrical member and located outside the main body 124 of the joint body 118. The plug 120 is movable in the front-back direction 8 along the main body 124. The spring 121 has a front end fixed to the rear end of the plug 120, and a rear end in contact with a buffer tank 90 in the air communication portion 70 and the external cylinder 122 of the joint body 118. The spring 121 urges the plug 120 forward. Under no external force applied, the plug 120 is located at the front end of the joint body 118 and closes the upper opening 125 and the lower opening 126. Under a rearward external force greater than the elastic force of the spring 121 applied, the plug 120 moves rearward to open the upper opening 125 and the lower opening 126. When the ink cartridge 50 is installed, the joint receiver 52 of the ink cartridge 50 comes into contact with the plug 120. Under the external force applied during the installation of the ink cartridge 50, the plug 120 in contact with the joint receiver 52 moves rearward.

Installed State of Ink Cartridge 50

In the installed state of the ink cartridge 50 installed in the subtank 100 as shown in FIGS. 5 and 7, the joint body 118 of the subtank 100 is inserted in the joint receiver 52 of the ink cartridge 50 in the front-back direction 8 and further in the communication port 61. In this installed state, the second opening 132 of the liquid flow path 103 and the fourth opening 142 of the gas flow path 104 in the subtank 100 enter the first reservoir 53 of the ink cartridge 50. As shown in FIGS. 4 and 5, the ink cartridge 50 can be removed from and installed in the subtank 100 in the front-back direction 8.

Layout of Ink Cartridge 50 and Subtank 100

The layout of the ink cartridge 50 and the subtank 100 will now be described. In the layout described below, the ink cartridge 50 is installed in the installation case 71, and the ink cartridge 50 and the subtank 100 are in the use posture shown in FIG. 5.

As shown in FIG. 5, the protrusion 65 of the ink cartridge 50 is located at substantially the same position as the joint 102 in the up-down direction 7, whereas the part of the ink cartridge 50 above the protrusion 65 is located higher than the joint 102. Thus, a most part of the first reservoir 53 of the ink cartridge 50 is located higher than the second opening 132. The upper part of the subtank 100, or the part at and above the curved upper wall 130, is located at substantially the same position as the joint 102, whereas the part of the subtank 100 below the curved upper wall 130 is located lower than the joint 102. Thus, a most part of the second reservoir 105 of the subtank 100 is located lower than the third opening 141.

The part of the first reservoir 53 above the protrusion 65 is located higher than the horizontal part 134 of the liquid flow path 103 and the horizontal part 144 of the gas flow path 104. The second reservoir 105 is located lower than the horizontal part 134 of the liquid flow path 103 and the horizontal part 144 of the gas flow path 104. The lower part of the first reservoir 53 and the upper part of the second reservoir 105 are arranged coaxially in the front-back direction 8. The first reservoir 53 has a larger volume than the second reservoir 105.

The horizontal part 144 of the gas flow path 104 is located higher than the horizontal part 134 of the liquid flow path 103.

As shown in FIG. 7, the first opening 131 of the liquid flow path 103, the third opening 141 of the gas flow path 104, and the air communication port 106 are located rearward in the stated order from the communication port 61 of the first reservoir 53. The position of the communication port 61 of the first reservoir 53 in the up-down direction 7 corresponds to the position in the up-down direction 7 at which the first reservoir 53 and the liquid flow path 103 communicate with each other. The rearward direction from the communication port 61 at this position in the up-down direction 7 is a direction away from the first reservoir 53.

Air Communication Portion 70

As shown in FIGS. 5, 11, 12A, and 12B, the air communication portion 70 includes a buffer tank 90, communication flow paths 145, and an air communication path 147.

Buffer Tank 90

As shown in FIGS. 5 and 11, the buffer tank 90 is located under the installation case 71 and above the subtank 100.

As shown in FIGS. 5 and 11, the buffer tank 90 includes an upper wall 91, a lower wall 92, two side walls 93, three partition walls 94, a rear wall 95, and an upright wall 96. The upper wall 91 extends along a plane inclined with respect to the horizontal plane. The lower wall 92 extends in parallel with the horizontal plane in the rear part and curves upward as it extends forward. The lower wall 92 has a front end connected to the front end of the upper wall 91. The two side walls 93 connect the upper wall 91 and the lower wall 92 in the up-down direction 7 at both ends of the upper and lower walls in the left-right direction 9. The three partition walls 94 are arranged in the left-right direction 9 in parallel with the two side walls 93. The rear wall 95 connects the rear end of the upper wall 91 and the rear end of the lower wall 92. The upright wall 96 extends upward from the rear end of the upper wall 91. The rear wall 95 and the upright wall 96 have a gap between them in the front-back direction 8.

The upper wall 91 of the buffer tank 90 is located below the lower wall 73 of the installation case 71. The upper wall 91 of the buffer tank 90 supports the lower wall 73 of the installation case 71. Thus, the upper wall 91 of the buffer tank 90 can support the ink cartridge 50 housed in the installation case 71 with the lower wall 73 of the installation case 71.

Buffer Chamber 97

The internal space defined by the upper wall 91, the lower wall 92, the two side walls 93, and the rear wall 95 is partitioned by the three partition walls 94 into four buffer chambers 97. The four buffer chambers 97 are each connected to and communicate with the corresponding one of the four subtanks 100. Each of the four buffer chambers 97 is a storage space for air delivered to the first reservoir 53 as the ink in the first reservoir 53 is fed to the second reservoir 105 by gas-liquid displacement. The four buffer chambers 97 are located above the recorder 24.

As shown in FIG. 5, the first reservoir 53 is located above the buffer chamber 97, and the buffer chamber 97 is located above the second reservoir 105. The part of the first reservoir 53 formed in the protrusion 65 and a part of the buffer chamber 97 are arranged coaxially in the front-back direction 8 (an example of the horizontal direction). In addition, a part of the protrusion 65, a part of the joint 102, and a part of the buffer tank 90 are arranged coaxially in the front-back direction 8 (an example of the horizontal direction). Additionally, a part of the first reservoir 53 and a part of the buffer chamber 97 are arranged coaxially in the up-down direction 7.

Communication Flow Path 145

Figure 12A:
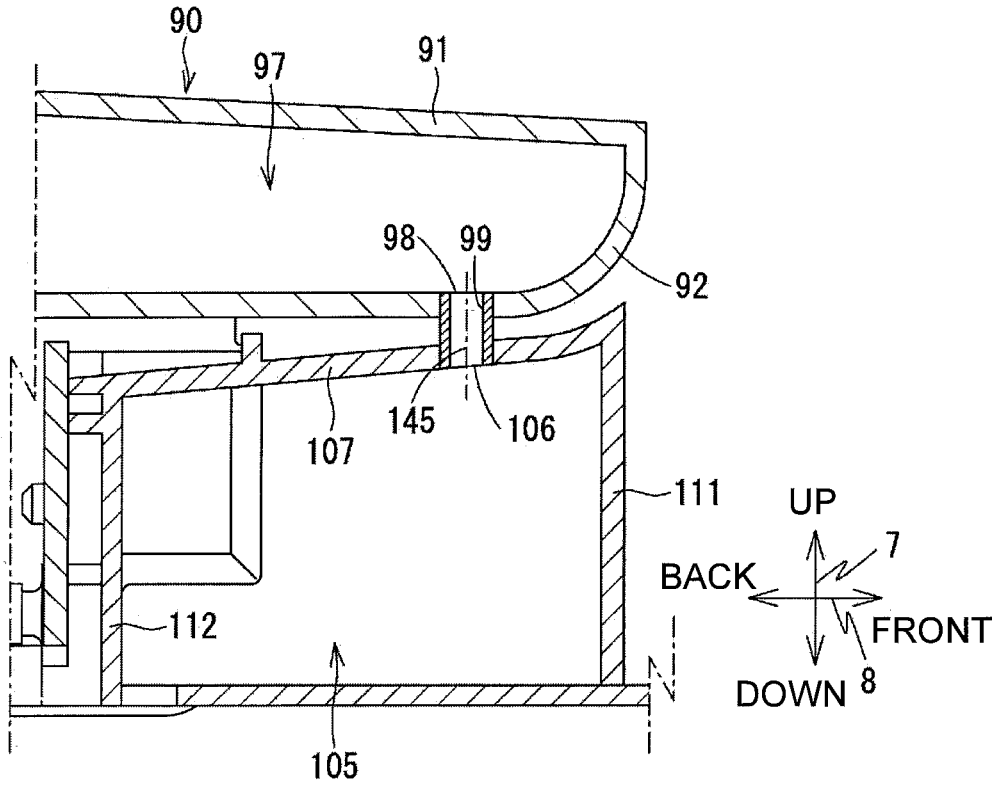
FIG. 12A is a cross-sectional view taken in the arrow direction of line XIIA-XIIA in FIG. 10.

As shown in FIG. 12A, the lower wall 92 of the buffer tank 90 has openings 98 communicating with the buffer chambers 97. The ink feeder 15 includes connection pipes 99 connecting the air communication ports 106 in the tank bodies 101 and the openings 98 in the buffer tank 90. The connection pipes 99 are cylindrical. The inner surface of each connection pipe 99 defines a communication flow path 145 connecting the second reservoir 105 and the buffer chamber 97. The communication flow path 145 extends in the up-down direction 7.

Air Communication Path 147

Figure 12B:
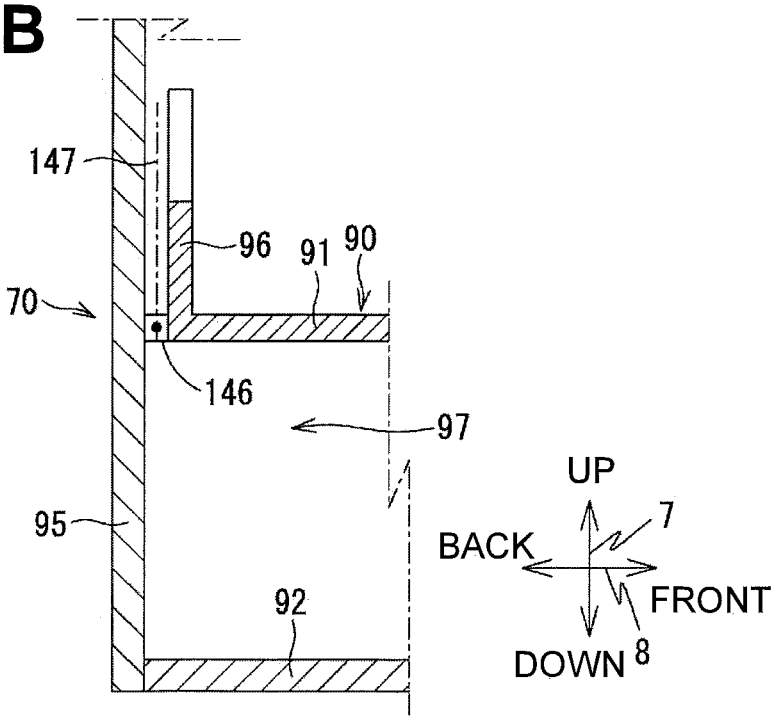
FIG. 12B is a cross-sectional view taken in the arrow direction of line XIIB-XIIB in FIG. 11.

As shown in FIG. 12B, the upper wall 91 has an opening 146 at its rear end in each buffer chamber 97. The upper wall 91 has four openings 146 behind the upright wall 96. The bottom surface of the upper wall 91 is inclined upward in the front-back direction 8 (an example of the horizontal direction) away from the openings 98 (rearward). The openings 146 are formed in the upper wall 91 at the highest position of the bottom surface of the upper wall 91 in the up-down direction 7. The front surface of the rear wall 95 and the rear surface of the upright wall 96 define an air communication path 147 extending in the up-down direction 7. The air communication path 147 extends through the opening 146 upward from the buffer chamber 97, and communicates with the outside of the housing 14 of the multifunction peripheral 10.

Operation in Present Embodiment

The flow of ink and air at the initial loading of an ink cartridge 50 into an empty subtank 100 will now be described.

Before initially loaded (or in an unloaded state) as shown in FIG. 6, the ink cartridge 50 is separate from the subtank 100. In the unloaded state, the communication port 61 of the ink cartridge 50 is closed by the plug 62, and the first reservoir 53 is sealed in the ink cartridge 50. Thus, ink filling the first reservoir 53 does not flow outside. In the unloaded state, the upper opening 125 and the lower opening 126 (see FIG. 7) of the subtank 100 are closed by the plug 120. Thus, the second opening 132 of the liquid flow path 103 and the fourth opening 142 of the gas flow path 104 communicating with the second reservoir 105 are closed to the outside. The second reservoir 105 includes, in addition to the liquid flow path 103 and the gas flow path 104, the air communication port 106 (see FIG. 7) and the communication port 129 (see FIG. 7) for communicating with the outside. The air communication port 106 communicates with the air outside the multifunction peripheral 10 through the buffer chamber 97. The communication port 129 communicates with the recording head 39 through the ink tube 32. However, when the recording head 39 is idle, no ink flows out through the communication port 129. In this state, the second reservoir 105 contains no ink and is empty.

As shown in FIGS. 5 and 7, when the ink cartridge 50 is installed in the subtank 100, the plug 62 closing the communication port 61 moves forward against the urging force of the spring 63, and the plug 120 closing the upper opening 125 and the lower opening 126 moves rearward against the urging force of the spring 121. As a result, the first reservoir 53 communicates with the second reservoir 105 through the liquid flow path 103 and the gas flow path 104. In this state, the ink in the first reservoir 53 of the ink cartridge 50 falls freely through the liquid flow path 103 and enters the second reservoir 105 of the subtank 100. With the air communication port 106 open to the outside air, air with the same volume as the ink entering the second reservoir 105 flows into the first reservoir 53 through the air communication port 106 and the gas flow path 104. In this manner, the ink in the first reservoir 53 is fed to the second reservoir 105 as the ink in the first reservoir 53 is replaced by air (gas-liquid displacement).

As the gas-liquid displacement proceeds, the liquid level of the ink in the second reservoir 105 increases. When the liquid level of the ink increases and reaches the lower end position of the vertical wall 115, the third opening 141 of the gas flow path 104 is closed. In this state, the gas-liquid displacement no longer proceeds, thus stopping the ink feeding from the first reservoir 53 to the second reservoir 105. The ink is fed in this manner at the initial loading.

The flow of ink and air during a recording operation performed by the printer unit 11 with the ink cartridge 50 in the installed state will now be described.

When the recording head 39 discharges ink during the recording operation, the ink in the second reservoir 105 is drawn to the recording head 39 through the communication port 129. The liquid level of the ink in the second reservoir 105 lowers as the ink decreases, thus opening the closed third opening 141 of the gas flow path 104. When the third opening 141 of the gas flow path 104 is open, the gas-liquid displacement is performed in the manner described above to feed ink from the first reservoir 53 to the second reservoir 105. To supplement ink used in the recording head 39, ink is fed from the first reservoir 53 to the second reservoir 105. The liquid level of the ink in the second reservoir 105 remains at the position of the third opening 141 of the gas flow path 104.

When the ink in the first reservoir 53 is used up, the empty ink cartridge 50 can be replaced with another ink cartridge 50 filled with ink to allow the multifunction peripheral 10 to continue the recording operation.

Controller 230

As shown in FIG. 13, the controller 230 includes a central processing unit (CPU) 231, a read-only memory (ROM) 232, a random-access memory (RAM) 233, an electrically programmable read-only memory (EEPROM) 234, and an application-specific integrated circuit (ASIC) 235. The ROM 232 stores various programs to be executed by the CPU 231 to control various operations. The RAM 233 provides a storage area for temporarily storing data or signals used by the CPU 231 executing the programs or a work area used for processing data. The EEPROM 234 stores setting information to be retained after the power is shut off. The ROM 232, the RAM 233, and the EEPROM 234 are examples of a device memory.

The ASIC 235 is used to operate the feed roller 25, the conveyance roller 34, the discharge roller 36, and the recording head 39. The controller 230 rotates the feed roller 25, the conveyance roller 34, and the discharge roller 36 by driving a motor (not shown) through the ASIC 235. The controller 230 further outputs a driving signal to a driving element of the recording head 39 through the ASIC 235 to cause the recording head 39 to discharge ink through the nozzles 40. The ASIC 235 can output different driving signals depending on the amount of ink to be discharged through the nozzles 40.

The display 17 and the operation panel 22 are connected to the ASIC 235.

The contact 152, the cover sensor 88, the installation sensor 154, and the liquid level sensor 155 are also electrically connected to the ASIC 235. The controller 230 accesses the memory of the IC chip 66 of the ink cartridge 50 installed in the installation case 71 through the contact 152. The controller 230 detects the position of the cover 48 with the cover sensor 88. The controller 230 also detects the ink cartridge 50 installed in the installation case 71 based on a detection signal from the installation sensor 154. The controller 230 further detects the liquid level of the ink stored in the second reservoir 105 equal to or higher than the predetermined level B with the liquid level sensor 155.

When the liquid level sensor 155 outputs a high-level signal, the ROM 232 stores a predetermined ink amount Vsc stored in the second reservoir 105 of the subtank 100 and a predetermined ink amount Vcc stored in the first reservoir 53 of the ink cartridge 50. The predetermined ink amount Vcc is zero in the present embodiment.

The EEPROM 234 stores various items of information associated with the four ink cartridges 50 installed in the installation case 71, in other words, associated with the subtanks 100 communicating with the ink cartridges 50. The various items of information include, for example, ink amounts Vc and Vs, which are examples of the liquid amount, a volume $V_{th}$, a flag C_Empty, a flag S_Empty, a temporary canceling flag, a non-residual ink flag, a count value SN1, a count value SN2, a count value TN, a threshold value $N_{th1}$, a threshold value $N_{th2}$, a threshold value Vmin, and a wait time Tw.

The ink amount Vc and the identification information are read by the controller 230 from the memory of the IC chip 66 through the contact 152 while the ink cartridge 50 is installed in the installation case 71. The volume $V_{th}$ may be stored in the ROM 232 instead of the EEPROM 234. The initial ink amount Vc0 is an example of initial information.

The ink amount Vc indicates the amount of ink stored in the first reservoir 53 of the ink cartridge 50. The ink amount Vs indicates the amount of ink stored in the second reservoir 105 of the subtank 100. The ink amounts Vc and Vs are calculated based on, for example, the volume $V_{th}$. When the first reservoir 53 of the ink cartridge 50 contains ink that can flow into the subtank 100, the liquid level of the ink in the second reservoir 105 of the subtank 100 is at the position of the imaginary line L including the third opening 141 of the gas flow path 104. This state is referred to as the equilibrium state. More specifically, in the equilibrium state, ink transfer stops between the first reservoir 53 and the second reservoir 105. The ink amount Vs in the equilibrium state is the volume $V_{th}$ of the second reservoir 105 lower than the imaginary line L. Thus, once the total amount Vt of ink is calculated, the ink amount Vs and the ink amount Vc can be calculated. More specifically, when the total amount Vt is equal to or greater than the volume $V_{th}$, the ink amount Vs is the volume $V_{th}$, and the ink amount Vc is obtained by subtracting the volume $V_{th}$ from the total amount Vt. When the total amount Vt is smaller than the volume $V_{th}$, the ink amount Vs is equal to the total amount Vt, and the ink amount Vc is zero. The ink amounts Vc and Vs may be determined by referring to a table storing the correspondence between the ink amounts and the total amount Vt without using the volume $V_{th}$.

The count value SN1 is equivalent to an ink discharge amount Dh (an ink amount indicated by a driving signal) instructed to discharge through the recording head 39 after the signal output from the liquid level sensor 155 changes from a low level to a high level and is updated toward the threshold value $N_{th1}$. The count value SN1 is counted up from an initial value of 0. The threshold value $N_{th1}$ is equivalent to the volume of a part of the second reservoir 105 between the position near the upper end of the communication port 129 and the predetermined level B. However, the count value SN1 may be counted down from an initial value equivalent to the volume. In this case, the threshold value $N_{th1}$ is zero (0). The count value SN1 is an example of a first count value. The threshold value $N_{th1}$ is an example of a first threshold.

The count value SN2 is equivalent to an ink discharge amount Dh (an ink amount indicated by a driving signal) instructed to discharge through the recording head 39 when the flag S_Empty is OFF and the signal output from the liquid level sensor 155 is a high-level signal, and is updated toward the threshold value $N_{th2}$. The count value SN2 is counted up from an initial value of 0. Further, the threshold value $N_{th2}$ is equivalent to the product of the average amount of ink discharged through the recording head 39 and the number of unit sheets that can undergo image recording within the wait time Tw (described later) in the image recording operation for the unit sheet (one sheet). However, the count value SN2 may be counted down from an initial value equivalent to the product. In this case, the threshold value $N_{th2}$ is zero (0). The count value SN2 is an example of a second count value. The threshold value $N_{th2}$ is an example of a second threshold. In the present embodiment, the threshold value $N_{th1}$ is greater than the threshold value $N_{th2}$. However, the relationship between the threshold value $N_{th1}$ and the threshold value $N_{th2}$ is set in accordance with the size of the second reservoir 105 of the subtank 100, the inflow rate from the first reservoir 53 of the ink cartridge 50 to the second reservoir 105, and the liquid level of the ink detected by the liquid level sensor 155.

The count value TN is equivalent to an ink discharge amount Dh (an ink amount indicated by a driving signal) instructed to discharge through the recording head 39 after the signal output from the liquid level sensor 155 changes from a high level to a low level, and is counted up from an initial value of 0. The count value TN may be counted down from an initial value equivalent to the total amount Vt of ink as well.

The flag C_Empty is information indicating whether the ink cartridge 50 is in a cartridge empty state. The flag C_Empty is set either ON corresponding to the cartridge empty state or OFF corresponding to a non-cartridge empty state. The cartridge empty state refers to the state of the ink cartridge 50 (more specifically, the first reservoir 53) storing substantially no ink. In other words, the cartridge empty state refers to the state of no ink transferred from the first reservoir 53 to the second reservoir 105 communicating with each other. The liquid level sensor 155 detects this cartridge empty state when the liquid level of the subtank 100 communicating with the ink cartridge 50 is lower than the predetermined level B.

The flag S_Empty is information indicating whether the subtank 100 is in the empty ink state. The flag S_Empty is set either ON corresponding to the empty ink state or OFF corresponding to a non-empty ink state. The empty ink state refers to, for example, the state of the liquid level of the ink stored in the subtank 100 (more specifically, the second reservoir 105) reaching the position near the upper end of the communication port 129. In other words, the empty ink state refers to the state of the count value SN1 equal to or greater than the threshold value $N_{th1}$. When the ink continues to be discharged through the recording head 39 in the empty ink state, the liquid level of the ink in the subtank 100 may fall below the upper end of the communication port 129, and air may mix in an ink flow path from the subtank 100 to the recording head 39 or in the recording head 39 (air entrapment). The nozzles 40 may not be filled with the ink, and the ink may not be discharged.

The temporary canceling flag is information indicating whether the signal output from the liquid level sensor 155 remains at a high level after the ink cartridge 50 is replaced and the flag C_Empty and the flag S_Empty are both set OFF. The temporary canceling flag is set either ON corresponding to the state of the signal output from the liquid level sensor 155 remaining at a high level or OFF corresponding to the state of the signal changed to a low level. When the ink continues to be discharged through the recording head 39 while the signal output from the liquid level sensor 155 remains at a high level or in the temporary canceling state, air entrapment may occur as described above.

The non-residual ink flag is information indicating whether the liquid level of the ink stored in the second reservoir 105 of the subtank 100 is lowered to the upper end of the communication port 129. When the liquid level of the ink stored in the second reservoir 105 reaches a position near the upper end of the communication port 129, the tank is in an empty ink state. Although the empty ink state is determined depending on whether the count value SN1 is equal to or greater than the threshold value $N_{th1}$, the liquid level of the ink stored in the second reservoir 105 in the empty ink state may be set at a position substantially higher than the upper end of the communication port 129, reflecting any error of the count value SN1 or the position of the liquid level of the ink stored in the second reservoir 105 affected by the installed state (inclination from the horizontal direction) of the multifunction peripheral 10.

In contrast, when the total amount Vt, which is the sum of the ink amount Vc stored in the replaced ink cartridge 50 and the ink amount Vs stored in the second reservoir 105 of the subtank 100, is equal to or greater than the threshold value Vmin, the ink is transferred from the first reservoir 53 to the second reservoir 105, and the liquid level of the ink in the second reservoir 105 reaches the predetermined level B over a predetermined time. The liquid level of the ink stored in the second reservoir 105 in the empty ink state is to be positioned above the upper end of the communication port 129 by the degree equivalent to the amount of ink to be used for image recording on the number N of sheets during the predetermined time until the liquid level of the ink reaches the predetermined level B. Under this setting, the liquid level of the ink stored in the second reservoir 105 does not reach the upper end of the communication port 129 although no ink is transferred from the first reservoir 53 to the second reservoir 105 after image recording is performed the number of times corresponding to the number N of sheets described above.

However, when image recording has been performed for the number N of sheets described above in the temporary canceling state but the empty state has not been fully canceled, the liquid level of the ink stored in the second reservoir 105 may be already lowered to near the upper end of the communication port 129 despite the ink cartridge 50 replaced again. When the ink continues to be discharged through the recording head 39, air entrapment occurs as described above. The OFF value of the non-residual ink flag is an example of a first value, and the ON value of the flag is an example of a second value.

Operation of Multifunction Peripheral 10

The operation of the multifunction peripheral 10 according to the present embodiment will be described with reference to FIGS. 14 to 18. Each of the processes shown in FIGS. 14 to 18 is performed by the CPU 231 of the controller 230. Each of the processes described below may be performed by the CPU 231 reading programs stored in the ROM 232, or may be implemented by a hardware circuit installed in the controller 230. Further, the processes described below can be performed in an order changed appropriately without departing from the spirit and scope of the present disclosure.

Image Recording Process

Figure 14:
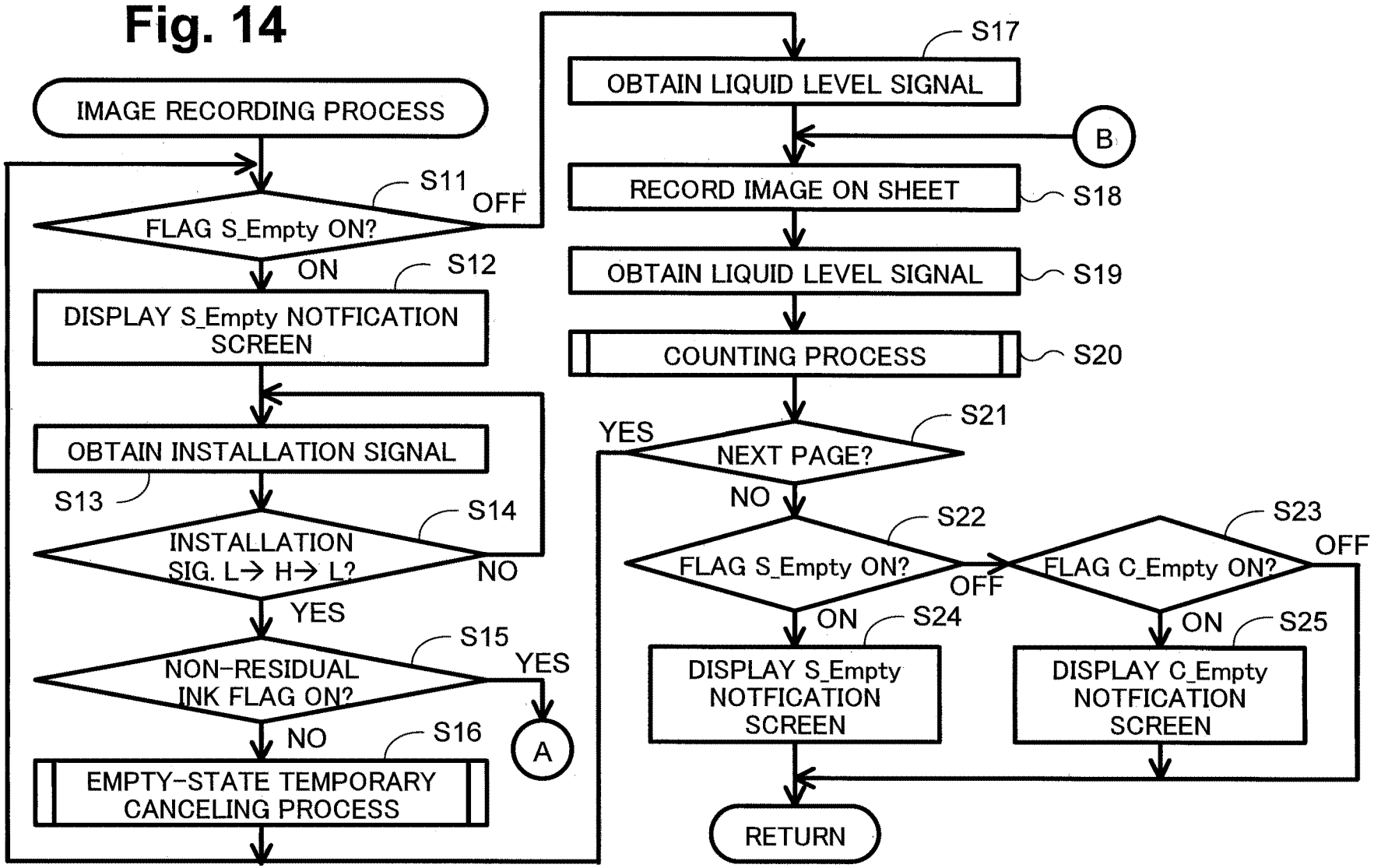
FIG. 14 is a flowchart of an image recording process.

The controller 230 performs an image recording process shown in FIG. 14 in response to a recording instruction input to the multifunction peripheral 10. The recording instruction is an example of a discharge instruction for causing the multifunction peripheral 10 to record an image represented by image data on a sheet. The recording instruction may be received in any manner, but may be received as a corresponding user operation performed through the operation panel 22 or may be received from an external device through a communication interface (not shown).

First, the controller 230 determines the set values for the four flags S_Empty (S11). When determining that at least one of the four flags S_Empty is set ON (S11: ON), the controller 230 displays a notification screen S_Empty on the display 17 (S12). The notification screen S_Empty notifies the user that the corresponding subtank 100 is in the empty ink state and the ink cannot be discharged through the recording head 39. For example, the notification screen S_Empty may include information indicating the color and the ink amounts Vc and Vs of the ink stored in the subtank 100 in the empty ink state. In step S12, the controller 230 may display the notification screen C_Empty on the display 17 together with the notification screen S_Empty when determining that at least one of the four flags C_Empty is set ON. The operation of the display 17 in step S12 is an example of a first operation.

The controller 230 also performs the processing in steps S13 to S15 for each ink cartridge 50 corresponding to the flag S_Empty set ON. More specifically, the processing in steps S13 to S15 is performed for each ink cartridge 50 for which the flag S_Empty is set ON, among the four ink cartridges 50. The processing in steps S13 to S15 is common to the ink cartridges 50. The processing in steps S13 to S15 corresponding to one ink cartridge 50 will be described.

The controller 230 first obtains a signal output from the installation sensor 154 (S13). The controller 230 then determines whether the signal obtained from the installation sensor 154 is a high-level signal or a low-level signal (S14). Then, the controller 230 repeatedly performs the processing in steps S13 and S14 at predetermined time intervals until the signal output from the installation sensor 154 changes from a low level to a high level and then from a high level to a low level again (S14: No). In other words, the controller 230 repeatedly performs the processing in steps S13 and S14 until the ink cartridge 50 is removed from the installation case 71 and an ink cartridge 50 is newly installed in the installation case 71.

The controller 230 obtains a high-level signal from the installation sensor 154 after obtaining a low-level signal from the installation sensor 154. Subsequently, in response to another low-level signal obtained from the installation sensor 154 (S14: Yes), the controller 230 determines whether the non-residual ink flag is ON (S15). When the non-residual ink flag is ON (S15: Yes), the controller 230 performs a process described below (see FIG. 18). The controller 230 also stores, into the EEPROM 234, the time at which the low-level signal is obtained from the installation sensor 154 after the high-level signal is obtained from the installation sensor 154. The controller 230 may measure the time by operating a timer after obtaining the low-level signal from the installation sensor 154, instead of storing the time. The stored time or the measured time is used in an empty-state fully canceling process (described below).

When the non-residual ink flag is OFF (S15: No), the controller 230 performs the empty-state temporary canceling process (S16). The empty-state temporary canceling process is to delete the notification screen C_Empty and the notification screen S_Empty appearing on the display 17. The empty-state temporary canceling process will be described in detail with reference to FIG. 16. The processing subsequent to step S11 is resumed in response to the completion of the empty-state temporary canceling process.

When the flags S_Empty corresponding to all the ink cartridges 50 are all not ON, or in other words, are all OFF, the controller 230 obtains signals output from the four liquid level sensors 155 at the current time (S17). In step S17, the controller 230 further causes the RAM 233 to store information indicating whether the signal obtained from each liquid level sensor 155 is a high-level signal or a low-level signal.

The controller 230 then records the image represented by the image data included in the recording instruction on one sheet (S18). More specifically, the controller 230 causes the sheet on the feed tray 20 to be conveyed by the feed roller 25 and the conveyance roller 34, the recording head 39 to discharge the ink, and the sheet having the recorded image to be discharged to the discharge tray 21 with the discharge roller 36. More specifically, the controller 230 enables the ink discharge through the recording head 39 when all the four flags S_Empty are set OFF. In contrast, the controller 230 disables the ink discharge through the recording head 39 when at least one of the four flags S_Empty is set ON.

The controller 230 then obtains signals output from the four liquid level sensors 155 at the current time upon recording the image on one sheet in response to the recording instruction (S19). Similarly to step S17, the controller 230 causes the RAM 233 to store information indicating whether the signal obtained from each liquid level sensor 155 is a high-level signal or a low-level signal (S19). The controller 230 then performs a counting process (S20). The counting process is to update the count values TN, SN1, and SN2, the flag C_Empty, and the flag S_Empty based on the signals obtained from each liquid level sensor 155 in steps S17 and S19. The counting process will be described in detail below with reference to FIG. 15.

The controller 230 then repeatedly performs the processing in steps S11 to S20 until all the images indicated by the recording instruction are recorded on one sheet (S21: Yes). After recording all the images indicated by the recording instruction on one sheet (S21: No), the controller 230 determines the set values for the four flags S_Empty and the set values for the four flags C_Empty (S22 and S23).

When at least one of the four flags S_Empty is set ON (S22: ON), the controller 230 displays the notification screen S_Empty on the display 17 (S24). When all the four flags S_Empty are set OFF and at least one of the four flags C_Empty is set ON (S22: OFF and S23: ON), the controller 230 displays the notification screen C_Empty on the display 17 (S25). The processing in steps S24 and S25 is an example of activating the alarm.

The notification screen S_Empty displayed in step S24 may be the same as in step S12. The notification screen C_Empty notifies the user that the ink cartridge 50 corresponding to the flag C_Empty set ON is in the cartridge empty state. For example, the notification screen C_Empty may include information indicating the color and the ink amounts Vc and Vs of the ink stored in the ink cartridge 50 in the cartridge empty state. In contrast, when all the four flags S_Empty and the four flags C_Empty are set OFF (S23: OFF), the controller 230 completes the image recording process without performing the processing in steps S24 and S25.

An example of the discharge instruction is not limited to the recording instruction, but may be a maintenance instruction instructing maintenance of the nozzles 40 such as a purge. For example, the controller 230 performs the same process as in FIG. 14 in response to a maintenance instruction obtained through the operation panel 22. The process in response to a maintenance instruction differs from the above process in the manner described below. First, the controller 230 drives a maintenance mechanism (not shown) in step S18, and discharges the ink through the nozzles 40. The controller 230 also performs the processing in steps subsequent to step S21 without performing the processing in step S21 after the counting process.

Counting Process

Figure 15:
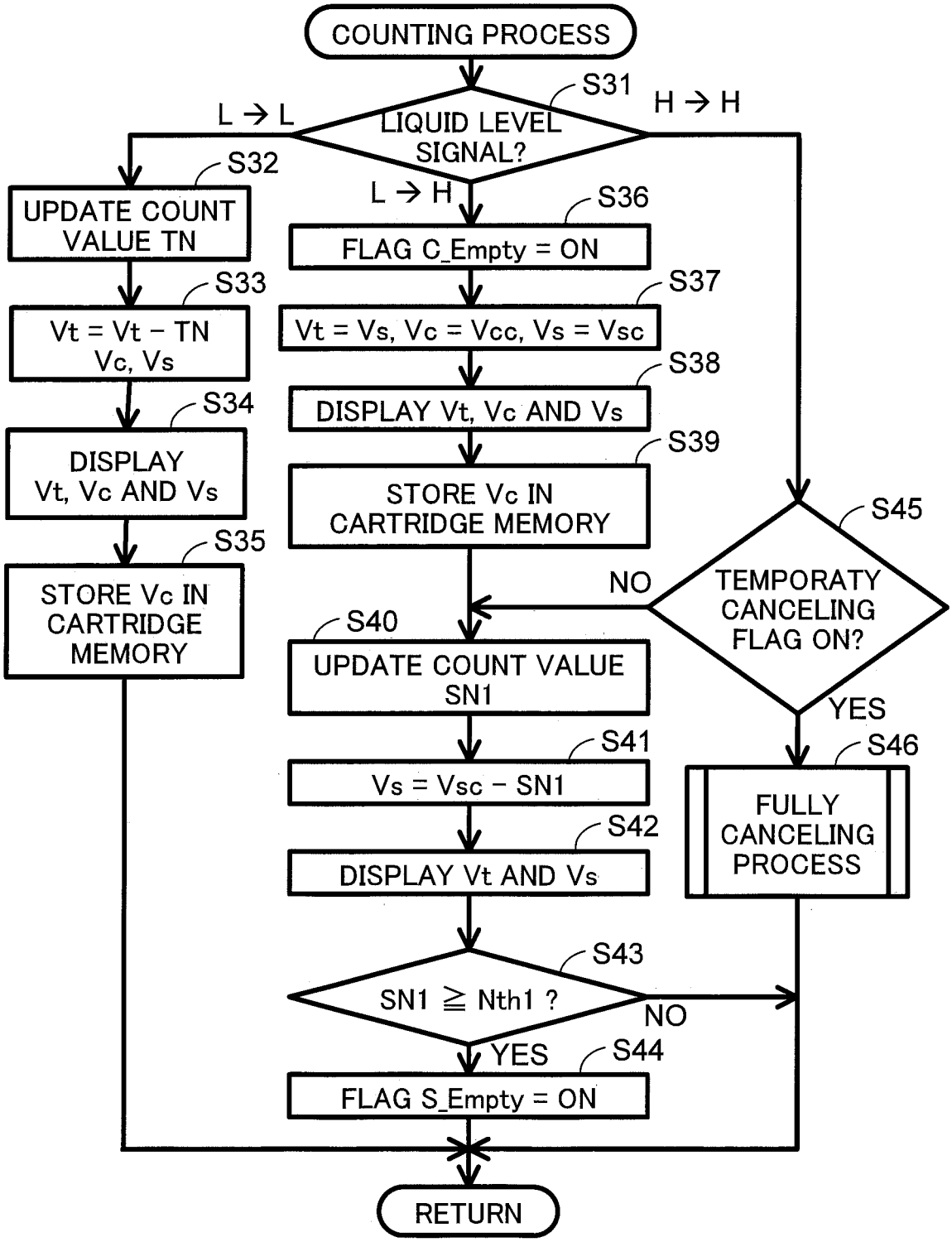
FIG. 15 is a flowchart of a counting process.

The counting process performed by the controller 230 in step S20 will be described in detail with reference to FIG. 15. The controller 230 performs the counting process independently for each of the four ink cartridges 50. The counting process is common to the ink cartridges 50. The counting process for one ink cartridge 50 will be described.

First, the controller 230 compares sets of information indicating the signals from the liquid level sensors 155 stored in the RAM 233 in steps S17 and S19 (S31). More specifically, the controller 230 determines whether the signal from each of the four liquid level sensors 155 has changed before and after the processing in step S18 immediately before the counting process (S20).

When the sets of information stored in the RAM 233 in steps S17 and S19 both indicate a low-level signal (S31: L→L) (in other words, the output of each liquid level sensor 155 remains unchanged before and after the processing in step S18) (S32), the controller 230 updates the count value TN (S32). More specifically, the controller 230 counts up the count value TN to a value equivalent to the amount of ink instructed to discharge in the immediately preceding step S18.

The controller 230 also calculates the current total amount Vt (S33). First, the controller 230 calculates the total amount Vt after the cartridge replacement that is the sum of the ink amount Vc and the ink amount Vs stored in the EEPROM 234 after the cartridge replacement. The controller 230 then calculates the current total amount Vt by subtracting the ink amount equivalent to the count value TN from the calculated total amount Vt (Vt=Vt−TN). The controller 230 then obtains the ink amounts Vc and Vs based on the calculated current total amount Vt and the volume $V_{th}$ (S33).

The controller 230 then displays the obtained total amount Vt and one of the ink amount Vc and the ink amount Vs on the display 17 (S34). Further, the controller 230 overwrites the ink amount Vc stored in the memory of the IC chip 66 of the ink cartridge 50 with the obtained ink amount Vc (S35).

Figure 19A:
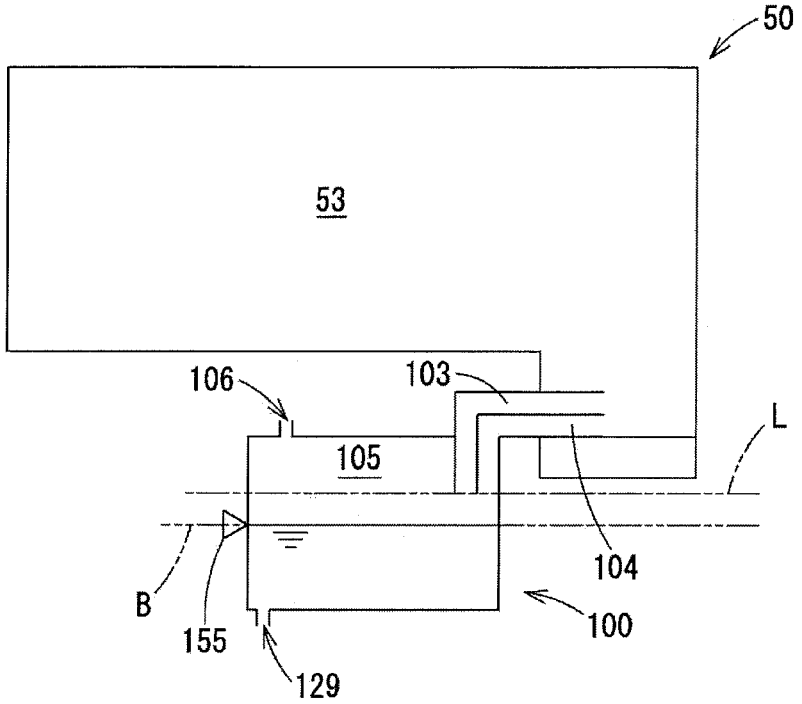
FIG. 19A is a schematic diagram of the ink cartridge 50 and the subtank 100 communicating with each other in which the cartridge is empty.

When the information stored in the RAM 233 in step S17 indicates a low-level signal and the information stored in the RAM 233 in step S19 indicates a high-level signal (S31: L→H) (in other words, the output of the liquid level sensor 155 is changed before and after the processing in step S18), the controller 230 substitutes a value indicating ON into the flag C_Empty (S36). The output from the liquid level sensors 155 changing from a low-level signal to a high-level signal corresponds to the liquid level of the second reservoir 105 reaching the predetermined level B during the processing in step S18 as shown in FIG. 19A. In this state, no ink transfer occurs between the ink cartridge 50 and the subtank 100.

The controller 230 also reads a predetermined ink amount Vcc (=0) from the ROM 232, and sets the ink amount Vc to the predetermined ink amount Vcc (S37). Similarly, the controller 230 reads a predetermined ink amount Vsc (equivalent to the volume of a part of the second reservoir 105 lower than the predetermined level B) from the ROM 232, and sets the ink amount Vs to the predetermined ink amount Vsc (S37). The ink amounts Vc and Vs calculated in the residual amount updating process include errors. The controller 230 thus sets the ink amount Vc to the predetermined ink amount Vcc and the ink amount Vs to the predetermined ink amount Vsc at the time when the output from the liquid level sensor 155 changes from a low-level signal to a high-level signal, thus resetting the accumulated errors. Further, the controller 230 calculates the current total amount Vt as a value equal to the ink amount Vs (Vt=Vsc) (S37). When the ink amount Vc is zero, the total amount Vt has the same value as the ink amount Vs.

The controller 230 then displays the current total amount Vt and one of the ink amount Vc and the ink amount Vs on the display 17 (S38). The controller 230 also overwrites the ink amount Vc stored in the memory of the IC chip 66 of the ink cartridge 50 with the above ink amount Vc (S39).

The output of each liquid level sensor 155 changes during the processing in step S18, and thus the predetermined ink amount Vsc read in step S37 is not strictly the amount of ink stored in the subtank 100 at the moment when the output from the liquid level sensor 155 changes, but indicates the amount of ink immediately before the output from the liquid level sensor 155 changes. With the difference between the ink amounts being small, the ink amount Vsc read in step S37 is approximately the ink amount Vs at the time when the output from the liquid level sensor 155 changes.

The controller 230 also counts up the count value SN1 stored in EEPROM 234 to the value equivalent to the amount of ink instructed to discharge in the immediately preceding step S18 (S40). In other words, the controller 230 starts updating the count value SN1 in response to the output from the liquid level sensors 155 changing from a low-level signal to a high-level signal. The controller 230 counts up the count value TN stored in the EEPROM 234 to a value equivalent to the amount of ink instructed to discharge in the immediately preceding step S18.

The controller 230 then calculates the ink amount Vs (S41). The above ink amount Vs is obtained by subtracting the ink amount equivalent to the count value SN1 stored in the EEPROM 234 from the predetermined ink amount Vsc stored in the ROM 232. As described above, after the output from the liquid level sensor 155 changes to a high-level signal, the ink amount Vs is the same value as the current total amount Vt. The ink amount Vc is zero.

The controller 230 then displays the obtained current total amount Vt or the ink amount Vs on the display 17 (S42). The ink amount Vc is zero after the output of liquid level sensor 155 changes to a high-level signal, and thus the controller 230 does not overwrite the ink amount Vc stored in the memory of the IC chip 66 of the ink cartridge 50.

The controller 230 then compares the count value SN1 updated in step S40 with the threshold value $N_{th1}$ (S43). When determining that the count value SN1 updated in step S40 is smaller than the threshold value $N_{th1}$ (S43: No), the controller 230 completes the counting process. In contrast, when determining that the count value SN1 updated in step S40 is equal to or greater than the threshold value $N_{th1}$ (S43: Yes), the controller 230 substitutes the value indicating ON into the flag S_Empty (S44). The controller 230 disables the ink discharge through the recording head 39 in response to the flag S_Empty set ON, and completes the counting process.

When the sets of information stored in the RAM 233 in steps S17 and S19 both indicate a high-level signal (S31: H→H), the controller 230 determines whether the temporary canceling flag stored in the EEPROM 234 is ON (S45). When the temporary canceling flag is ON (S45: No), the controller 230 reads the count value SN1 stored in the EEPROM 234. The controller 230 then counts up the read count value SN1 to a value equivalent to the amount of ink instructed to discharge in the immediately preceding step S18 and stores the value into the EEPROM 234 again. More specifically, the controller 230 updates the count value SN1 (S40). The controller 230 also updates the count value TN. The controller 230 then performs the processing from steps S41 to S44 described above using the count value SN1 updated in step S40.

When the temporary canceling flag is ON (S45: Yes), the controller 230 performs the empty-state fully canceling process (S46). The empty-state fully canceling process will be described in detail below with reference to FIG. 17.

Empty-State Temporary Canceling Process

Figure 16:
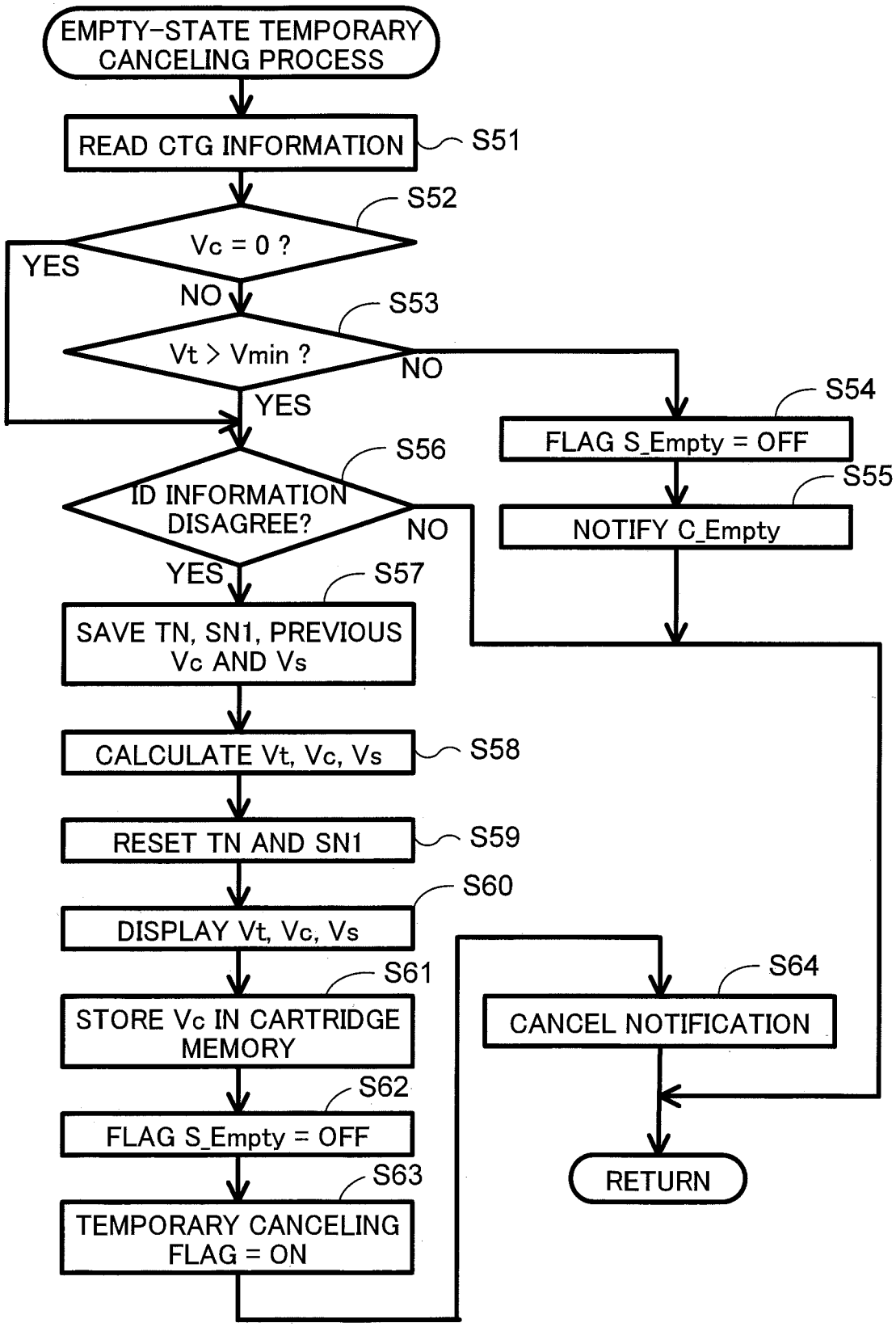
FIG. 16 is a flowchart of an empty-state temporary canceling process.

With reference to FIG. 16, the empty-state temporary canceling process performed by the controller 230 in step S16 will be described in detail. The controller 230 performs the empty-state temporary canceling process independently for each of the four ink cartridges 50. The empty-state temporary canceling process is common to the ink cartridges 50. The empty-state temporary canceling process for one ink cartridge 50 will be described.

In the counting process, when determining that the count value SN1 is equal to or greater than the threshold value $N_{th1}$ (S43: Yes), the controller 230 substitutes the value indicating ON into the flag S_Empty (S44) and disables the ink discharge through the recording head 39. In the image recording process, when determining that the flag S_Empty is set ON (S11: ON), the controller 230 displays the notification screen S_Empty on the display 17 (S12).

Figure 19B:
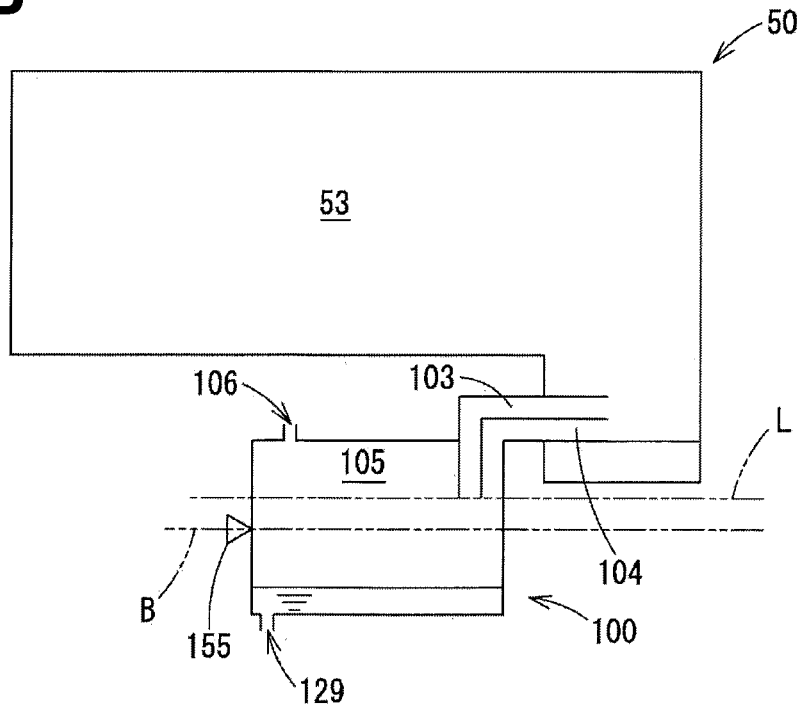
FIG. 19B is a schematic diagram of the ink cartridge 50 and the subtank 100 communicating with each other in which the subtank 100 has no residual amount.

In the above state (or the state of the controller 230 disabling the ink discharge through the recording head 39 and displaying the notification screen S_Empty on the display 17), as shown in FIG. 19B, the ink cartridge 50 is in the state of no ink flowing toward the subtank 100, or in the state of the ink amount Vc being zero (Vc=0). Also, the liquid level of the ink in the subtank 100 is lower than the predetermined level B and reaches the position near the upper end of the communication port 129. Image recording cannot be performed unless the ink discharge through the recording head 39 is enabled by the user replacing the ink cartridge 50 in the empty state with a fresh ink cartridge 50 or with an ink cartridge 50 storing a sufficient amount of ink.

In the process of replacing the ink cartridge 50 by the user, the controller 230 obtains a low-level signal from the installation sensor 154, and then obtains a high-level signal from the installation sensor 154, and further obtains a low-level signal from the installation sensor 154 (S14: Yes). More specifically, in the process of removing the ink cartridge 50 from the installation case 71, the controller 230 obtains a low-level signal from the installation sensor 154 and then obtains a high-level signal from the installation sensor 154. In the subsequent process of inserting the ink cartridge 50 into the installation case 71, the controller 230 obtains a high-level signal from the installation sensor 154 and then obtains a low-level signal from the installation sensor 154.

In the empty-state temporary canceling process, the controller 230 reads CTG information from the memory of the IC chip 66 through the contact 152 and stores the read CTG information into the EEPROM 234 (S51). When the ink cartridge 50 is replaced with a fresh ink cartridge 50, an initial ink amount Vc0 is stored as the ink amount Vc in the memory of the IC chip 66. The identification information is also read from the memory of the IC chip 66.

When determining that the initial ink amount Vc0 is read (S52: Yes), the controller 230 performs the processing in step S56 (described later) without performing the processing in step S53 (described later). When determining that the initial ink amount Vc0 is not read (S52: No), the controller 230 performs the processing in step S53 (described later). When the initial ink amount Vc0 is not read, the ink amount Vc read from the memory of the IC chip 66 is not the initial ink amount Vc0 but is a value smaller than the initial ink amount.

The controller 230 compares a total amount Vt obtained by adding the ink amount Vc read from the memory of the IC chip 66 to the ink amount Vs read from the EEPROM 234 with the threshold value Vmin (S53). The threshold value Vmin equivalent to the total amount when the liquid level reaches the predetermined level B in the second reservoir 105 of the subtank 100. When the calculated total amount Vt is equal to or greater than the threshold value Vmin (S53: Yes), the ink is transferred from the first reservoir 53 of the ink cartridge 50 to the second reservoir 105 of the subtank 100 and the liquid level of the ink in the second reservoir 105 reaches the predetermined level B or higher. In contrast, the controller 230 performs the processing in steps S54 and S55 when the calculated total amount Vt is smaller than the threshold value Vmin (S53: No).

When determining that the calculated total amount Vt is smaller than the threshold value Vmin (S53: No), the controller 230 substitutes a value indicating OFF into the flag S_Empty and enables the disabled discharge of ink through the recording head 39 (S54). The value indicating ON remains for the flag C_Empty. The controller 230 then deletes the notification screen S_Empty from the display 17 and displays the notification screen C_Empty on the display 17 (S55). The controller 230 completes the empty-state temporary canceling process.

When the calculated total amount Vt is smaller than the threshold value Vmin, the liquid level of the ink in the second reservoir 105 does not reach the predetermined level B or higher despite any ink transfer from the first reservoir 53 of the ink cartridge 50 to the second reservoir 105 of the subtank 100. In this case, the user is urged to replace the ink cartridge 50 through a notification although image recording can be performed with the ink stored in the second reservoir 105 of the subtank 100.

When determining that the calculated total amount Vt is equal to or greater than the threshold value Vmin (S53: Yes), the controller 230 compares the identification information read from the memory of the IC chip 66 with the identification information read from the memory of the IC chip 66 of the ink cartridge 50 yet to be replaced (S56). The identification information read from the memory of the IC chip 66 of the ink cartridge 50 yet to be replaced is stored in the EEPROM 234. For example, with the ink cartridge 50 replaced with a fresh ink cartridge 50, the compared two sets of identification information disagree with each other. The identification information is, for example, the serial number of the ink cartridge 50.

When determining that the compared two sets of identification information agree with each other (S56: No), the controller 230 completes the empty-state temporary canceling process. When the ink cartridge 50 having the ink used up to have the ink amount Vc of zero in the first reservoir 53 is installed in the installation case 71 again, no ink is transferred from the first reservoir 53 of the ink cartridge 50 to the second reservoir 105 of the subtank 100, and thus the empty state Empty is not to be canceled temporarily.

When determining that the compared two sets of identification information disagree with each other (S56: Yes), the controller 230 stores the count values TN and SN1, the ink amount Vc, and the ink amount Vs stored in the EEPROM 234 into another storage area of the EEPROM 234 (S57). The count values TN and SN1, the ink amount Vc, and the ink amount Vs stored in the other memory area of the EEPROM 234 are used when the empty state is not fully canceled after the empty state Empty is temporarily canceled as described later.

After step S57, the controller 230 calculates the total amount Vt after the cartridge replacement (S58). In detail, the controller 230 calculates the ink amount Vs before the cartridge replacement (equal to the total amount Vt) based on the count value SN1 before the cartridge replacement stored in the EEPROM 234 and a predetermined ink amount Vsc stored in the ROM 232, and stores the ink amount into the EEPROM 234. Based on the calculated ink amount Vs and the ink amount Vc read from the memory of the IC chip 66 of the replaced ink cartridge 50, the total amount Vt after the cartridge replacement is calculated. More specifically, the ink amount Vc stored in the first reservoir 53 of the fresh ink cartridge 50 is added to the ink amount Vs stored in the second reservoir 105 of the subtank 100 immediately before the ink cartridge 50 is replaced. The controller 230 thus calculates the sum of the ink amount Vc read from the IC chip 66 of the replaced ink cartridge 50 and the ink amount Vs before the cartridge replacement stored in the EEPROM 234 as the total amount Vt (Vt=Vs+Vc). The ink amounts Vc and Vs are calculated from the calculated total amount Vt of ink based on the volume $V_{th}$.

The count values TN and SN1 stored in the EEPROM 234 are reset (S59). This sets the count values TN and SN1 to their initial values (zero).

The controller 230 then displays the obtained current total amount Vt and one of the ink amount Vc and the ink amount Vs on the display 17 (S60). The controller 230 stores the calculated ink amount Vc into the memory of the IC chip 66 through the contact 152 (S61). When the initial ink amount Vc0 as the ink amount Vc is stored in the memory of the IC chip 66, the controller 230 overwrites the initial ink amount Vc0 with the calculated ink amount Vc. With the ink amount Vc overwritten in the memory of the IC chip 66, the ink cartridge 50 is determined not to be a fresh ink cartridge. In the manufacturing processes, a flag indicating that the ink cartridge 50 is a fresh ink cartridge may be set ON in the memory of the IC chip 66. Once the ink cartridge 50 is installed in the installation case 71, the controller 230 may substitute the value indicating OFF into the flag. The controller 230 can thus determine whether the ink cartridge 50 is a fresh ink cartridge based on the value of the flag.

The controller 230 substitutes the value indicating OFF into each of the flag S_Empty and the flag C_Empty (S62). The controller 230 substitutes the value indicating ON into the temporary canceling flag (S63). The controller 230 enables the ink discharge through the recording head 39 when all the four flags S_Empty are set OFF. The controller 230 deletes the notification screen S_Empty and the notification screen C_Empty from the display 17 (S64), and completes the empty-state temporary canceling process.

Empty-State Fully Canceling Process

Figure 17:
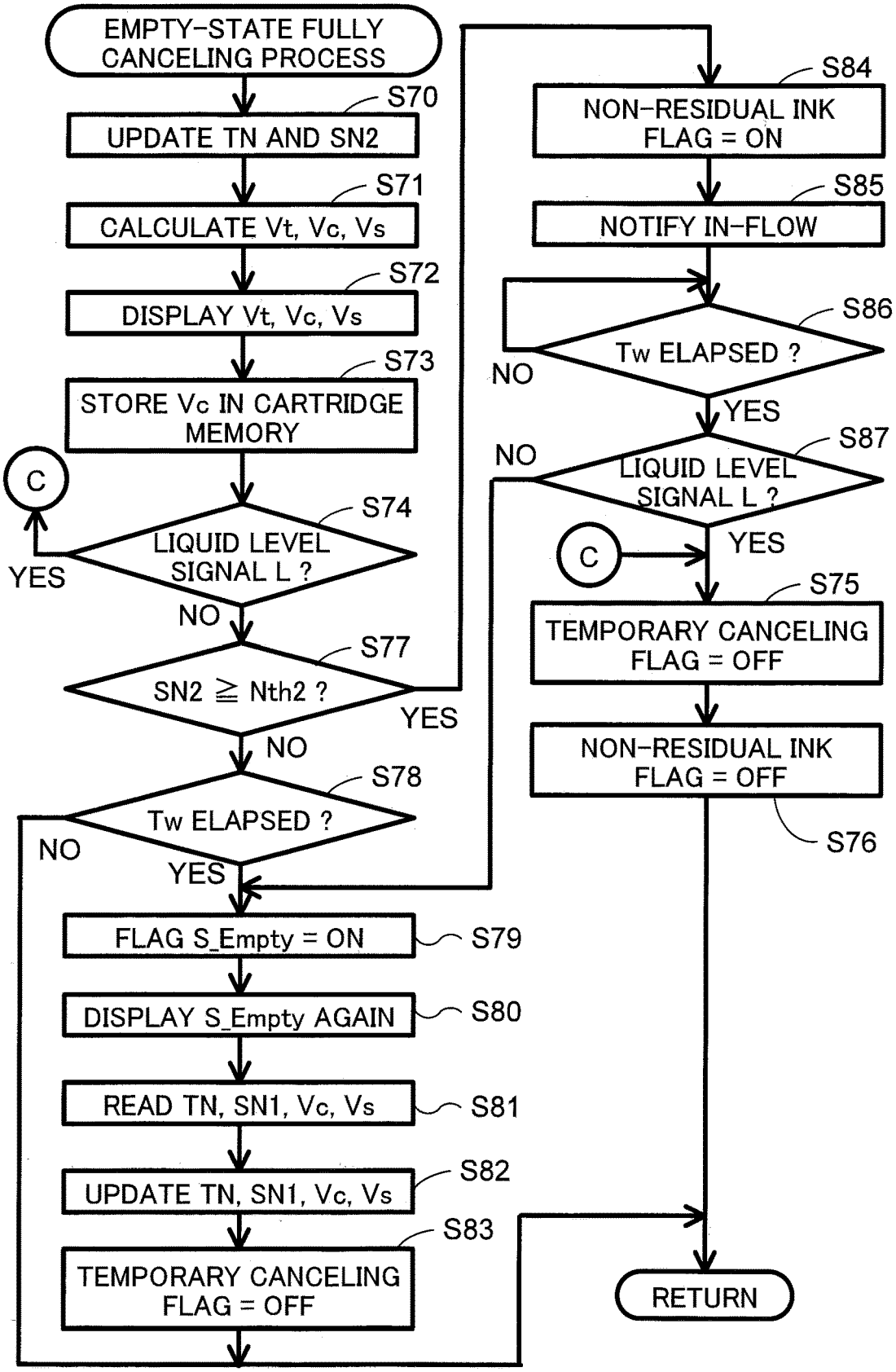
FIG. 17 is a flowchart of an empty-state fully canceling process.

With reference to FIG. 17, the empty-state fully canceling process performed by the controller 230 in step S46 will be described in detail. The controller 230 performs the empty-state fully canceling process independently for each of the four ink cartridges 50. The empty-state fully canceling process is common to the ink cartridges 50. The empty-state canceling process for one ink cartridge 50 will be described.

When determining that the temporary canceling flag is ON in the counting process (S45: Yes), the controller 230 performs the empty-state fully canceling process. At this time, the flag S_Empty is OFF and the ink discharge through the recording head 39 is enabled. The notification screen S_Empty is not on the display 17. The user can use the multifunction peripheral 10 in the same manner as in the normal use state.

Figure 20:
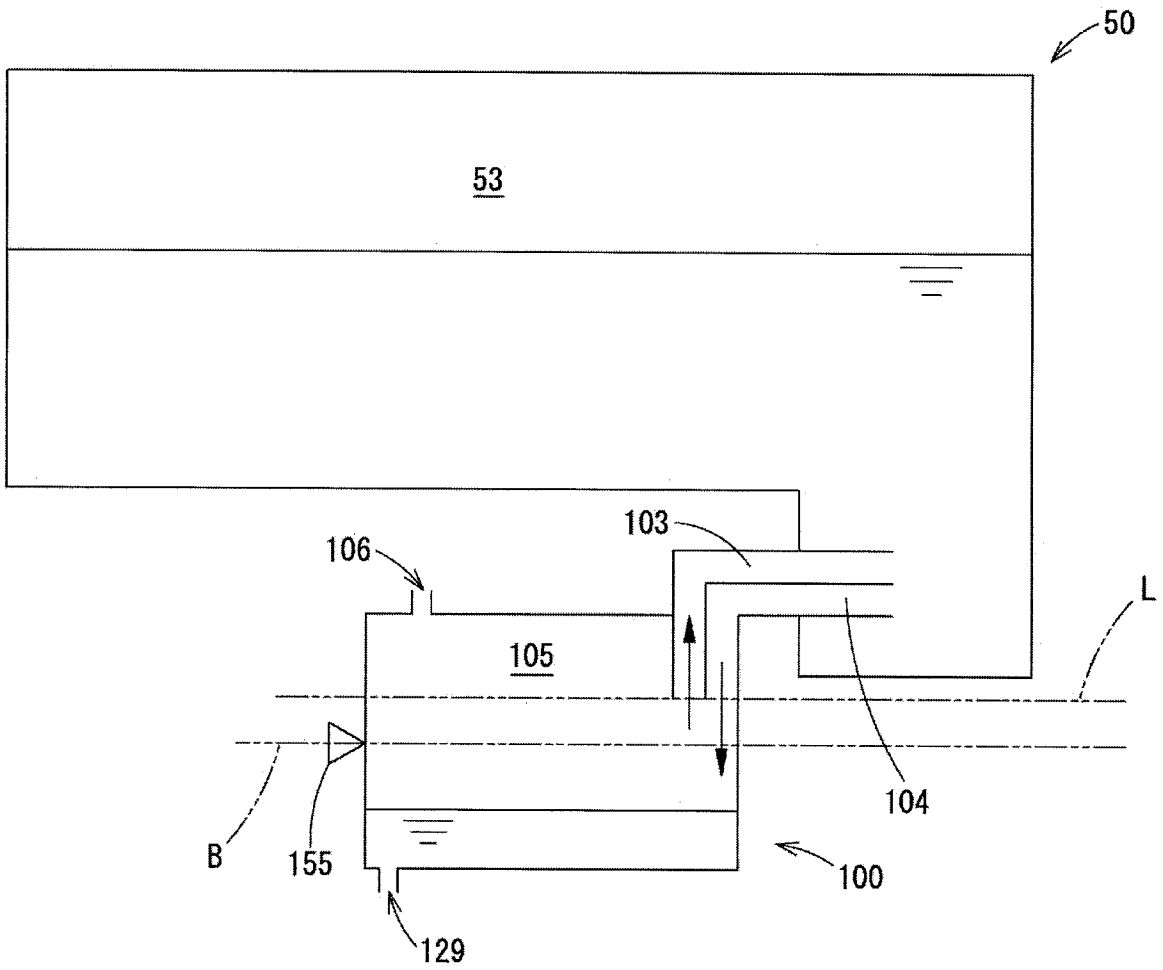
FIG. 20 is a schematic diagram of the ink cartridge 50 and the subtank 100 communicating with each other in which ink flows from the ink cartridge 50 into the subtank 100 until the liquid level of the ink in the subtank 100 reaches a predetermined level B.

As shown in FIG. 20, when the temporary canceling flag is ON, the ink is transferred from the first reservoir 53 of the ink cartridge 50 to the second reservoir 105 of the subtank 100 and the liquid level of the ink in the second reservoir 105 is lower than the predetermined level B. When the processing in step S18 is performed in this state, the controller 230 counts up the count value SN2 stored in the EEPROM 234 to a value equivalent to the amount of ink instructed to discharge in the immediately preceding step S18 (S70). In other words, the controller 230 starts updating the count value SN2 in response to the temporary canceling flag set ON. The controller 230 counts up the count value TN stored in the EEPROM 234 to a value equivalent to the amount of ink instructed to discharge in the immediately preceding step S18.

The controller 230 then calculates the current total amount Vt (S71). First, the controller 230 calculates the total amount Vt after the cartridge replacement as the sum of the ink amount Vc and the ink amount Vs stored in the EEPROM 234. The controller 230 then calculates the current total amount Vt by subtracting the ink amount equivalent to the count value TN from the total amount Vt after the cartridge replacement. The controller 230 obtains the ink amounts Vc and Vs based on the calculated current total amount Vt and the volume $V_{th}$ (S71).

The controller 230 then displays the obtained current total amount Vt and one of the ink amount Vc and the ink amount Vs on the display 17 (S72). Further, the controller 230 overwrites the ink amount Vc stored in the memory of the IC chip 66 of the ink cartridge 50 with the obtained ink amount Vc (S73).

The controller 230 then determines whether the output from the liquid level sensor 155 is a low-level signal (S74). When determining that the output from the liquid level sensor 155 is a low-level signal (S74: Yes), the controller 230 substitutes the value indicating OFF into each of the temporary canceling flag and the non-residual ink flag (S75 and S76).

When determining that the output from the liquid level sensor 155 is not a low-level signal but is a high-level signal (S74: No), the controller 230 compares the count value SN2 updated in step S70 with the threshold value $N_{th2}$ (S77).

When determining that the count value SN2 updated in step S70 is smaller than the threshold value $N_{th2}$ (S77: No), the controller 230 determines whether a wait time Tw has elapsed from the time stored in the EEPROM 234 in the image recording process (the time when the low-level signal is obtained after the high-level signal is obtained from the installation sensor) (S78). The wait time Tw is set by a wait time Tw setting process described later.

When determining that the wait time Tw has not elapsed from the time stored in the EEPROM 234 (S78: No), the controller 230 completes the empty-state fully canceling process.

When determining that the wait time Tw has elapsed from the time stored in the EEPROM 234 (S78: Yes), the controller 230 substitutes the value indicating ON into the flag S_Empty (S79). The controller 230 then disables the ink discharge through the recording head 39 in response to the flag S_Empty set ON. The controller 230 displays the notification screen S_Empty on the display 17 (S80).

In the empty-state temporary canceling state, the total amount Vt that is the sum of the ink amount Vc read from the memory of the IC chip 66 of the replaced ink cartridge 50 and the ink amount Vs of the second reservoir 105 of the subtank 100 is equal to or greater than the threshold value Vmin. However, when the ink amount Vc stored in the memory of the IC chip 66 is larger than the amount of ink substantially stored in the ink cartridge 50 or the ink transfer from the ink cartridge 50 to the subtank 100 is disabled, the liquid level of the ink is not raised to the predetermined level B in the second reservoir 105 of the subtank 100. In this case, the user may be urged to replace the ink cartridge 50 again with a fresh ink cartridge 50 or with an ink cartridge 50 storing a sufficient amount of ink, and the ink discharge through the recording head 39 is to be disabled until the ink cartridge 50 is replaced again.

The controller 230 reads the count values TN and SN1, the ink amount Vc, and the ink amount Vs stored in the other area of the EEPROM 234 (S81) and updates the count values TN and SN1, the ink amount Vc, and the ink amount Vs currently stored in the EEPROM 234 to the read values (S82). More specifically, the count value SN2 is added to each of the count values TN and SN1 stored in the other area of the EEPROM 234, and the resultant values are stored into the EEPROM 234. The controller 230 updates the ink amount Vc stored in the EEPROM 234 to zero. Further, the controller 230 substitutes the value indicating OFF into the temporary canceling flag (S83), and completes the empty-state fully canceling process. This ends the empty-state temporary canceling state, thus setting the empty ink state immediately before temporarily canceling the empty state Empty. The updated count value SN1, more specifically, the sum of the stored count values SN1 and SN2, corresponds to a third count value.

When determining that the count value SN2 updated in step S70 is equal to or greater than the threshold value $N_{th2}$ (S77: Yes), the controller 230 substitutes the value indicating ON into the non-residual ink flag (S84). When the count value SN2 is equal to or greater than the threshold value $N_{th2}$ for a predetermined time until the liquid level of the ink in the second reservoir 105 of the subtank 100 reaches the predetermined level B, the ink is discharged through the recording head 39 by the amount of ink corresponding to the number N of sheets to undergo image recording.

The controller 230 displays a screen for notifying that the ink is flowing into the subtank 100 from the ink cartridge 50 on the display 17 (S85). The controller 230 determines whether the wait time Tw has elapsed from the time stored in the EEPROM 234 (S86). When determining that the wait time Tw has not elapsed from the time stored in the EEPROM 234 (S86: No), the controller 230 continuously displays the above screen on the display 17. More specifically, until the wait time Tw elapses from the time stored in the EEPROM 234, the image recording process in the next step S18 is suspended. The operation performed by the display 17 in step S86 is an example of a second operation.

When determining that the wait time Tw has elapsed from the time stored in the EEPROM 234 (S86: Yes), the controller 230 determines whether the signal output from the liquid level sensor 155 is a low-level signal (S87). When determining that the signal output from the liquid level sensor 155 is a low-level signal (S87: Yes), the controller 230 performs the processing from steps S75 to S76 described above, and completes the empty-state fully canceling process. The signal output from the liquid level sensor 155 being the low-level signal indicates that the ink is transferred from the ink cartridge 50 to the subtank 100, and the liquid level of the ink in the second reservoir 105 reaches the predetermined level B before the wait time Tw elapses from the time stored in the EEPROM 234. This ends the empty-state temporary canceling state.

In contrast, when determining that the signal output from the liquid level sensor 155 is not a low-level signal but is a high-level signal (S87: No), the controller 230 performs the processing from steps S79 to S83 described above, and ends the empty-state fully canceling process. This ends the empty-state temporary canceling state, thus setting the empty ink state immediately before temporarily canceling the empty state Empty.

When determining that the non-residual ink flag is ON in step S15 in the image recording process (S15: Yes), the controller 230 performs the process shown in FIG. 18. As described above, when the ink amount Vc stored in the memory of the IC chip 66 is larger than the amount of ink substantially stored in the ink cartridge 50 or the ink transfer from the ink cartridge 50 to the subtank 100 is disabled, the liquid level of the ink in the second reservoir 105 of the subtank 100 is not raised to the predetermined level B. In this case, the ink cartridge 50 is to be replaced again with a fresh ink cartridge 50 or with an ink cartridge 50 storing a sufficient amount of ink.

However, when the non-residual ink flag is ON, the count value SN2 updated in step S70 is already equal to or greater than the threshold value $N_{th2}$. Thus, although the ink cartridge 50 is replaced again, image recording performed in the empty-state temporary canceling state may cause air entrapment described above. When determining that the non-residual ink flag is ON (S15: Yes), the controller 230 does not perform the empty-state temporary canceling process.

Figure 18:
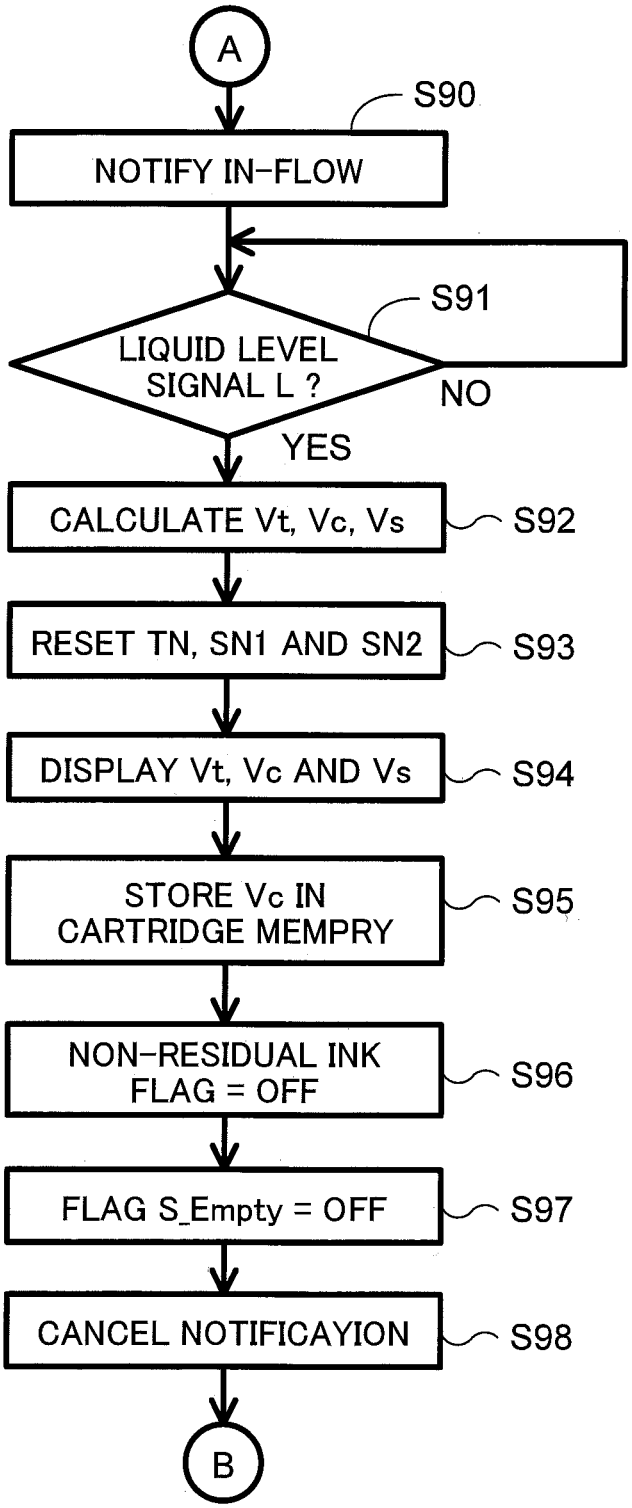
FIG. 18 is a flowchart of a part of the image recording process.

As shown in FIG. 18, when determining that the non-residual ink flag is ON (S15: Yes), the controller 230 displays the screen notifying that the ink is flowing into the subtank 100 from the ink cartridge 50 on the display 17 (S90).

The controller 230 determines whether the signal output from the liquid level sensor 155 is a low-level signal (S91). When determining that the signal output from the liquid level sensor 155 is not a low-level signal but a high-level signal (S91: No), the controller 230 repeatedly performs the processing in step S91 until the signal output from the liquid level sensor 155 changes to a low-level signal.

When determining that the signal output from the liquid level sensor 155 is a low-level signal (S91: Yes), the controller 230 calculates the ink amount Vs before the cartridge replacement (equal to the total amount Vt) based on the count value SN before the cartridge replacement stored in the EEPROM 234 and the ink amount Vsc stored in the ROM 232, and stores the calculated value into the EEPROM 234. Based on the calculated ink amount Vs and the ink amount Vc read from the memory of the IC chip 66 of the replaced ink cartridge 50, the total amount Vt after the cartridge replacement is calculated (S92: Vt=Vs+Vc).

The controller 230 calculates the ink amount Vc and the ink amount Vs when ink transfer from the first reservoir 53 to the second reservoir 105 is complete based on the calculated total amount Vt and the volume $V_{th}$ read from the EEPROM 234 (S92).

The controller 230 resets the count values TN, SN1, and SN2 stored in the EEPROM 234 (S93). This sets the count values TN, SN1, and SN2 to their initial values (zero).

The controller 230 then displays the obtained current total amount Vt and one of the ink amount Vc and the ink amount Vs on the display 17 (S94). The controller 230 stores the calculated ink amount Vc into the memory of the IC chip 66 through the contact 152 (S95).

The controller 230 substitutes the value indicating OFF into each of the non-residual ink flag, the flag S_Empty, and the flag C_Empty (S96 and S97). The controller 230 enables the ink discharge through the recording head 39 when all the four flags S_Empty are set OFF. The controller 230 deletes the notification screen S_Empty and the notification screen C_Empty from the display 17 (S98) and returns to step S17. Thus, when the non-residual ink flag is set ON, which can cause air entrapment described above if more ink is discharged through the recording head 39, the empty ink state is canceled without temporarily canceling the empty ink state in response to the output from the liquid level sensor 155 indicating that the liquid level of the ink in the second reservoir 105 of the subtank 100 reaches the predetermined level B. This prevents air entrapment described above.

Wait Time Tw Setting Process

Figure 21:
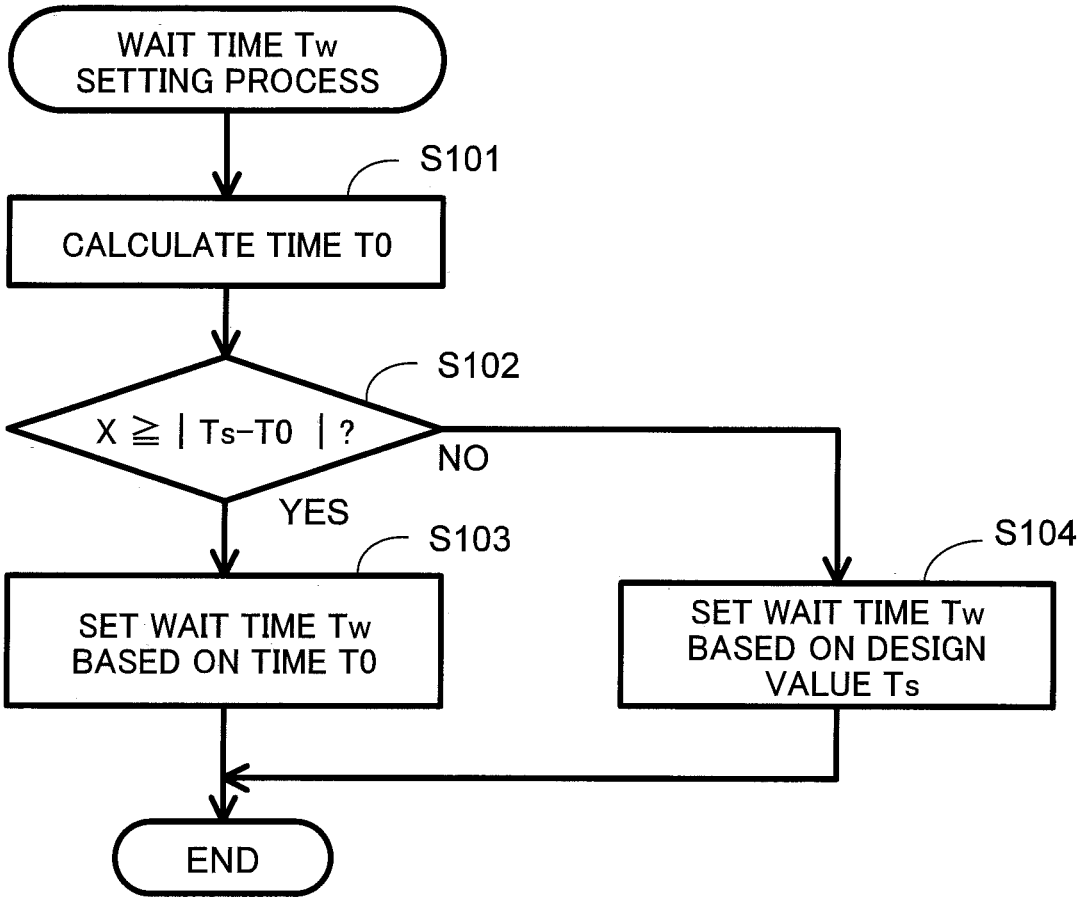
FIG. 21 is a flowchart of a wait time Tw setting process.

With reference to FIG. 21, the wait time Tw setting process performed by the controller 230 will be described in detail. The controller 230 performs the wait time Tw setting process independently for each of the four ink cartridges 50. The wait time Tw setting process is common to the ink cartridges 50. The wait time Tw setting process for one ink cartridge 50 will be described.

The controller 230 performs the wait time Tw setting process when the ink cartridge 50 is installed firstly in the installation case 71 of the multifunction peripheral 10. The controller 230 determines whether the ink cartridge 50 is installed firstly in the installation case 71 based on, for example, identification information read from the IC chip 66 of the installed ink cartridge 50 indicating that the cartridge has been packaged with the multifunction peripheral 10, or a flag indicating an initial ink loading operation not stored in the EEPROM 234. The determination causes the time to be measured from when the ink flows into the second reservoir 105 of the subtank 100 in the empty state to when the liquid level of the ink reaches the predetermined level B.

As shown in FIG. 21, the controller 230 stores, into the EEPROM 234, the time when the ink cartridge 50 is installed firstly in the installation case 71, or in other words, the time when a low-level signal is obtained from the installation sensor 154 after a high-level signal is obtained from the installation sensor 154. The controller 230 then calculates, in response to the signal received from the liquid level sensor 155 changing from a high level to a low level, a time T0 from the time stored in the EEPROM 234 to when the signal from the liquid level sensor 155 changes (S101). The time T0 is an example of a second elapsed time.

When a fresh ink cartridge 50 is installed in the installation case 71, the ink flows from the first reservoir 53 into the second reservoir 105. The liquid level of the ink in the second reservoir 105 then reaches the predetermined level B over time, and thus the liquid level sensor 155 outputs a low-level signal.

Subsequently, the controller 230 calculates a difference between the calculated time T0 and a design value Ts prestored in the EEPROM 234 (|Ts−T0|) and determines whether the calculated difference is within a threshold value range X (S102: X≥|Ts−T0|). When the calculated difference is within the threshold value range X (S102: Yes), the controller 230 stores, into the EEPROM 234, the time obtained by adding a predetermined additional time to the time T0 as the wait time Tw (S103). When the calculated difference is out of the threshold value range X (S102: No), the controller 230 stores, into the EEPROM 234, the time obtained by adding a predetermined additional time to the predetermined design value Ts as the wait time Tw (S104).

Operational Effects of First Embodiment

The structure according to the first embodiment can cancel the empty ink state, in which the ink discharge through the recording head 39 is disabled, after the ink cartridge 50 is replaced and before the liquid level sensor 155 outputs a low-level signal. When the elapsed time from the replacement of the ink cartridge 50 reaches the wait time Tw after the empty ink state is canceled, the empty ink state is entered, in which the ink discharge through the recording head 39 is disabled. In this state, air from the second reservoir 105 of the subtank 100 is prevented from entering the recording head 39 although the ink cartridge 50 installed in the installation case 71 does not store an amount of ink in the first reservoir 53 sufficient to cause the liquid level of the ink in the second reservoir 105 of the subtank 100 to reach the predetermined level B or higher.

When the elapsed time from the replacement of the ink cartridge 50 reaches the wait time Tw and the empty ink state is entered, the count value SN2 is updated by adding the count value SN2 to the count value SN1 used before the state S_Empty is canceled.

In the empty ink state, the previously disabled ink discharge through the head can be enabled after the ink cartridge 50 is replaced with a fresh ink cartridge 50 and before the liquid level sensor 155 outputs a low-level signal.

Further, the notification screen S_Empty on the display 17 can notify the user that the ink discharge through the recording head 39 is disabled.

Without a fresh ink cartridge 50 replacing the ink cartridge 50, the empty ink state can be canceled before the liquid level sensor 155 outputs a low-level signal when the ink cartridge 50 installed in the installation case 71 stores an amount of ink in the first reservoir 53 sufficient to cause the liquid level of the ink in the second reservoir 105 of the subtank 100 to reach the predetermined level B or higher.

Further, when the ink cartridge 50 installed in the installation case 71 does not store an amount of ink in the first reservoir 53 sufficient to cause the liquid level of the ink in the second reservoir 105 of the subtank 100 to reach the redetermined position B or higher, the notification screen C_Empty appears on the display 17 to urge the user to replace the ink cartridge 50 with a fresh ink cartridge 50.

When the sum of the count value SN2 and the count value SN1 reaches the threshold value $N_{th2}$ after the empty ink state is canceled, the empty ink state is entered, and thus the controller 230 can limit the amount of ink discharged through the recording head 39 before receiving a low-level signal from the liquid level sensor 155. This prevents air from the second reservoir 105 from entering the recording head 39. Subsequently, the empty ink state is canceled in response to a low-level signal from the liquid level sensor 155, enabling the disabled discharge of ink through the recording head 39.

The wait time Tw is set in accordance with the elapsed time from when the ink cartridge 50 is installed firstly in the installation case 71 to when the liquid level sensor 155 outputs a low-level signal, and can thus be set in accordance with differences between individual devices.

When the temporary canceling state is entered or the temporary canceling flag is ON, the controller 230 substitutes the value indicating OFF into the temporary canceling flag in response to a low-level signal from the liquid level sensor 155. Thus, when the liquid level of the second reservoir 105 is substantially equal to or higher than the predetermined level B after the cartridge is replaced, the temporary canceling state is canceled. The controller also substitutes the value indicating OFF into the non-residual ink flag as well when the liquid level of the second reservoir 105 is substantially equal to or higher than the predetermined level B after the cartridge is replaced. This prevents air entrapment described above.

Modifications of First Embodiment

The empty-state temporary canceling process in the first embodiment includes the determination (S52) as to whether the ink cartridge 50 installed in the installation case 71 stores the initial ink amount Vc0, or in other words, as to whether the ink cartridge 50 is a fresh ink cartridge 50, or the determination (S53) as to whether the total amount Vt that is the sum of the ink amount Vc of the first reservoir 53 and the ink amount Vs of the second reservoir 105 is equal to or greater than the threshold value Vmin when the ink cartridge 50 installed in the installation case 71 is not a fresh ink cartridge 50. However, the processing in steps S52 to S55 may not be performed. More specifically, the controller 230 may temporarily cancel the empty ink state in response to the ink cartridge 50 installed in the installation case 71. The processing in step S54 may be performed without performing the processing in steps S52 and S53, or may be performed with either step S52 or S53.

In the first embodiment, the ink discharge through the recording head 39 refers to image recording on a sheet. However, the ink discharge through the recording head 39 may be a purge for forcibly discharging the ink through the nozzles 40 of the recording head 39.

In the first embodiment, the controller 230 disables the ink discharge through the recording head 39 when the flag S_Empty is ON. However, the ink discharge through the recording head 39 may not be disabled, and the controller 230 may simply display the notification screen S_Empty on the display 17 when the flag S_Empty is ON. Similarly, the controller 230 disables the ink discharge through the recording head 39 when the non-residual ink flag is ON. However, the ink discharge through the recording head 39 may not be disabled, and the controller 230 may simply display the notification screen S_Empty on the display 17 when the flag S_Empty is ON. In contrast, the controller 230 may simply disable the ink discharge through the recording head 39 when the flag S_Empty is ON without displaying the notification screen S_Empty on the display 17. This prevents at least air entrapment described above. Similarly, the controller 230 may simply disable the ink discharge through the recording head 39 when the non-residual ink flag is ON without displaying, on the display 17, the notification screen notifying that the ink is flowing.

In the first embodiment, the controller 230 stores the total amount Vt into the EEPROM 234 after the ink cartridge 50 is replaced, and obtains the current total amount Vt by subtracting the ink amount equivalent to the count value TN from the total amount Vt. In some embodiments, the total amount Vt is updated and stored into the EEPROM 234 every time when the ink is discharged through the recording head 39. When the ink discharge through the recording head 39 is performed subsequently, the same ink amount as the discharged amount may be calculated based on the count value TN, and subtracted from the total amount Vt stored in the EEPROM 234 to update the total amount Vt.

In the first embodiment, the flag C_Empty is set ON in response to the output from the liquid level sensor 155 changing from a low-level signal to a high-level signal, and the notification screen C_Empty appears on the display 17. In some embodiments, the flag C_Empty may be set ON in response to the count value SN1 reaching a predetermined threshold after the output from the liquid level sensor 155 changes from a low-level signal to a high-level signal, and the notification screen C_Empty may appear on the display 17.

In the image recording process according to the first embodiment, the operations in steps S11 to S17 excluding the image recording operation, or the operations in step S18 and subsequent steps, may be performed when the cover 48 is closed or when the power of the printer is turned on.

The value indicating OFF may be substituted into the temporary canceling flag in response to a low-level signal received from the liquid level sensor 155 in a step other than step S75 or S83. For example, the value indicating OFF may be substituted into the temporary canceling flag in step S17 in response to a low-level signal received from the liquid level sensor 155.

Second Embodiment

A second embodiment will now be described. The structure of a multifunction peripheral 10 according to the second embodiment is the same as in the first embodiment, and will not be described in detail. The operation of the multifunction peripheral 10 according to the second embodiment will now be described.

Image Recording Process

Figure 22:
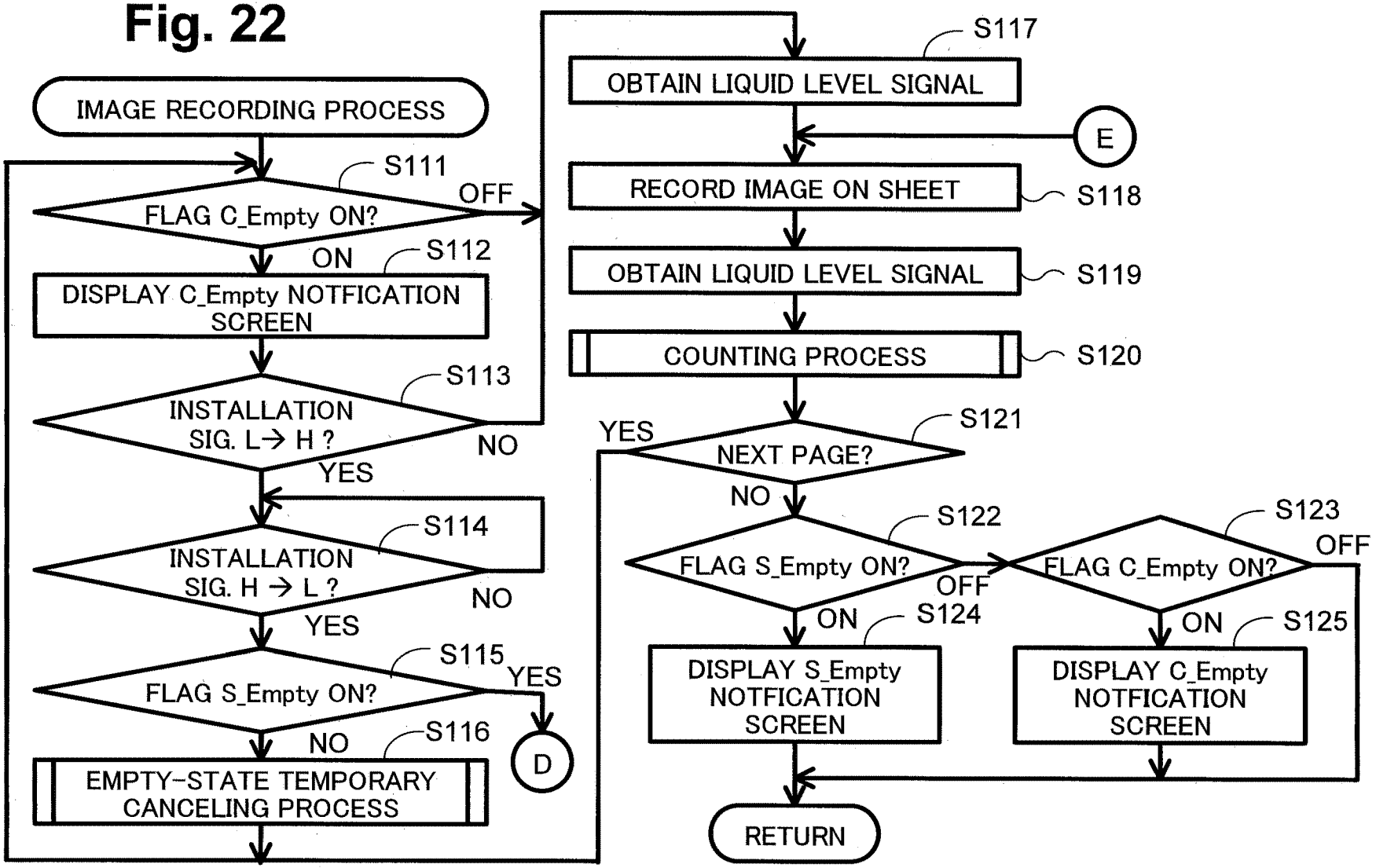
FIG. 22 is a flowchart of an image recording process according to a second embodiment.

The controller 230 performs an image recording process shown in FIG. 22 in response to a recording instruction input to the multifunction peripheral 10. The recording instruction is an example of a discharge instruction for causing the multifunction peripheral 10 to record an image represented by image data on a sheet. The recording instruction may be received in any manner, but may be received as a corresponding user operation performed through the operation panel 22 or may be received from an external device through a communication interface (not shown).

First, the controller 230 determines the set values for four flags C_Empty (S111). When determining that at least one of the four flags C_Empty is set ON (S111: ON), the controller 230 displays a notification screen C_Empty on the display 17 (S112). The notification screen C_Empty notifies the user that the ink cartridge 50 corresponding to the flag C_Empty set ON is in the cartridge empty state. For example, the notification screen C_Empty may include information indicating the color and the ink amounts Vc and Vs of the ink stored in the ink cartridge 50 in the cartridge empty state. In step S112, the controller 230 may display the notification screen S_Empty on the display 17 together with the notification screen C_Empty when determining that at least one of the four flags S_Empty is set ON. The operation of the display 17 in step S112 is an example of a first operation.

The controller 230 also performs the processing in steps S113 to S115 for each ink cartridge 50 corresponding to the flag C_Empty set ON. More specifically, the processing in steps S113 to S115 is performed for each ink cartridge 50 for which the flag C_Empty is set ON, among the four ink cartridges 50. The processing in steps S113 to S115 is common to the ink cartridges 50. The processing in steps S113 to S115 for one ink cartridge 50 will be described.

First, the controller 230 determines whether the signal obtained from the installation sensor 154 has changed from a low-level signal to a high-level signal (S113). When the signal obtained from the installation sensor 154 remains unchanged from the low-level signal (S113: No), the controller 230 obtains signals output from four liquid level sensors 155 at the current time (S117). When the flag C_Empty is in ON state, the liquid level of the second reservoir 105 of the subtank 100 is lower than the predetermined level B. However, while the liquid level of the second reservoir 105 is being lowered to a position immediately above the communication port 129, or in the cartridge empty state, image recording can be performed based on the recording instruction until the empty ink state is entered.

When determining that the signal obtained from the installation sensor 154 has changed from a low-level signal to a high-level signal (S113: Yes), the controller 230 repeatedly performs the processing in step S114 at predetermined time intervals until the signal output from the installation sensor 154 changes from a high-level signal to a low-level signal again (S114: No). In other words, the controller 230 repeatedly performs the processing in step S114 until the ink cartridge 50 is removed from the installation case 71 and an ink cartridge 50 is newly installed in the installation case 71.

When obtaining a low-level signal after a high-level signal from the installation sensor 154 (S114: Yes), the controller 230 determines whether the flag S_Empty is ON (S115). When the flag S_Empty is ON (S115: Yes), the controller 230 performs the process described below (see FIG. 26). The controller 230 also stores, into the EEPROM 234, the time at which the low-level signal is obtained from the installation sensor 154 after obtaining the high-level signal. The controller 230 may measure the time by operating a timer after obtaining the low-level signal from the installation sensor 154, instead of storing the time. The stored time or the measured time is used in an empty-state fully canceling process (described below).

When the flag S_Empty is OFF (S115: No), the controller 230 performs the empty-state temporary canceling process (S116). The empty-state temporary canceling process is to delete the notification screen C_Empty appearing on the display 17. The empty-state temporary canceling process will be described in detail with reference to FIG. 24. Then, the steps subsequent to step S111 are performed again in response to the completion of the empty-state temporary canceling process.

The controller 230 obtains signals output from the four liquid level sensors 155 at the current time when the flags C_Empty corresponding to all the ink cartridges 50 are all not ON, or in other words, are all OFF (S117). In step S117, the controller 230 further causes the RAM 233 to store information indicating whether the signal obtained from each liquid level sensor 155 is a high-level signal or a low-level signal.

The controller 230 then records the image represented by the image data included in the recording instruction on one sheet (S118). More specifically, the controller 230 causes the sheet on the feed tray 20 to be conveyed by the feed roller 25 and the conveyance roller 34, the recording head 39 to discharge the ink, and the sheet having the recorded image to be discharged to the discharge tray 21 with the discharge roller 36.

The controller 230 then obtains signals output from the four liquid level sensors 155 at the current time upon recording the image on one sheet in response to the recording instruction (S119). Similarly to step S117, the controller 230 causes the RAM 233 to store information indicating whether the signal obtained from the liquid level sensor 155 is a high-level signal or a low-level signal (S119). The controller 230 then performs a counting process (S120). The counting process is to update the count values TN, SN1, and SN2, the flag C_Empty, and the flag S_Empty based on the signals obtained from each liquid level sensor 155 in steps S117 and S119. The counting process will be described in detail below with reference to FIG. 23.

The controller 230 then repeatedly performs the processing in steps S111 to S120 until all the images indicated by the recording instruction are recorded on one sheet (S121: Yes). When recording all the images indicated by the recording instruction on one sheet (S121: No), the controller 230 determines the set values for the four flags S_Empty and the set values for the four flags C_Empty (S122 and S123).

When at least one of the four flags S_Empty is set ON (S122: ON), the controller 230 displays the notification screen S_Empty on the display 17 (S124). When all the four flags S_Empty are set OFF and at least one of the four flags C_Empty is set ON (S122: OFF and S123: ON), the controller 230 displays the notification screen C_Empty on the display 17 (S125). The processing in steps S124 and S125 is an example of activating the alarm.

The notification screen C_Empty displayed in step S123 may be the same as in step S112. The notification screen C_Empty notifies the user that the ink cartridge 50 corresponding to the flag C_Empty set ON is in the cartridge empty state. For example, the notification screen C_Empty may include information indicating the color and the ink amounts Vc and Vs of the ink stored in the ink cartridge 50 in the cartridge empty state. In contrast, when all the four flags S_Empty and the four flags C_Empty are set OFF (S123: OFF), the controller 230 completes the image recording process without performing the processing in steps S124 and S125.

The notification screen S_Empty notifies the user that the corresponding subtank 100 is in the empty ink state and the ink cannot be discharged through the recording head 39. For example, the notification screen S_Empty may include information indicating the color and the ink amounts Vc and Vs of the ink stored in the subtank 100 in the empty ink state.

An example of the discharge instruction is not limited to the recording instruction, but may be a maintenance instruction instructing maintenance of the nozzles 40 such as a purge. For example, the controller 230 performs the same process as in FIG. 22 in response to a maintenance instruction obtained through the operation panel 22. The process in response to a maintenance instruction differs from the above process in the manner described below. First, the controller 230 drives a maintenance mechanism (not shown) in step S118, and discharges the ink through the nozzles 40. The controller 230 also performs the processing in steps subsequent to step S21 without performing the processing in step S121 after the counting process.

Counting Process

Figure 23:
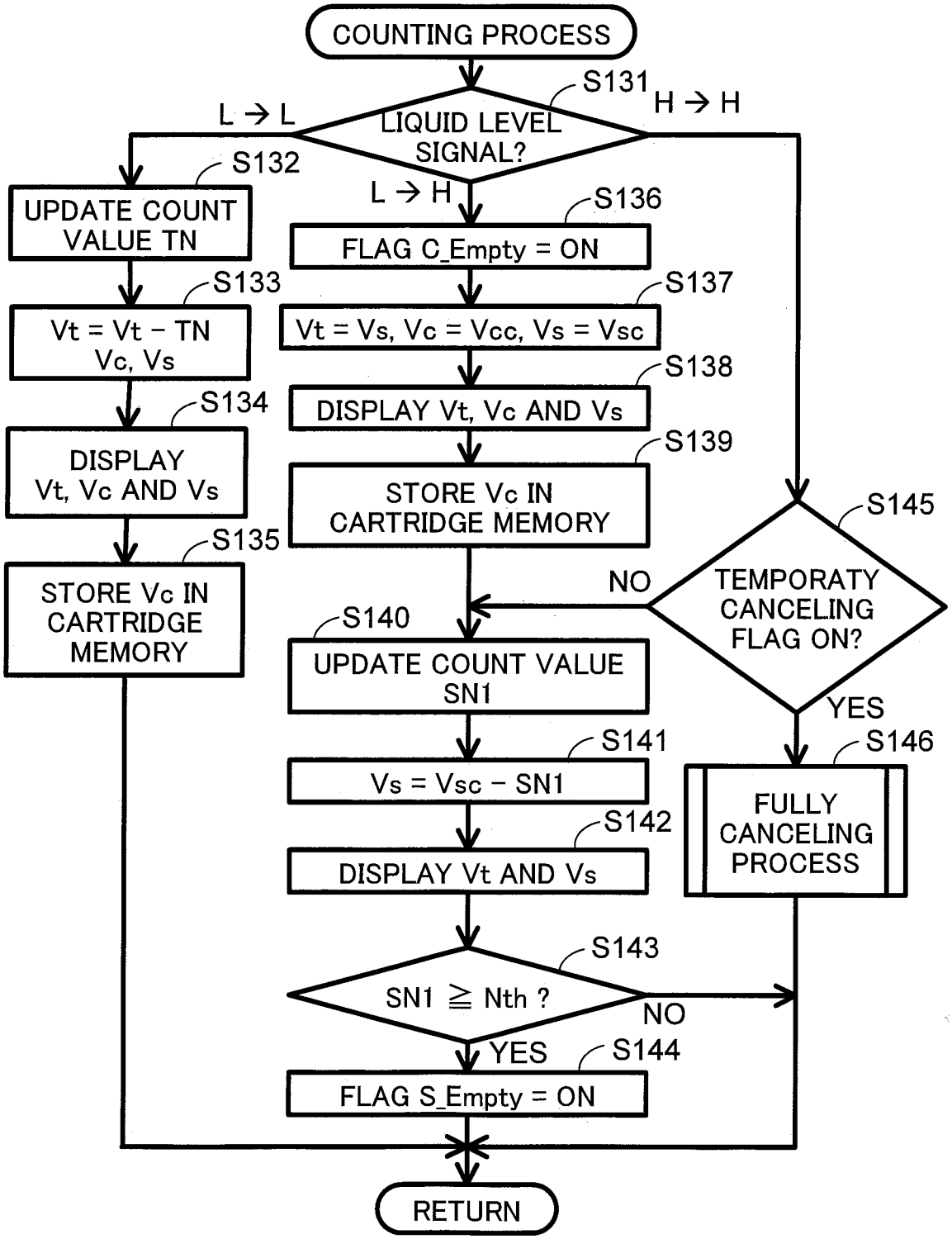
FIG. 23 is a flowchart of a counting process according to the second embodiment.

The counting process performed by the controller 230 in step S120 will be described in detail with reference to FIG. 23. The controller 230 performs the counting process independently for each of the four ink cartridges 50. The counting process is common to the ink cartridges 50. The counting process for one ink cartridge 50 will be described.

First, the controller 230 compares sets of information indicating the signals from the liquid level sensors 155 stored in the RAM 233 in steps S117 and S119 (S131). More specifically, the controller 230 determines whether the signal from each of the four liquid level sensors 155 has changed before and after the processing in step S118 immediately before the counting process (S120).

When the sets of information stored in the RAM 233 in steps S117 and S119 both indicate a low-level signal (S131: L→L) (in other words, the output of each liquid level sensor 155 remains unchanged before and after the processing in step S118), the controller 230 updates the count value TN (S132). More specifically, the controller 230 counts up the count value TN to a value equivalent to the amount of ink instructed to discharge in the immediately preceding step S118.

The controller 230 also calculates the current total amount Vt (S133). First, the controller 230 calculates the total amount Vt after the cartridge replacement that is the sum of the ink amount Vc and the ink amount Vs stored in the EEPROM 234 after the cartridge is replaced. The controller 230 then calculates the current total amount Vt by subtracting the ink amount equivalent to the count value TN from the calculated total amount Vt (Vt=Vt−TN). The controller 230 then obtains the ink amounts Vc and Vs based on the calculated current total amount Vt and the volume $V_{th}$ (S133).

The controller 230 then displays the obtained total amount Vt and one of the ink amount Vc and the ink amount Vs on the display 17 (S134). Further, the controller 230 overwrites the ink amount Vc stored in the memory of the IC chip 66 of the ink cartridge 50 with the obtained ink amount Vc (S135).

When the information stored in the RAM 233 in step S117 indicates a low-level signal and the information stored in the RAM 233 in step S119 indicates a high-level signal (S131: L→H) (in other words, the output of each liquid level sensor 155 is changed before and after the processing in step S118) (S136), the controller 230 substitutes the value indicating ON into the flag C_Empty. The output from the liquid level sensors 155 changing from a low-level signal to a high-level signal corresponds to the liquid level of the second reservoir 105 reaching the predetermined level B during the processing in step S118 as shown in FIG. 19A. Subsequently, no ink transfer occurs between the ink cartridge 50 and the subtank 100.

The controller 230 also reads a predetermined ink amount Vcc (=0) from the ROM 232, and sets the ink amount Vc to the predetermined ink amount Vcc (S137). Similarly, the controller 230 reads a predetermined ink amount Vsc (equivalent to the volume of a part of the second reservoir 105 lower than the predetermined level B) from the ROM 232, and sets the ink amount Vs to the predetermined ink amount Vsc (S137). The ink amounts Vc and Vs calculated in the residual amount updating process include errors. The controller 230 thus sets the ink amount Vc to the predetermined ink amount Vcc and the ink amount Vs to the predetermined ink amount Vsc at the time when the output from the liquid level sensor 155 changes from a low-level signal to a high-level signal, thus resetting the accumulated errors. Further, the controller 230 calculates the current total amount Vt as a value equal to the ink amount Vs (Vt=Vsc) (S137). When the ink amount Vc is zero, the total amount Vt has the same value as the ink amount Vs.

The controller 230 then displays the current total amount Vt and one of the ink amount Vc and the ink amount Vs on the display 17 (S138). The controller 230 also overwrites the ink amount Vc stored in the memory of the IC chip 66 of the ink cartridge 50 with the above ink amount Vc (S139).

The output of each liquid level sensor 155 changes during the processing in step S118, and thus the predetermined ink amount Vsc read in step S137 is not strictly the amount of ink stored in the subtank 100 at the moment when the output from the liquid level sensor 155 changes, but indicates the amount of ink immediately before the output from the liquid level sensor 155 changes. With the difference between the ink amounts being small, the ink amount Vsc read in step S137 is approximately the ink amount Vs at the time when the output from the liquid level sensor 155 changes.

The controller 230 also counts up the count value SN1 stored in EEPROM 234 to the value equivalent to the amount of ink instructed to discharge in the immediately preceding step S118 (S140). In other words, the controller 230 starts updating the count value SN1 in response to the output from the liquid level sensors 155 changing from a low-level signal to a high-level signal. The controller 230 counts up the count value TN stored in the EEPROM 234 to a value equivalent to the amount of ink instructed to discharge in the immediately preceding step S118.

The controller 230 then calculates the ink amount Vs (S141). The calculated ink amount Vs is obtained by subtracting the ink amount equivalent to the count value SN1 from the ink amount Vsc stored in the ROM 232. As described above, after the output from the liquid level sensor 155 changes to a high-level signal, the ink amount Vs is the same value as the current total amount Vt. The ink amount Vc is zero.

The controller 230 then displays one of the current total amount Vt and the ink amount Vs on the display 17 (S142). The ink amount Vc is zero after the output of liquid level sensor 155 changes to a high-level signal, and thus the controller 230 does not overwrite the ink amount Vc stored in the memory of the IC chip 66 of the ink cartridge 50.

The controller 230 then compares the count value SN1 updated in step S140 with the threshold value $N_{th}$ (S143). When determining that the count value SN1 updated in step S140 is smaller than the threshold value $N_{th}$ (S143: No), the controller 230 completes the counting process. In contrast, when determining that the count value SN1 updated in step S140 is equal to or greater than the threshold value $N_{th}$ (S143: Yes), the controller 230 substitutes the value indicating ON into the flag S_Empty (S144). The controller 230 disables the ink discharge through the recording head 39 in response to the flag S_Empty set ON, and completes the counting process.

When the sets of information stored in the RAM 233 in steps S117 and S119 both indicate a high-level signal (S131: H→H), the controller 230 determines whether the temporary canceling flag stored in the EEPROM 234 is ON (S145). When the temporary canceling flag is ON (S145: No), the controller 230 reads the count value SN1 stored in the EEPROM 234. The controller 230 then counts up the read count value SN1 to a value equivalent to the amount of ink instructed to discharge in the immediately preceding step S118 and stores the value into the EEPROM 234 again. More specifically, the controller 230 updates the count value SN1 (S140). The controller 230 also updates the count value TN. The controller 230 then performs the processing from steps S141 to S144 described above using the count value SN1 updated in step S140.

When the temporary canceling flag is ON (S145: Yes), the controller 230 performs the empty-state fully canceling process (S146). The empty-state fully canceling process will be described in detail below with reference to FIG. 25.

Empty-State Temporary Canceling Process

Figure 24:
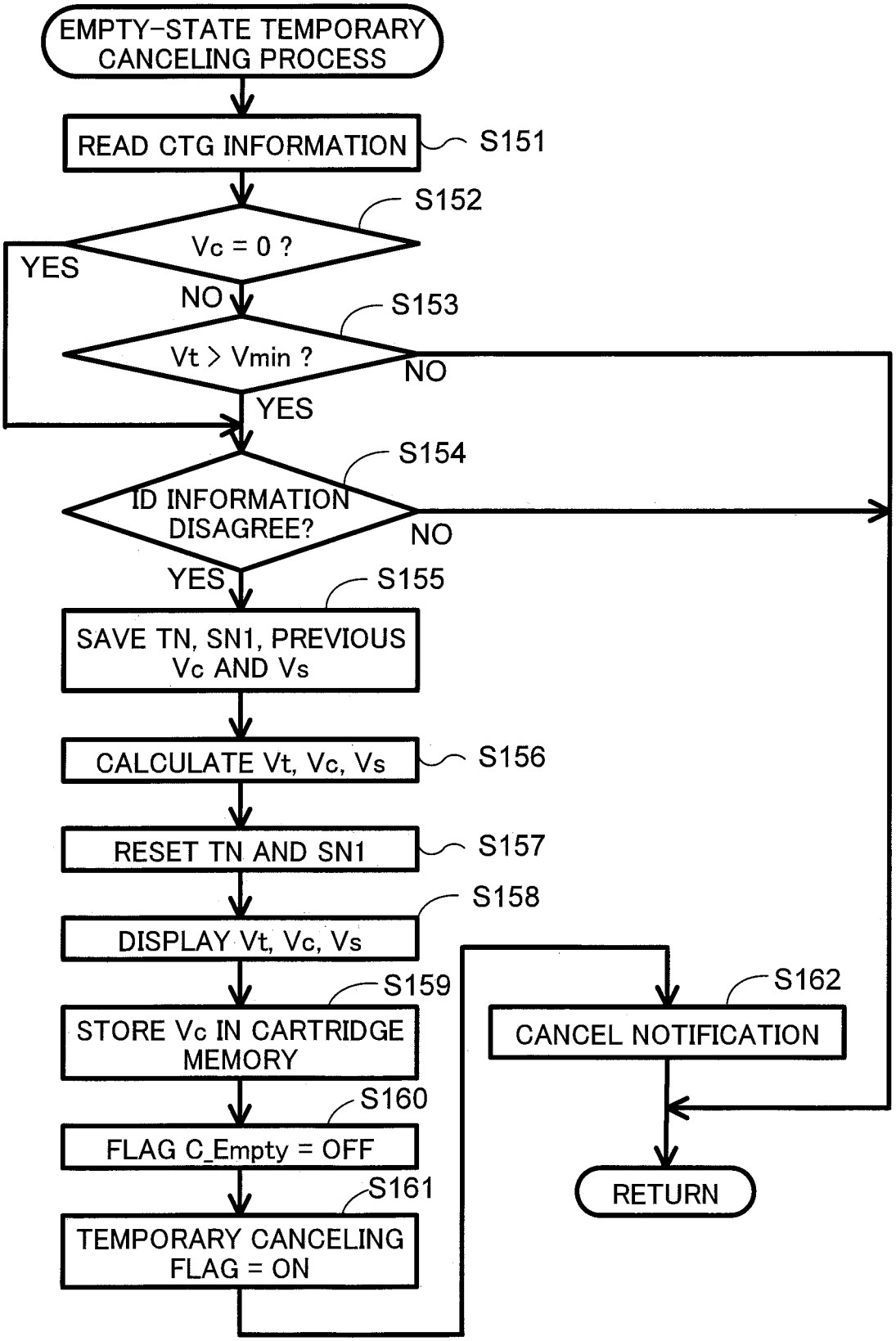
FIG. 24 is a flowchart of an empty-state temporary canceling process according to the second embodiment.

With reference to FIG. 24, the empty-state temporary canceling process performed by the controller 230 in step S116 will be described in detail. The controller 230 performs the empty-state temporary canceling process independently for each of the four ink cartridges 50. The empty-state temporary canceling process is common to the ink cartridges 50. The empty-state temporary canceling process for one ink cartridge 50 will be described.

In the counting process, when determining that the signal of the liquid level sensor 155 changes from a low-level signal to a high-level signal (S131: L→H), the controller 230 substitutes the value indicating ON into the flag C_Empty (S136). In the image recording process, when determining that the flag C_Empty is set ON (S111: ON), the controller 230 displays the notification screen C_Empty on the display 17 (S112).

In the above state (or the state of the controller 230 displaying the notification screen C_Empty on the display 17), the ink cartridge 50 is in the state of no ink flowing toward the subtank 100, or in the state of the ink amount Vc being zero (Vc=0). Also, the liquid level of the ink in the subtank 100 is lower than the predetermined level B. The user is thus to replace the empty ink cartridge 50 with a fresh ink cartridge 50 or with an ink cartridge 50 storing a sufficient amount of ink before the empty ink state shown in FIG. 19B is entered.

In the process of replacing the ink cartridge 50 by the user, the controller 230 obtains a low-level signal from the installation sensor 154, then obtains a high-level signal from the installation sensor 154, and further obtains a low-level signal from the installation sensor 154 (S114: Yes). More specifically, in the process of removing the ink cartridge 50 from the installation case 71, the controller 230 obtains a low-level signal from the installation sensor 154 and then obtains a high-level signal from the installation sensor 154. In the subsequent process of inserting the ink cartridge 50 into the installation case 71, the controller obtains a high-level signal from the installation sensor 154 and then obtains a low-level signal from the installation sensor 154.

In the empty-state temporary canceling process, the controller 230 reads CTG information from the memory of the IC chip 66 through the contact 152 and stores the read CTG information into the EEPROM 234 (S151). When the ink cartridge 50 is replaced with a fresh ink cartridge 50, an initial ink amount Vc0 is read as the ink amount Vc from the memory of the IC chip 66. The identification information is also read from the memory of the IC chip 66.

When determining that the initial ink amount Vc0 is read (S152: Yes), the controller 230 does not perform the processing in step S153 (described later) and performs the processing in step S154 (described later). When determining that the initial ink amount Vc0 is not read (S152: No), the controller 230 performs the processing in step S153 (described later). When the initial ink amount Vc0 is not read, the ink amount Vc read from the memory of the IC chip 66 is not the initial ink amount Vc0 but is a value smaller than the initial ink amount Vc0.

The controller 230 compares a total amount Vt obtained by adding the ink amount Vc read from the memory of the IC chip 66 to the ink amount Vs read from the EEPROM 234 with the threshold value Vmin (S153). The threshold value Vmin is equivalent to the total amount when the liquid level reaches the predetermined level B in the second reservoir 105 of the subtank 100. When the calculated total amount Vt is equal to or greater than the threshold value Vmin (S153: Yes), the ink is transferred from the first reservoir 53 of the ink cartridge 50 to the second reservoir 105 of the subtank 100, and the liquid level of the ink in the second reservoir 105 reaches the predetermined level B or higher. In contrast, when the calculated total amount Vt is smaller than the threshold value Vmin (S153: No), the controller 230 completes the empty-state temporary canceling process.

When the calculated total amount Vt is smaller than the threshold value Vmin, the liquid level of the ink in the second reservoir 105 does not reach the predetermined level B or higher despite any ink transfer from the first reservoir 53 of the ink cartridge 50 to the second reservoir 105 of the subtank 100. Thus, the controller 230 maintains the state of the notification screen C_Empty appearing on the display 17.

When determining that the calculated total amount Vt is equal to or greater than the threshold value Vmin (S153: Yes), the controller 230 compares the identification information read from the memory of the IC chip 66 with the identification information read from the memory of the IC chip 66 of the ink cartridge 50 yet to be replaced (S154). The identification information read from the memory of the IC chip 66 of the ink cartridge 50 yet to be replaced is stored in the EEPROM 234. For example, with the ink cartridge 50 replaced with a fresh ink cartridge 50, the compared two sets of identification information disagree with each other. The identification information is, for example, the serial number of the ink cartridge 50.

When determining that the compared two sets of identification information agree with each other (S154: No), the controller 230 completes the empty-state temporary canceling process. When the ink cartridge 50 having the ink used up to have the ink amount Vc of zero in the first reservoir 53 is installed in the installation case 71 again, no ink is transferred from the first reservoir 53 of the ink cartridge 50 to the second reservoir 105 of the subtank 100, and thus the empty state C_Empty is not to be canceled temporarily.

When determining that the compared two sets of identification information disagree with each other (S154: Yes), the controller 230 stores the count values TN and SN1, the ink amount Vc, and the ink amount Vs stored in the EEPROM 234 into another storage area of the EEPROM 234 (S155). The count values TN and SN1, the ink amount Vc, and the ink amount Vs stored in the other storage area of the EEPROM 234 are used when C_Empty is not fully canceled after the empty state C_Empty is temporarily canceled as described later.

The controller 230 calculates the total amount Vt after the cartridge replacement (S156). In detail, the controller 230 calculates the ink amount Vs before the cartridge replacement (equal to the total amount Vt) based on the count value SN1 before the cartridge replacement stored in the EEPROM 234 and the ink amount Vsc stored in the ROM 232, and stores the ink amount into the EEPROM 234. Based on the calculated ink amount Vs and the ink amount Vc read from the memory of the IC chip 66 of the replaced ink cartridge 50, the total amount Vt after the cartridge replacement is calculated. More specifically, the ink amount Vc stored in the first reservoir 53 of the fresh ink cartridge 50 is added to the ink amount Vs stored in the second reservoir 105 of the subtank 100 immediately before the ink cartridge 50 is replaced. The controller 230 thus calculates the sum of the ink amount Vc read from the memory of the IC chip 66 of the replaced ink cartridge 50 and the ink amount Vs before the cartridge replacement stored in the EEPROM 234 as the total amount Vt (Vt=Vs+Vc).

The controller 230 calculates the ink amount Vc and the ink amount Vs obtained when ink transfer from the first reservoir 53 to the second reservoir 105 is complete based on the calculated total amount Vt and the volume $V_{th}$ read from the EEPROM 234 (S156). When the ink cartridge 50 is replaced, the ink stored in the first reservoir 53 of the newly installed ink cartridge 50 flows into the second reservoir 105 of the subtank 100 through the liquid flow path 103. As a result, the ink amount Vc of the first reservoir 53 decreases, and the ink amount Vs of the second reservoir 105 increases. The liquid level of the ink in the second reservoir 105 of the subtank 100 then reaches the imaginary line L, and the equilibrium state is entered.

The controller 230 resets the count values TN and SN1 stored in the EEPROM 234 after performing the processing in step S156 (S157). This sets the count values TN and SN1 to their initial values (zero).

The controller 230 displays the obtained total amount Vt and one of the ink amount Vc and the ink amount Vs on the display 17 (S158). The controller 230 stores the calculated ink amount Vc into the memory of the IC chip 66 through the contact 152 (S159). When the initial ink amount Vc0 is stored in the memory of the IC chip 66, the controller 230 overwrites the initial ink amount Vc0 with the calculated ink amount Vc (an example of a second value). With the ink amount Vc0 overwritten with another ink amount Vc in the memory of the IC chip 66, the ink cartridge 50 is determined not to be a fresh ink cartridge. In the manufacturing processes, a flag indicating that the ink cartridge 50 is a fresh ink cartridge may be set ON in the memory of the IC chip 66. Once the ink cartridge 50 is installed in the installation case 71, the controller 230 may substitute the value indicating OFF into the flag. The controller 230 can thus determine whether the ink cartridge 50 is a fresh ink cartridge based on the value of the flag.

The controller 230 substitutes the value indicating OFF into the flag C_Empty (S160). The controller 230 substitutes the value indicating ON into the temporary canceling flag (S161). The controller 230 deletes the notification screen C_Empty from the display 17 (S162), and completes the empty-state temporary canceling process.

Empty-State Fully Canceling Process

Figure 25:
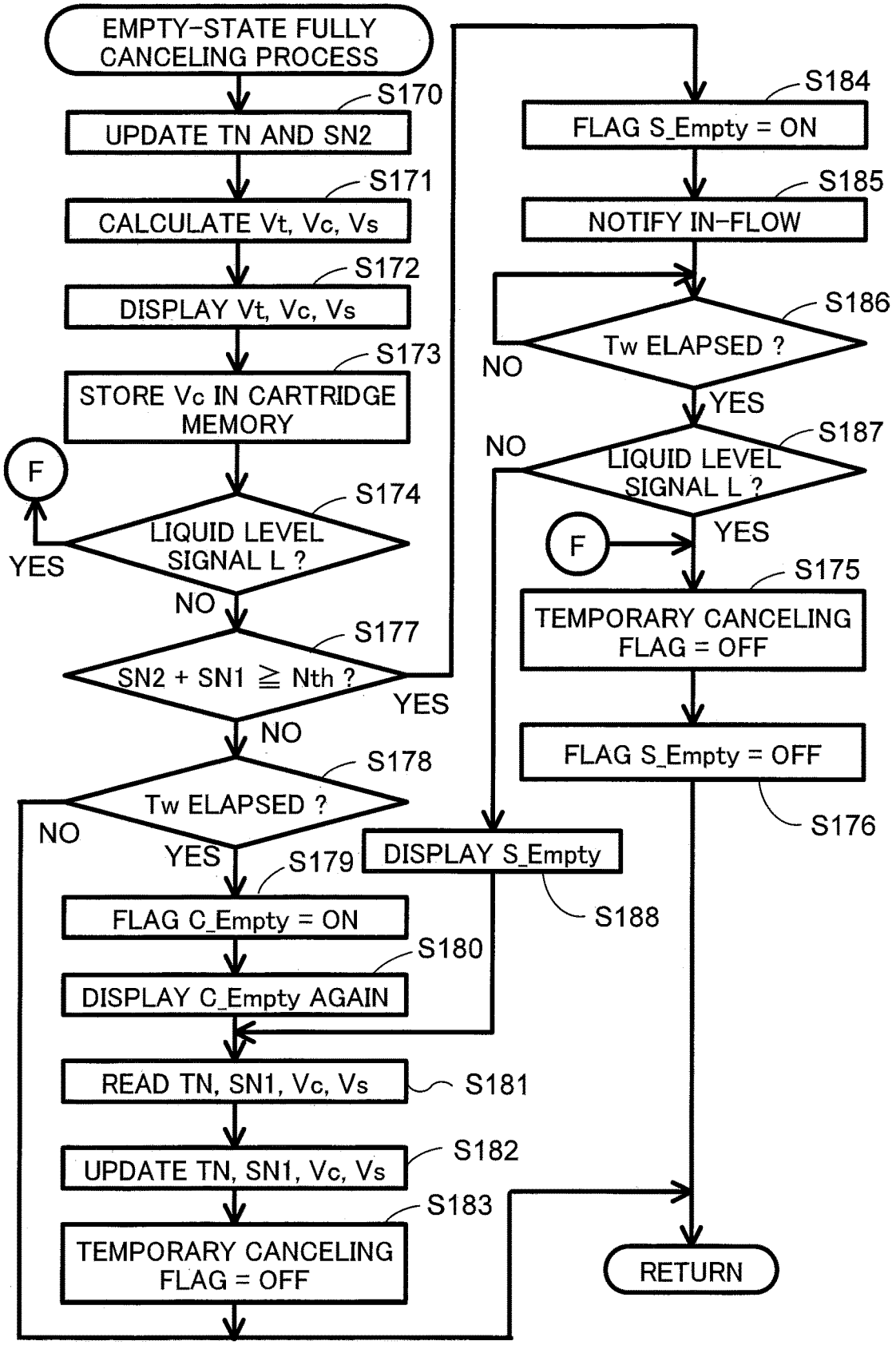
FIG. 25 is a flowchart of an empty-state fully canceling process according to the second embodiment.

With reference to FIG. 25, the empty-state fully canceling process performed by the controller 230 in step S146 will be described in detail. The controller 230 performs the empty-state fully canceling process independently for each of the four ink cartridges 50. The empty-state fully canceling process is common to the ink cartridges 50. The empty-state canceling process for one ink cartridge 50 will be described.

When determining that the temporary canceling flag is ON in the counting process (S145: Yes), the controller 230 performs the empty-state fully canceling process. At this time, the flag C_Empty is OFF, and the notification screen C_Empty is not on the display 17.

As shown in FIG. 20, when the temporary canceling flag is ON, the ink is transferred from the first reservoir 53 of the ink cartridge 50 to the second reservoir 105 of the subtank 100, and the liquid level of the ink in the second reservoir 105 is lower than the predetermined level B. When the processing in step S118 is performed in this state, the controller 230 counts up the count value SN2 stored in the EEPROM 234 to a value equivalent to the amount of ink instructed to discharge in the immediately preceding step S118 (S170). In other words, the controller 230 starts updating the count value SN2 in response to the temporary canceling flag set ON. The controller 230 counts up the count value TN stored in the EEPROM 234 to a value equivalent to the amount of ink instructed to discharge in the immediately preceding step S118.

The controller 230 then calculates the current total amount Vt (S171). The current total amount Vt is obtained by subtracting the ink amount equivalent to the count value TN from the sum of the ink amount Vc and the ink amount Vs stored in the EEPROM 234. The controller 230 obtains the ink amounts Vc and Vs based on the calculated current total amount Vt and the volume $V_{th}$ (S171).

The controller 230 then displays the obtained total amount Vt and one of the ink amount Vc and the ink amount Vs on the display 17 (S172). Further, the controller 230 overwrites the ink amount Vc stored in the memory of the IC chip 66 of the ink cartridge 50 with the obtained ink amount Vc (S173).

The controller 230 then determines whether the output from the liquid level sensor 155 is a low-level signal (S174). When determining that the output from the liquid level sensor 155 is a low-level signal (S174: Yes), the controller 230 substitutes the value indicating OFF into each of the temporary canceling flag and the flag S_Empty (S175 and S176).

When determining that the output from the liquid level sensor 155 is not a low-level signal but is a high-level signal (S174: No), the controller 230 compares the sum of the count value SN2 updated in step S170 and the count value SN1 stored in the other area of the EEPROM 234 with the threshold value $N_{th}$ (S177). The sum of the count value SN2 and the count value SN1 is an example of a third count value.

When determining that the sum of the count value SN2 and the count value SN1 updated in step S170 is smaller than the threshold value $N_{th}$ (S177: No), the controller 230 determines whether a wait time Tw has elapsed from the time stored in the EEPROM 234 in the image recording process (the time when the low-level signal is obtained after the high-level signal is obtained from the installation sensor) (S178). The wait time Tw is set by a wait time Tw setting process described later. The wait time Tw is an example of a first elapsed time.

When determining that the wait time Tw has not elapsed from the time stored in the EEPROM 234 (S178: No), the controller 230 completes the empty-state fully canceling process.

When determining that the wait time Tw has elapsed from the time stored in the EEPROM 234 (S178: Yes), the controller 230 substitutes the value indicating ON into the flag C_Empty (S179). The controller 230 then displays the notification screen C_Empty on the display 17 in response to the flag C_Empty set ON (S180).

In the empty-state temporary canceling state, the total amount Vt that is the sum of the ink amount Vc read from the memory of the IC chip 66 of the replaced ink cartridge 50 and the ink amount Vs of the second reservoir 105 of the subtank 100 is equal to or greater than the threshold value Vmin. However, when the ink amount Vc stored in the memory of the IC chip 66 is larger than the amount of ink substantially stored in the ink cartridge 50 or the ink transfer from the ink cartridge 50 to the subtank 100 is disabled, the liquid level of the ink is not raised to the predetermined level B in the second reservoir 105 of the subtank 100. In this case, the user may be urged to replace the ink cartridge 50 again with a fresh ink cartridge 50 or with an ink cartridge 50 storing a sufficient amount of ink, and the ink discharge through the recording head 39 is to be disabled until the ink cartridge 50 is replaced again.

The controller 230 reads the count values TN and SN1, the ink amount Vc, and the ink amount Vs stored in the other area of the EEPROM 234 (S181) and updates the count values TN and SN1, the ink amount Vc, and the ink amount Vs currently stored in the EEPROM 234 to the read values (S182). More specifically, the count value SN2 is added to each of the count values TN and SN1 stored in the other area of the EEPROM 234, and the count values TN and SN1 stored in the EEPROM 234 are updated to the resultant values. In addition, the controller updates the ink amount Vs by subtracting the value equivalent to the updated count value SN1 from the Vsc stored in the ROM 232. The controller 230 updates the ink amount Vc to zero. Further, the controller 230 substitutes the value indicating OFF into the temporary canceling flag (S183), and completes the empty-state fully canceling process. This ends the empty-state temporary canceling state, and the empty ink state is entered. The updated count value SN1 corresponds to a third count value.

When determining that the sum of the count value SN2 and the count value SN1 updated in step S170 is equal to or greater than the threshold value $N_{th}$, (S177: Yes), the controller 230 substitutes the value indicating ON into the flag S_Empty (S184). The sum of the count value SN2 and the count value SN1 equal to or greater than the threshold value $N_{th}$ indicates that the liquid level of the ink in the second reservoir 105 of the subtank 100 has reached the position immediately above the communication port 129.

The controller 230 displays a screen for notifying that the ink is flowing into the subtank 100 from the ink cartridge 50 on the display 17 (S185). The controller 230 determines whether the wait time Tw has elapsed from the time stored in the EEPROM 234 (S186). When determining that the wait time Tw has not elapsed from the time stored in the EEPROM 234 (S186: No), the controller 230 continuously displays the above screen on the display 17. More specifically, until the wait time Tw elapses from the time stored in the EEPROM 234, image recording performed in the next step S118 is suspended. The operation performed by the display 17 in step S186 is an example of a second operation.

When determining that the wait time Tw has elapsed from the time stored in the EEPROM 234 (S186: Yes), the controller 230 determines whether the signal output from the liquid level sensor 155 is a low-level signal (S187). When determining that the signal output from the liquid level sensor 155 is a low-level signal (S187: Yes), the controller 230 performs the processing from steps S175 to S176 described above, and completes the empty-state fully canceling process. The signal output from the liquid level sensor 155 being the low-level signal indicates that the ink is transferred from the ink cartridge 50 to the subtank 100, and the liquid level of the ink in the second reservoir 105 reaches the predetermined level B before the wait time Tw elapses from the time stored in the EEPROM 234. This ends the empty-state temporary canceling state. In the next step S118, the suspended image recording is resumed. The controller 230 may continue to determine whether the signal output from the liquid level sensor 155 is a low-level signal until the wait time Tw elapses, instead of determining whether the signal output from the liquid level sensor 155 is a low-level signal after the wait time Tw elapses from the time stored in the EEPROM 234.

In contrast, when determining that the signal output from the liquid level sensor 155 is not a low-level signal but is a high-level signal (S187: No), the controller 230 displays the notification screen S_Empty instead of an in-flow notification screen on the display 17 (S188). Then, the processing in steps S181 to S183 described above is performed, and the empty-state fully canceling process is complete. This ends the empty-state temporary canceling state, and the empty ink state is entered.

When determining that the flag S_Empty is ON in step S115 in the image recording process (S115: Yes), the controller 230 performs the process shown in FIG. 26. As described above, when the ink amount Vc stored in the memory of the IC chip 66 is larger than the amount of ink substantially stored in the ink cartridge 50 or the ink transfer from the ink cartridge 50 to the subtank 100 is disabled, the liquid level of the ink in the second reservoir 105 of the subtank 100 is not raised to the predetermined level B. In this case, the ink cartridge 50 is to be replaced again with a fresh ink cartridge 50 or with an ink cartridge 50 storing a sufficient amount of ink.

However, in the state of the flag S_Empty being ON, the sum of the count value SN2 and the count value SN1 updated in step S170 is already equal to or greater than the threshold value $N_{th}$. Thus, although the ink cartridge 50 is replaced again, image recording performed in the empty-state temporary canceling state may cause air entrapment described above. When determining that the flag S_Empty is ON (S115: Yes), the controller 230 does not perform the empty-state temporary canceling process.

Figure 26:
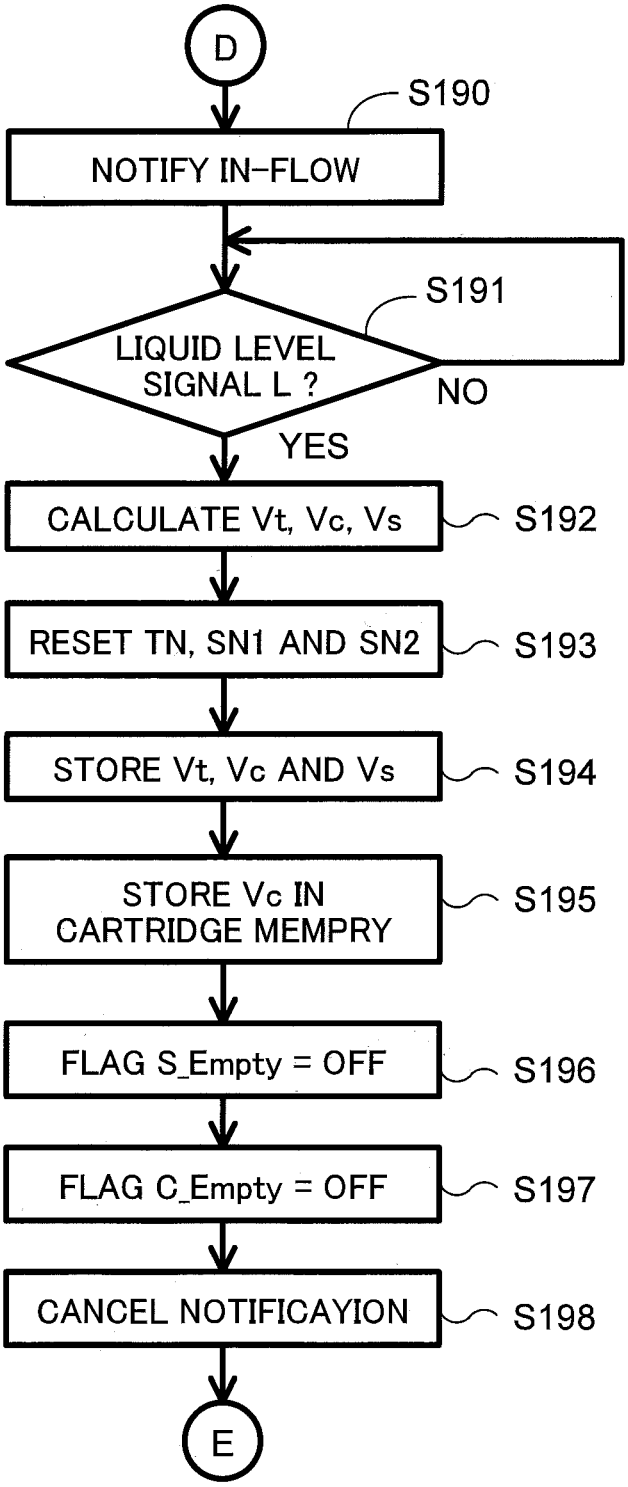
FIG. 26 is a flowchart of a part of the image recording process according to the second embodiment.

As shown in FIG. 26, when determining that the flag S_Empty is ON (S115: Yes), the controller 230 displays the screen notifying that the ink is flowing into the subtank 100 from the ink cartridge 50 on the display 17 (S190).

The controller 230 determines whether the signal output from the liquid level sensor 155 is a low-level signal (S191). When determining that the signal output from the liquid level sensor 155 is not a low-level signal but is a high-level signal (S191: No), the controller 230 repeatedly performs the processing in step S191 until the signal output from the liquid level sensor 155 changes to a low-level signal.

When determining that the signal output from the liquid level sensor 155 is a low-level signal (S191: Yes), the controller 230 calculates the ink amount Vs before the cartridge replacement (equal to the total amount Vt) based on the count value SN before the cartridge replacement stored in the EEPROM 234 and the ink amount Vsc stored in the ROM 232, and stores the calculated value into the EEPROM 234. Based on the calculated ink amount Vs and the ink amount Vc read from the memory of the IC chip 66 of the replaced ink cartridge 50, the total amount Vt after the cartridge replacement is calculated (S192: Vt=Vs+Vc).

The controller 230 calculates the ink amount Vc and the ink amount Vs when ink transfer from the first reservoir 53 to the second reservoir 105 is complete based on the calculated total amount Vt and the volume $V_{th}$ read from the EEPROM 234 (S192).

The controller 230 resets the count values TN, SN1, and SN2 stored in the EEPROM 234 (S193). This sets the count values TN, SN1, and SN2 to their initial values (zero).

The controller 230 displays the obtained total amount Vt and one of the ink amount Vc and the ink amount Vs on the display 17 (S194). The controller 230 stores the calculated ink amount Vc into the memory of the IC chip 66 through the contact 152 (S195).

The controller 230 substitutes the value indicating OFF into each of the flag S_Empty and the flag C_Empty (S196 and S197). The controller 230 deletes the in-flow notification screen from the display 17 (S198) and returns to the processing in step S117 in response to the flag S_Empty set OFF.

Wait Time Tw Setting Process

Figure 27:
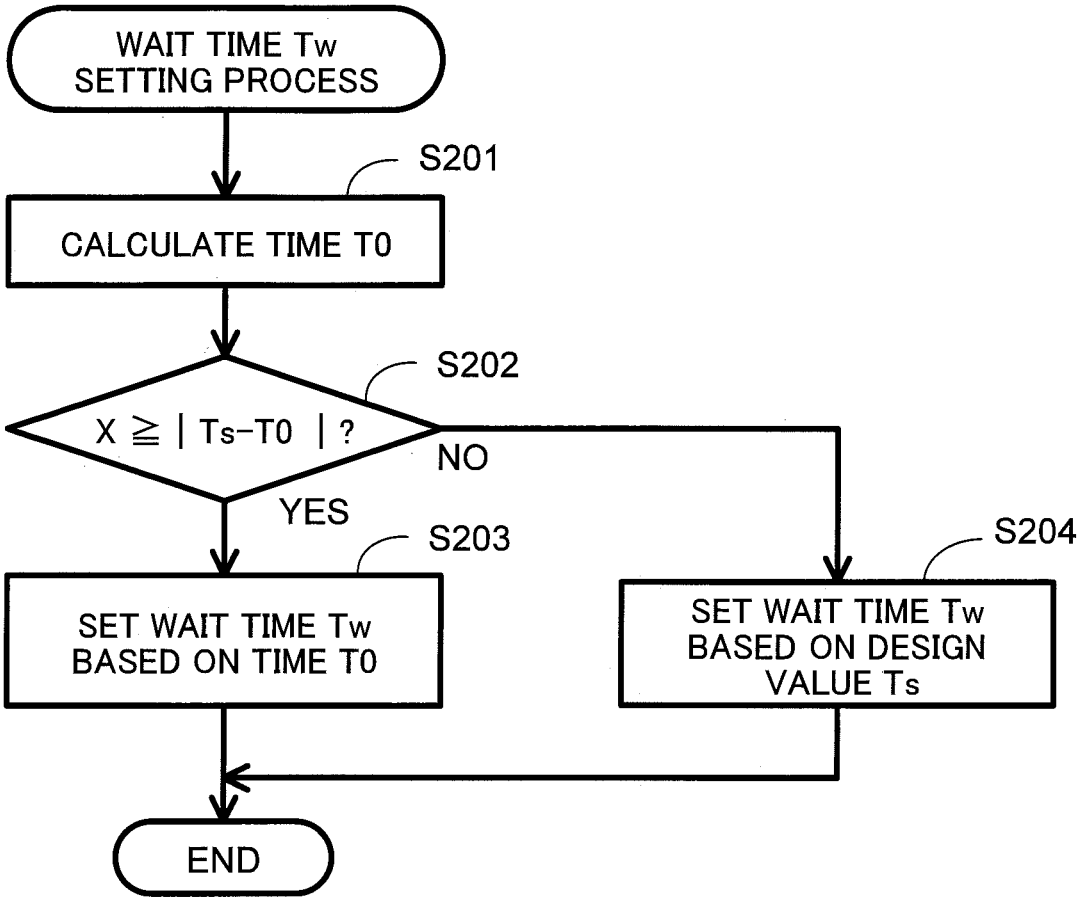
FIG. 27 is a flowchart of a wait time Tw setting process according to the second embodiment.

With reference to FIG. 27, the wait time Tw setting process performed by the controller 230 will be described in detail. The controller 230 performs the wait time Tw setting process independently for each of the four ink cartridges 50. The wait time Tw setting process is common to the ink cartridges 50. The wait time Tw setting process for one ink cartridge 50 will be described.

The controller 230 performs the wait time Tw setting process when the ink cartridge 50 is installed firstly in the installation case 71 of the multifunction peripheral 10. The controller 230 determines whether the ink cartridge 50 is installed firstly in the installation case 71 based on, for example, identification information read from the IC chip 66 of the installed ink cartridge 50 indicating that the cartridge has been packaged with the multifunction peripheral 10, or a flag indicating an initial ink loading operation not stored in the EEPROM 234. The determination causes the time to be measured from when the ink flows into the second reservoir 105 of the subtank 100 in the empty state to when the liquid level of the ink reaches the predetermined level B.

As shown in FIG. 27, the controller 230 stores, into the EEPROM 234, the time when the ink cartridge 50 is installed firstly in the installation case 71, or in other words, the time when a high-level signal is obtained from the installation sensor 154 and then a low-level signal is further obtained from the installation sensor 154. The controller 230 then calculates, in response to the signal received from the liquid level sensor 155 changing from a high level to a low level, a time T0 from the time stored in the EEPROM 234 to when the signal from the liquid level sensor 155 changes (S201). The time T0 is an example of a second elapsed time.

When a fresh ink cartridge 50 is installed in the installation case 71, the ink flows from the first reservoir 53 into the second reservoir 105. The liquid level of the ink in the second reservoir 105 then reaches the predetermined level B over time, and thus the liquid level sensor 155 outputs a low-level signal.

Subsequently, the controller 230 calculates a difference between the calculated time T0 and the design value Ts prestored in the EEPROM 234 (|Ts−T0|), and determines whether the calculated difference is within the threshold value range X (S202: X≥|Ts−T0|). When the calculated difference is within the threshold value range X (S202: Yes), the controller 230 stores, into the EEPROM 234, the time T0 or the time obtained by adding or subtracting a predetermined time to or from the time T0 as the wait time Tw (S203). When the calculated difference is out of the threshold value range X (S202: No), the controller 230 stores, into the EEPROM 234, the design value Ts or the time obtained by adding or subtracting a predetermined time to or from the design value Ts as the wait time Tw (S204).

Operational Effects of Second Embodiment

The structure according to the second embodiment can delete the notification screen C_Empty from the display 17 in the cartridge empty state of the notification screen C_Empty appearing on the display 17 after the ink cartridge 50 is replaced and before the liquid level sensor 155 outputs a low-level signal. When the elapsed time from the replacement of the ink cartridge 50 reaches the wait time Tw after the notification screen C_Empty is deleted from the display 17, the notification screen C_Empty appears on the display 17. Thus, if the liquid level of the ink in the second reservoir 105 of the subtank 100 is not equal to or higher than the predetermined level B after the ink cartridge 50 is replaced, the user can be urged to replace the ink cartridge 50 again through the notification.

Further, when the ink cartridge 50 installed in the installation case 71 does not store an amount of ink in the first reservoir 53 sufficient to cause the liquid level of the ink in the second reservoir 105 of the subtank 100 to reach the predetermined level B or higher, the notification screen C_Empty is not deleted from the display 17.

The wait time Tw is set in accordance with the time T0 from when the ink flows from the first reservoir 53 of the ink cartridge 50 installed firstly in the installation case 71 to the second reservoir 105 of the subtank 100 to when the controller 230 receives a low-level signal from the liquid level sensor 155, and thus can be set in accordance with differences between individual devices.

When the elapsed time from the replacement of the ink cartridge 50 reaches the wait time Tw and the notification screen C_Empty appears on the display 17 after the notification screen C_Empty is deleted from the display 17, the count value SN1 used before the notification screen C_Empty is deleted from the display 17 is added to the count value SN2 and updated after the notification screen C_Empty appears on the display 17.

When the sum of the count value SN2 and the count value SN1 reaches the threshold value $N_{th}$ after the cartridge empty state is canceled, the image recording is suspended and thus the controller 230 can regulate the amount of ink discharged through the recording head 39 before receiving a low-level signal from the liquid level sensor 155. This prevents air from the second reservoir 105 from entering the recording head 39. Thereafter, when a low-level signal is received from the liquid level sensor 155, the image recording is resumed.

When the image recording is suspended, a screen notifying that the ink is flowing into the subtank 100 from the ink cartridge 50 appears on the display 17. The user can thus be notified whether to replace the ink cartridge 50 or to wait.

When the ink cartridge 50 installed in the installation case 71 again has the ink in the first reservoir 53 used up and needs replacement, the notification screen C_Empty is not deleted from the display 17.

When the temporary canceling state is entered or the temporary canceling flag is ON, the controller 230 substitutes the value indicating OFF into the temporary canceling flag in response to a low-level signal from the liquid level sensor 155. Thus, when the liquid level of the second reservoir 105 is substantially equal to or higher than the predetermined level B after the cartridge is replaced, the temporary canceling state is canceled. The controller also substitutes the value indicating OFF into the non-residual ink flag as well when the liquid level of the second reservoir 105 is substantially equal to or higher than the predetermined level B after the cartridge is replaced. This prevents air entrapment described above.

Modifications of Second Embodiment

The empty-state temporary canceling process in the second embodiment includes the determination (S152) as to whether the ink cartridge 50 installed in the installation case 71 stores the initial ink amount Vc0, or in other words, as to whether the ink cartridge 50 is a fresh ink cartridge 50, or the determination (S153) as to whether the total amount Vt that is the sum of the ink amount Vc of the first reservoir 53 and the ink amount Vs of the second reservoir 105 is equal to or greater than the threshold value Vmin when the ink cartridge 50 installed in the installation case 71 is not a fresh ink cartridge. However, the processing in steps S152 to S155 may not be performed. More specifically, the controller 230 may temporarily cancel the empty ink state in response to the ink cartridge 50 installed in the installation case 71. Either the processing in step S152 or S153 may be performed selectively. The processing in step S154 may be performed without performing the processing in steps S152 and S153, or may be performed with either step S152 or S153.

In the second embodiment, the flag C_Empty is set ON in response to the output from the liquid level sensor 155 changing from a low-level signal to a high-level signal, and the notification screen C_Empty appears on the display 17. In some embodiments, the flag C_Empty may be set ON in response to the count value SN1 reaching a predetermined threshold after the output from the liquid level sensor 155 changes from a low-level signal to a high-level signal, and the notification screen C_Empty may appear on the display 17.

In the second embodiment, the cartridge empty state is temporarily canceled when the ink cartridge 50 is replaced and then a low-level signal is received from the installation sensor 154. However, the empty ink state, instead of the cartridge empty state, may be temporarily canceled in response to a low-level signal received from the installation sensor 154. More specifically, when the flag S_Empty is ON, the controller 230 performs the empty-state temporary canceling process in response to a low-level signal received from the installation sensor 154, and substitutes the value indicating OFF into the flag S_Empty. Through this process, the notification screen S_Empty is deleted from the display 17 after the cartridge is replaced and before the liquid level sensor 155 outputs a low-level signal.

When the flag S_Empty is ON, the controller 230 may set the flag S_Empty OFF and delete the notification screen S_Empty from the display 17 in response to a low-level signal from the installation sensor 154, or by determining that the ink cartridge 50 installed in the installation case 71 stores the initial ink amount Vc0 or that the total amount Vt that is the sum of the ink amount Vc of the first reservoir 53 and the ink amount Vs of the second reservoir 105 is equal to or greater than the threshold value Vmin although the ink cartridge 50 installed in the installation case 71 is not a fresh ink cartridge. When the flag S_Empty is ON, the controller 230 may not provide a notification but may disable ink discharge. When the flag S_Empty is OFF, the controller may enable the ink discharge. Further, the controller 230 may both provide a notification and disable ink discharge.

In the second embodiment, the controller 230 stores the total amount Vt after replacement of the ink cartridge 50 into the EEPROM 234, and obtains the current total amount Vt by subtracting the ink amount equivalent to the count value TN from the total amount Vt. In some embodiments, the total amount Vt is updated and stored into the EEPROM 234 every time when the ink is discharged through the recording head 39. When the ink discharge through the recording head 39 is performed subsequently, the same ink amount as the discharged amount may be calculated based on the count value TN, and subtracted from the total amount Vt stored in the EEPROM 234 to update the total amount Vt.

In the second embodiment, the ink discharge through the recording head 39 refers to image recording on a sheet. However, the ink discharge through the recording head 39 may be a purge for forcibly discharging the ink through the nozzles 40 of the recording head 39.

In the image recording process according to the second embodiment, the operations in steps S111 to S117 excluding the image recording operation, or the operations in step S118 and subsequent steps, may be performed when the cover 48 is closed or when the power of the printer is turned on.

The value indicating OFF may be substituted into the temporary canceling flag in response to a low-level signal received from the liquid level sensor 155 in a step other than step S175 or S183. For example, the value indicating OFF may be substituted into the temporary canceling flag in step S117 in response to a low-level signal received from the liquid level sensor 155.

Third Embodiment

A third embodiment will now be described. The structure of a multifunction peripheral 10 according to the third embodiment is the same as in the first embodiment, and will not be described in detail. Additionally, an image recording process (FIGS. 14 and 18), a counting process (FIG. 15), and an empty-state fully canceling process (FIG. 17) in the operation of the multifunction peripheral 10 are also the same as in the first embodiment. The empty-state temporary canceling process according to the third embodiment will now be described.

Empty-State Temporary Canceling Process

Figure 28:
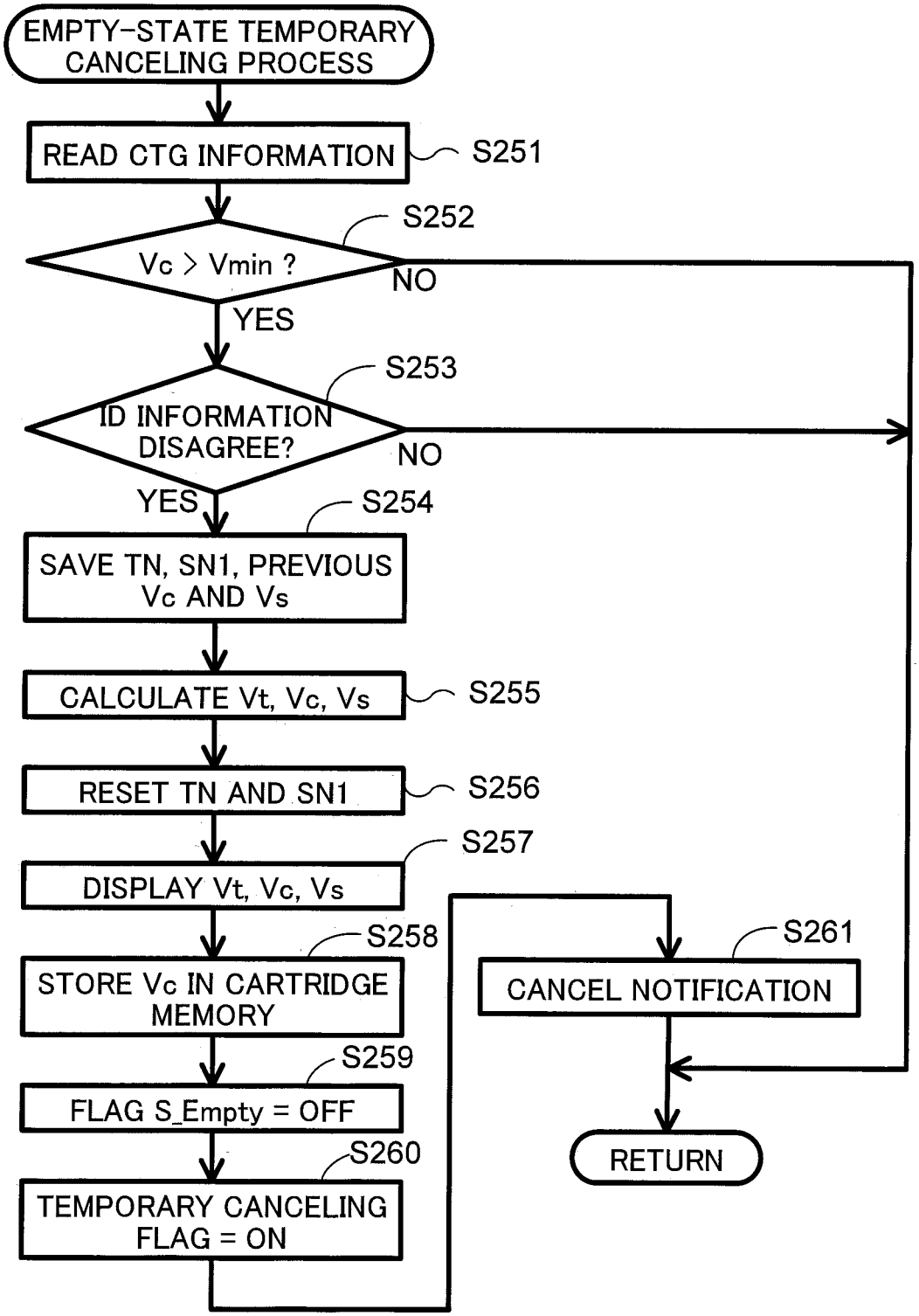
FIG. 28 is a flowchart of an empty-state temporary canceling process according to a third embodiment.

With reference to FIG. 28, the empty-state temporary canceling process performed by the controller 230 in step S16 will be described in detail. The controller 230 performs the empty-state temporary canceling process independently for each of the four ink cartridges 50. The empty-state temporary canceling process is common to the ink cartridges 50. The empty-state temporary canceling process for one ink cartridge 50 will be described.

In the counting process, when determining that the count value SN1 is equal to or greater than the threshold value $N_{th1}$ (S43: Yes), the controller 230 substitutes the value indicating ON into the flag S_Empty (S44) and disables the ink discharge through the recording head 39. In the image recording process, when determining that the flag S_Empty is set ON (S11: ON), the controller 230 displays the notification screen S_Empty on the display 17 (S12).

In the above state (or the state of the controller 230 disabling the ink discharge through the recording head 39 and displaying the notification screen S_Empty on the display 17), as shown in FIG. 19B, the ink cartridge 50 is in the state of no ink flowing toward the subtank 100, or in the state of the ink amount Vc being zero (Vc=0). Also, the liquid level of the ink in the subtank 100 is lower than the predetermined level B and reaches the position near the upper end of the communication port 129. Image recording cannot be performed unless the ink discharge through the recording head 39 is enabled by the user replacing the ink cartridge 50 in the empty state with a fresh ink cartridge 50 or with an ink cartridge 50 storing a sufficient amount of ink.

In the process of replacing the ink cartridge 50 by the user, the controller 230 obtains a low-level signal from the installation sensor 154, and then obtains a high-level signal from the installation sensor 154, and further obtains a low-level signal from the installation sensor 154 (S14: Yes). More specifically, in the process of removing the ink cartridge 50 from the installation case 71, the controller 230 obtains a low-level signal from the installation sensor 154 and then obtains a high-level signal from the installation sensor 154. In the subsequent process of inserting the ink cartridge 50 into the installation case 71, the controller 230 obtains a high-level signal from the installation sensor 154 and then obtains a low-level signal from the installation sensor 154.

In the empty-state temporary canceling process, the controller 230 reads CTG information from the memory of the IC chip 66 through the contact 152 and stores the read CTG information into the EEPROM 234 (S251). When the ink cartridge 50 is replaced with a fresh ink cartridge 50, an initial ink amount Vc0 is read from the memory of the IC chip 66 as the ink amount Vc. The identification information is also read from the memory of the IC chip 66.

The controller 230 then compares the ink amount Vc (here, Vc0) read from the memory of the IC chip 66 with the threshold value Vmin (S252). The threshold value Vmin is equivalent to the volume of a part of the second reservoir 105 between the position near the upper end of the communication port 129 and the predetermined level B. When the replaced ink cartridge 50 stores the amount of ink equal to or greater than the threshold value Vmin in the first reservoir 53, the ink is transferred from the first reservoir 53 of the ink cartridge 50 to the second reservoir 105 of the subtank 100, and thus the liquid level of the ink in the second reservoir 105 reaches the predetermined level B or higher. The cartridge is replaced with a fresh ink cartridge 50, and thus the ink amount Vc is the initial ink amount Vc0 equal to or greater than the threshold value Vmin.

When determining that the ink amount Vc read from the memory of the IC chip 66 is equal to or greater than threshold value Vmin (S252: Yes), the controller 230 compares the identification information read from the memory of the IC chip 66 with the identification information read from the memory of the IC chip 66 of the ink cartridge 50 yet to be replaced (S253). In the present embodiment, the identification information is the serial number of the ink cartridge 50. The identification information read from the memory of the IC chip 66 of the ink cartridge 50 yet to be replaced is stored in the EEPROM 234. In this case, with the cartridge replaced with a fresh ink cartridge 50, the compared two sets of identification information disagree with each other.

When determining that the ink amount Vc read from the memory of the IC chip 66 is smaller than threshold value Vmin (S252: No), the controller 230 completes the empty-state temporary canceling process. When the ink amount Vc read from the memory of the IC chip 66 is smaller than the threshold value Vmin, the liquid level of the ink in the second reservoir 105 does not reach the predetermined level B or higher despite any ink transfer from the first reservoir 53 of the replaced ink cartridge 50 to the second reservoir 105 of the subtank 100, and thus the empty state Empty is not to be canceled temporarily.

When determining that the compared two sets of identification information disagree with each other (S253: Yes), the controller 230 stores the count values TN and SN1, the ink amount Vc, and the ink amount Vs stored in the EEPROM 234 into another storage area of the EEPROM 234 (S254). The count values TN and SN1, the ink amount Vc, and the ink amount Vs stored in the other storage area of the EEPROM 234 are used when the empty state is not fully canceled after the empty state Empty is temporarily canceled as described later.

When determining that the compared two sets of identification information do not disagree with each other, or in other words, the two sets of information agree with each other (S253: No), the controller 230 completes the empty-state temporary canceling process. If the ink cartridge 50 remains the same before and after the replacement, ink is not transferred from the first reservoir 53 to the second reservoir 105 of the subtank 100, and thus the empty state is not to be canceled temporarily.

The controller 230 calculates the total amount Vt after the cartridge replacement (S255). In detail, the controller 230 calculates the ink amount Vs before the cartridge replacement (equal to the total amount Vt) based on the count value SN before the cartridge replacement stored in the EEPROM 234 and an ink amount Vsc stored in the ROM 232, and stores the ink amount into the EEPROM 234. Based on the calculated ink amount Vs and the ink amount Vc read from the memory of the IC chip 66 of the replaced ink cartridge 50, the total amount Vt after the cartridge replacement is calculated. More specifically, the ink amount Vc stored in the first reservoir 53 of the newly installed ink cartridge 50 is added to the ink amount Vs stored in the second reservoir 105 of the subtank 100 immediately before the ink cartridge 50 is replaced. The controller 230 thus calculates the sum of the ink amount Vc read from the memory of the IC chip 66 of the replaced ink cartridge 50 and the ink amount Vs before the cartridge replacement stored in the EEPROM 234 as the total amount Vt (Vt=Vs+Vc).

The controller 230 calculates the ink amount Vc and the ink amount Vs when ink transfer from the first reservoir 53 to the second reservoir 105 is complete based on the calculated total amount Vt and the function F read from the EEPROM 234 (S255). When the ink cartridge 50 is replaced, the ink stored in the first reservoir 53 of the newly installed ink cartridge 50 flows into the second reservoir 105 of the subtank 100 through the liquid flow path 103. As a result, the ink amount Vc of the first reservoir 53 decreases, and the ink amount Vs of the second reservoir 105 increases. The liquid level of the ink in the second reservoir 105 of the subtank 100 then reaches the imaginary line L, and the equilibrium state is entered.

The controller 230 resets the count values TN and SN1 stored in the EEPROM 234 after performing the processing in step S254 (S256). This sets the count values TN and SN1 to their initial values (zero).

The controller 230 then displays the obtained total amount Vt and one of the ink amount Vc and the ink amount Vs on the display 17 (S257). The controller 230 stores the calculated ink amount Vc into the memory of the IC chip 66 through the contact 152 (S258).

The controller 230 substitutes the value indicating OFF into each of the flag S_Empty and the flag C_Empty (S259). The controller 230 substitutes the value indicating ON into the temporary canceling flag (S260). The controller 230 enables the ink discharge through the recording head 39 when all the four flags S_Empty are set OFF. The controller 230 deletes the notification screen S_Empty and the notification screen C_Empty from the display 17 (S261), and completes the empty-state temporary canceling process.

Operational Effects of Third Embodiment

The structure according to the third embodiment can delete the notification screen S_Empty from the display 17 to enable the image recording after the ink cartridge 50 is replaced and before the liquid level of the ink stored in the second reservoir 105 of the subtank 100 reaches the predetermined level B or higher. Thus, the multifunction peripheral 10 can start image recording without the user waiting after replacement of the ink cartridge 50. Image recording remains enabled after replacement of the ink cartridge 50 without the user waiting, and thus without causing the user to worry about failures of the multifunction peripheral 10 or inconvenience after replacement of the main tank.

When the count value SN2 reaches equal to or greater than the threshold value $N_{th2}$ in the image recording performed after the notification screen S_Empty is deleted, the notification screen S_Empty appears on the display 17 again, and the image recording is disabled.

If the ink amount Vc stored in the replaced ink cartridge 50 is small, the flow rate of the ink to the subtank 100 from the ink cartridge 50 is small. In this case, the time taken by the ink transferred from the ink cartridge 50 to the subtank 100 for the liquid level of the second reservoir 105 to reach the predetermined level B or higher is relatively long. If image recording with a large amount of ink discharge through the recording head 39 is performed during this period of time, air can enter the recording head 39. However, when the wait time Tw elapses after the empty-state temporary canceling state is entered, the notification screen S_Empty appears on the display 17 again, disabling the image recording and preventing air from entering the recording head 39.

In the empty-state temporary canceling state, the image recording suspended before the liquid level sensor 155 outputs a low-level signal is resumed after the liquid level sensor 155 outputs a low-level signal.

In the state of the non-residual amount flag being ON, the controller 230 ends the empty-state temporary canceling state after entering the empty-state temporary canceling state to enter the empty ink state immediately before temporarily canceling the empty state Empty. This prevents air from entering the recording head 39.

While waiting for the wait time Tw to elapse, the controller 230 displays a screen notifying that the ink is flowing into the subtank 100 from the ink cartridge 50 on the display 17. The user can be notified to wait without replacing the cartridge again.

Modification 1 of Third Embodiment

In the third embodiment, the ink discharge through the recording head 39 refers to image recording on a sheet. However, the ink discharge through the recording head 39 may be a purge for forcibly discharging the ink through the nozzles 40 of the recording head 39.

For example, the controller 230 can perform a large amount of purge for discharging a large amount (an example of a second amount) of ink through the nozzles 40 of the recording head 39, and a small amount of purge for discharging a small amount (an example of a first amount) of ink. The multifunction peripheral 10 has such two different purge modes. A user's input or a maintenance program causes the controller 230 to selectively use one of the two purge modes.

Figure 29:
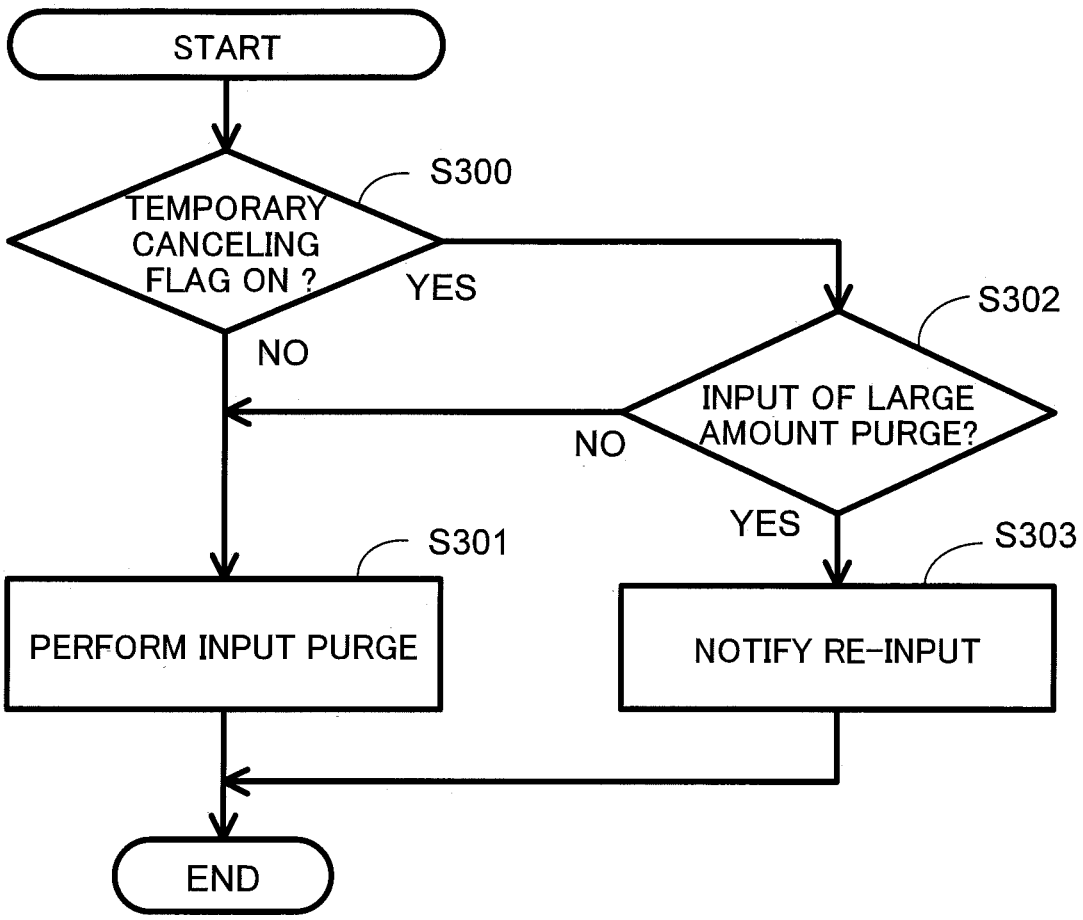
FIG. 29 is a flowchart according to a modification 1 of the third embodiment.

As shown in FIG. 29, in a state other than the empty-state temporary canceling state, in other words, in the state of the temporary canceling flag being OFF (S300: No), the controller 230 performs a purge in accordance with an input (S301).

In contrast, in the empty-state temporary canceling state, in other words, in the state of the temporary canceling flag being ON (S300: Yes), the controller 230 determines whether the input indicates a large amount of purge (S302). When the input does not indicate a large amount of purge (S302: No), the controller 230 performs a purge, more specifically, a small amount of purge, in accordance with the input (S301). When the input indicates a large amount of purge (S302: Yes), the controller 230 displays a screen for prompting re-input on the display 17 (S303). Thus, in the empty-state temporary canceling state, the controller 230 rejects an instruction for a large amount of purge (an example of a second instruction), but accepts only an instruction for a small amount of purge (an example of a first instruction).

When receiving an instruction for a large amount of purge in the empty-state temporary canceling state, the controller 230 may perform a small amount of purge instead of a large amount of purge. In addition to the image recording or the purge, the ink may be discharged through the recording head 39 by flushing in which ink droplets are continuously discharged from all the nozzles 40 of the recording head 39.

Modification 2 of Third Embodiment

Although the subtank 100 includes the liquid level sensor 155 in the above embodiments, the liquid level sensor 155 may be eliminated. The structure without the liquid level sensor 155 does not use the first count value SN1, which starts counting up in response to a high-level signal output from the liquid level sensor 155. The controller 230 determines the empty ink state using the count value TN instead of the count value SN1.

More specifically, the controller 230 does not perform the processing in step S31 in the counting process, and does not perform the processing in steps S36 to S46. Instead of these steps, the controller 230 performs the processing in steps S32 to S35 when the temporary canceling flag is OFF, and substitutes the value indicating ON into the flag S_Empty when the count value TN (an example of a first count value) reaches a threshold (an example of a first threshold). This causes the notification screen S_Empty to appear on the display 17, disabling the ink discharge through the recording head 39. The controller 230 performs the empty-state fully canceling process (S46) when the temporary canceling flag is ON.

The controller 230 then performs the empty-state temporarily canceling process as described above. In the empty-state fully canceling process, the controller 230 does not perform the processing in steps S74 and S88 that is based on a signal output from the liquid level sensor 155.

Other Modifications of Third Embodiment

In the third embodiment, the controller 230 disables the ink discharge through the recording head 39 when the flag S_Empty is ON. However, the ink discharge through the recording head 39 may not be disabled, and the controller 230 may simply display the notification screen S_Empty on the display 17 when the flag S_Empty is ON. Similarly, the controller 230 disables the ink discharge through the recording head 39 when the non-residual ink flag is ON. However, the ink discharge through the recording head 39 may not be disabled, and the controller 230 may simply display the notification screen S_Empty on the display 17 when the flag S_Empty is ON. In contrast, the controller 230 may simply disable the ink discharge through the recording head 39 when the flag S_Empty is ON without displaying the notification screen S_Empty on the display 17. This prevents at least air entrapment described above. Similarly, the controller 230 may simply disable the ink discharge through the recording head 39 when the non-residual ink flag is ON without displaying the in-flow notification screen on the display 17.

The controller 230 substitutes the value indicating ON into the flag C_Empty when the signal received from the liquid level sensor 155 changes from a low level to a high level. In some embodiments, the controller 230 may substitute the value indicating ON into the flag C_Empty when the signal received from the liquid level sensor 155 changes from a low-level signal to a high-level signal, and the count value SN1 reaches the predetermined threshold.

In the third embodiment, the controller 230 stores the total amount Vt after replacement of the ink cartridge 50 into the EEPROM 234, and obtains the current total amount Vt by subtracting the ink amount equivalent to the count value TN from the total amount Vt. In some embodiments, the total amount Vt is updated and stored into the EEPROM 234 every time when the ink is discharged through the recording head 39. When the ink discharge through the recording head 39 is performed subsequently, the same ink amount as the discharged amount may be calculated based on the count value TN, and subtracted from the total amount Vt stored in the EEPROM 234 to update the total amount Vt.

In the image recording process according to the third embodiment, the operations in steps S11 to S17 excluding the image recording operation, or the operations in step S18 and subsequent steps, may be performed when the cover 48 is closed or when the power of the printer is turned on.

Modifications of Each Embodiment

In the above embodiments, the liquid level sensor 155 optically detects the liquid level of the ink in the second reservoir 105 using a prism with different reflectance values depending on whether the ink is in contact with the rear wall 112 of the second reservoir 105. However, the liquid level sensor 155 may have any structure to detect the liquid level of the ink in the second reservoir 105. For example, the second reservoir 105 may contain an actuator that rotates depending on whether the liquid level in the second reservoir 105 is lower than a boundary position B, and the liquid level sensor 155 may detect a detection target portion included in the actuator located at a detection position. In some embodiments, the liquid level of the ink in the second reservoir 105 may be detected with an electrode. The liquid level sensor 155 may also output different signals for different liquid levels in the first reservoir 53 of the ink cartridge 50, instead of outputting different signals for different liquid levels in the second reservoir 105 of the subtank 100.

In the above embodiments, the controller 230 performs the processing in steps S15 and S145 in response to a low-level signal, a high-level signal, and a low-level signal received in the stated order from the installation sensor 154. The controller 230 performs the processing in steps S15 and S145 in response to the ink cartridge 50 installed in the installation case 71 previously containing no ink cartridge 50. More specifically, the controller 230 may perform the processing in steps S15 and S145 when determining that the ink cartridge 50 is installed in the installation case 71. The controller 230 receiving a low-level signal from the installation sensor 154, then receiving a high-level signal from the installation sensor 154, and further receiving a low-level signal from the installation sensor 154 is an example of the controller 230 determining that the cartridge is installed in the installation case 71. Other examples of the controller 230 determining that the ink cartridge 50 is installed in the installation case 71 will be described below.

For example, the controller 230 receives a low-level signal after receiving a high-level signal from the cover sensor 88. The controller 230 then reads identification information from the memory of the IC chip 66 and compares the read identification information with identification information for the ink cartridge 50 yet to be replaced stored in the EEPROM 234. When determining that the identification information read from the memory of the IC chip 66 differs from the identification information stored in the EEPROM 234, the controller 230 may perform the processing in steps S15 and S145. More specifically, an example of the controller 230 determining that the ink cartridge 50 is installed in the installation case 71 includes the controller 230 reading identification information from the memory of the IC chip 66 and comparing the read identification information with identification information for the ink cartridge 50 yet to be replaced stored in the EEPROM 234, and determining that the identification information read from the memory of the IC chip 66 differs from the identification information stored in the EEPROM 234.

For example, the controller 230 receives a low-level signal after receiving a high-level signal from the cover sensor 88. The controller 230 then displays, to the user, a confirmation screen on the display 17 indicating whether an ink cartridge 50 is newly installed in the installation case 71. The controller 230 receives an input corresponding to the confirmation screen through the operation panel 22 while the confirmation screen appears on the display 17. The controller 230 performs the processing in steps S15 and S145 when the received input corresponds to an ink cartridge 50 newly installed in the installation case 71. More specifically, an example of the controller 230 determining that the ink cartridge 50 is installed in the installation case 71 includes the controller 230 receiving a low-level signal after receiving a high-level signal from the cover sensor 88, displaying, to the user, a confirmation screen on the display 17 indicating whether an ink cartridge 50 is newly installed in the installation case 71, and receiving an input corresponding to the confirmation screen through the operation panel 22 while the confirmation screen appears on the display 17, with the received input then corresponding to an ink cartridge 50 newly installed in the installation case 71.

In the above embodiments, when at least one of the four flags S_Empty is set ON, all the four subtanks 100 are disabled from discharging ink through the recording head 39. The subtank 100 for which the flag S_Empty is set ON may be selectively disabled from discharging ink through the recording head 39. When at least one of the flags S_Empty associated with magenta, cyan, and yellow is set ON, and the flag S_Empty associated with black is set OFF, the discharge of the magenta, cyan, and yellow inks may be disabled, and the discharge of the black ink may be enabled.

In the above embodiments, the controller 230 disables the ink discharge through the recording head 39 when the flag S_Empty is ON. However, the ink discharge through the recording head 39 may not be disabled, and the controller 230 may simply display the notification screen S_Empty on the display 17 when the flag S_Empty is ON.

The IC chip 66 is electrically connectable to the contact 152 through contact. However, an information medium and an interface such as near field communication (NFC) or radio frequency identification (RFID) may be used for reading and writing data in a contactless manner using radio waves.

In the embodiments described above, the ink is an example of liquid. However, the liquid may be a pretreatment liquid discharged to a sheet or another substrate before ink is applied in image recording, or may be water for cleaning the recording head 39.

What is claimed is:

1. A liquid discharge device, comprising:
a tank;
an installation case in which a cartridge is to be installed;
a head communicating with the tank;
a liquid level sensor; and
a controller,
wherein the cartridge includes a first liquid chamber storing liquid,
wherein the tank includes:
a second liquid chamber to store the liquid;
a liquid flow path and a gas flow path communicating with the second liquid chamber; and
an air communication path allowing the second liquid chamber to communicate with outside,
wherein the liquid flow path has a first end having a first opening communicating with the second liquid chamber, and a second end opposite to the first end and having a second opening that is open to outside,
wherein the gas flow path has a first end having a third opening communicating with the second liquid chamber, and a second end opposite to the first end and having a fourth opening that is open to outside,
in an installed state of the cartridge installed in the installation case and having the first liquid chamber in the cartridge communicating with the second opening of the liquid flow path and the fourth opening of the gas flow path in the tank:
the first liquid chamber includes a portion located higher than the second opening; and
the second liquid chamber includes a portion located lower than the third opening,
wherein the controller is configured to:
receive, from the liquid level sensor, a first signal output from the liquid level sensor when the second liquid chamber has a liquid level equal to or higher than a predetermined level;
receive, from the liquid level sensor, a second signal output from the liquid level sensor when the second liquid chamber has a liquid level lower than the predetermined level;
receive, after receiving the second signal, a discharge instruction to discharge liquid through the head, and updates a first count value to a value equivalent to an amount of liquid instructed to discharge in accordance with the discharge instruction;
disable discharging of the liquid through the head when the first count value reaches a first threshold;
determine whether the cartridge is installed in the installation case;

enable, in response to the cartridge determined to be installed in the installation case, discharging of the liquid through the head; and disable discharging of the liquid through the head when a first elapsed time from when the cartridge is determined to be installed in the installation case reaches a predetermined time and when the second signal is received from the liquid level sensor without receiving the first signal.

2. The liquid discharge device according to claim 1, further comprising:

a memory, wherein the controller is further configured to:

store the first count value into the memory in response to enabled discharging of the liquid through the head;

receive, after enabling discharging of the liquid through the head, a discharge instruction to discharge liquid through the head, and updates a second count value to a value equivalent to an amount of liquid instructed to discharge in accordance with the discharge instruction;

read the first count value stored in the memory and add the first count value and the second count value together to calculate a third count value when the first elapsed time reaches the predetermined time and when the second signal is received from the liquid level sensor; and update the third count value to the value equivalent to the amount of liquid instructed to discharge in accordance with the discharge instruction.

3. The liquid discharge device according to claim 1, further comprising:

an alarm, wherein the controller activates a first operation of the alarm when the first count value reaches the first threshold, and deactivates the first operation of the alarm in response to the cartridge determined to be installed in the installation case.

4. The liquid discharge device according to claim 1, wherein the controller is further configured to:

receive, after enabling discharging of the liquid through the head, a discharge instruction to discharge liquid through the head, and update a second count value to a value equivalent to an amount of liquid instructed to discharge in accordance with the discharge instruction;

disable discharging of the liquid through the head associated with the discharge instruction when the second signal is received from the liquid level sensor without receiving the first signal and when the second count value reaches a second threshold; and enable, after disabling discharging of the liquid through the head, the disabled discharging of the liquid through the head when the first signal is received from the liquid level sensor.

5. The liquid discharge device according to claim 4, further comprising:

a memory, wherein the controller is further configured to:

disable discharging of the liquid through the head when the second signal is received from the liquid level sensor and when the second count value reaches the second threshold;

update a first value indicating that a residual amount of liquid in the second liquid chamber stored in the memory is equal to or greater than a residual amount equivalent to the second threshold to a second value indicating that the residual amount of liquid in the second liquid chamber is smaller than the residual amount equivalent to the second threshold when the first elapsed time from when the cartridge is determined to be installed in the installation case reaches the predetermined time, when the second signal is received from the liquid level sensor, and when the second count value reaches the second threshold;

read, after disabling discharging of the liquid through the head, a value stored in the memory in response to the cartridge determined to be installed in the installation case; and enable, while the value read from the memory is the second value, discharging of the liquid through the head when the first signal is received from the liquid level sensor, and updates the second value stored in the memory to the first value.

6. The liquid discharge device according to claim 5, further comprising:

an alarm, wherein the controller is further configured to:

activate a first operation of the alarm in response to disabled discharging of the liquid through the head, and deactivate the first operation of the alarm in response to enabled discharging of the liquid through the head;

activate, after deactivating the first operation, a second operation of the alarm different from the first operation when the second signal is received from the liquid level sensor and when the second count value reaches the second threshold;

activate the first operation of the alarm when the first elapsed time reaches the predetermined time and when the second signal is received without receiving the first signal;

read, after activating the first operation of the alarm, a value stored in the memory in response to the cartridge determined to be installed in the installation case; and activate, while the value read from the memory is the second value, the second operation of the alarm, and deactivate the second operation of the alarm when the first signal is received from the liquid level sensor after the second operation is activated.

7. The liquid discharge device according to claim 4, wherein the controller is further configured to set the second threshold in accordance with a second elapsed time from when the cartridge is determined to be installed firstly in the installation case to when the first signal is received from the liquid level sensor.

* * * * *